US010959473B2

(12) United States Patent
Chen

(10) Patent No.: US 10,959,473 B2
(45) Date of Patent: Mar. 30, 2021

(54) PLASTIC HELMET MOUNTING ASSEMBLY

(71) Applicant: HMOUNT LTD, Ra'anana (IL)

(72) Inventor: Itay Shlomo Chen, Raanana (IL)

(73) Assignee: HMOUNT LTD, Ra'anana (IL)

( * ) Notice: Subject to any disclaimer, the term of this patent is extended or adjusted under 35 U.S.C. 154(b) by 0 days.

(21) Appl. No.: 15/912,623

(22) Filed: Mar. 6, 2018

(65) Prior Publication Data

US 2018/0192727 A1 Jul. 12, 2018

Related U.S. Application Data

(63) Continuation-in-part of application No. 15/722,006, filed on Oct. 2, 2017, which is a continuation-in-part of application No. 15/604,756, filed on May 25, 2017, now abandoned.

(30) Foreign Application Priority Data

Jan. 10, 2017 (IL) ..... 250044

(51) Int. Cl.
*A42B 3/04* (2006.01)
*A45F 5/02* (2006.01)

(52) U.S. Cl.
CPC ..... *A42B 3/0406* (2013.01); *A45F 5/02* (2013.01)

(58) Field of Classification Search
CPC ..... A42B 3/0406; A42B 3/30; A42B 3/04; A42B 3/08; A45F 5/02
USPC ..... 2/410
See application file for complete search history.

(56) References Cited

U.S. PATENT DOCUMENTS 2,908,911 A * 10/1959 Sowle ..... A42B 3/20 2/9
4,042,974 A * 8/1977 Morgan ..... A42B 3/326 2/9
4,804,260 A * 2/1989 Anger ..... G02C 5/143 351/118
5,146,245 A * 9/1992 Bolinger ..... G02C 5/143 351/118
5,467,479 A * 11/1995 Mattes ..... A42B 3/04 2/422
5,506,730 A * 4/1996 Morley ..... A42B 3/04 359/815
5,658,065 A * 8/1997 Jamieson ..... A42B 3/04 2/422
6,247,811 B1 * 6/2001 Rhoades ..... G02C 11/08 351/156

(Continued)

*Primary Examiner* — Alissa L Hoey
(74) *Attorney, Agent, or Firm* — Soroker Agmon Nordman

(57) ABSTRACT

A helmet mounting assembly for attaching helmet accessories to a helmet is provided. The assembly comprises a front-to-back mounting unit comprising at least one rail, grip or connector configured for connecting at least one helmet accessory to the front-to-back mounting unit, whereby the front-to-back mounting unit further comprises a back end configured to enable passage of securing elements there through, and at least one clipping element for attaching the back end of the front-to-back mounting unit to a back edge of the helmet via the securing elements, configured to further pass through the at least one clipping element, and forcefully pulling the front-to-back mounting unit onto the surface of the helmet to squeeze the mounting unit onto the helmet.

5 Claims, 46 Drawing Sheets

(56) References Cited

U.S. PATENT DOCUMENTS 6,374,407 B1 * 4/2002 Howell ..... A42B 3/04 2/422
7,219,370 B1 * 5/2007 Teetzel ..... A42B 3/04 2/422
7,963,426 B2 * 6/2011 Gruebel ..... H01R 13/73 224/181
8,531,592 B2 * 9/2013 Teetzel ..... H04N 9/79 348/373
9,101,175 B2 * 8/2015 Redpath ..... A42B 3/04
9,700,096 B2 * 7/2017 McGinn ..... A42B 3/326
9,924,753 B1 * 3/2018 Soto ..... F16B 2/18
10,383,387 B2 * 8/2019 Gendron ..... A42B 3/044
2004/0025231 A1 * 2/2004 Ide ..... A42B 3/20 2/425
2004/0199982 A1 * 10/2004 Wang-Lee ..... A42B 3/04 2/424
2006/0072007 A1 * 4/2006 Gilor ..... F16M 11/10 348/61
2006/0162036 A1 * 7/2006 McCalla ..... A42B 3/04 2/6.2
2006/0174401 A1 * 8/2006 Prendergast ..... G02B 27/0176 2/422
2007/0067894 A1 * 3/2007 Bourree ..... G02B 27/0176 2/422
2007/0114252 A1 * 5/2007 Gruebel ..... A42B 3/04 224/181
2008/0263752 A1 * 10/2008 Solinsky ..... A42B 3/042 2/422
2009/0077721 A1 * 3/2009 Prendergast ..... A42B 3/04 2/422
2010/0012692 A1 * 1/2010 Harris ..... A42B 3/04 224/181
2010/0083413 A1 * 4/2010 McGovern ..... A42B 3/04 2/6.6
2011/0072562 A1 * 3/2011 Prendergast ..... G02B 27/0176 2/422
2011/0099695 A1 * 5/2011 Siviter ..... A42B 3/04 2/422
2011/0127305 A1 * 6/2011 Yates ..... G02B 7/002 224/181
2011/0239354 A1 * 10/2011 Celona ..... A42B 3/04 2/422
2011/0314594 A1 * 12/2011 Rogers ..... A42B 3/04 2/421
2013/0086722 A1 * 4/2013 Teetzel ..... F41H 1/04 2/2.5
2014/0084120 A1 * 3/2014 Solinsky ..... A42B 3/042 248/227.1
2015/0026872 A1 * 1/2015 Giroux Bernier ..... A42B 1/24 2/422
2015/0089726 A1 * 4/2015 Long ..... A42B 3/003 2/422
2015/0282549 A1 * 10/2015 Lebel ..... A42B 3/04 2/422
2016/0058091 A1 * 3/2016 Sasaki ..... F16M 11/041 348/376
2016/0088891 A1 * 3/2016 Walsh ..... A42B 3/04 2/421
2016/0191172 A1 * 6/2016 Masarik ..... G02B 6/4246 361/679.01
2016/0324248 A1 * 11/2016 Winters ..... A42B 3/16
2018/0092419 A1 * 4/2018 Banducci ..... A42B 3/04
2018/0192725 A1 * 7/2018 Chen ..... A42B 3/04
2018/0192726 A1 * 7/2018 Chen ..... A42B 3/04

* cited by examiner

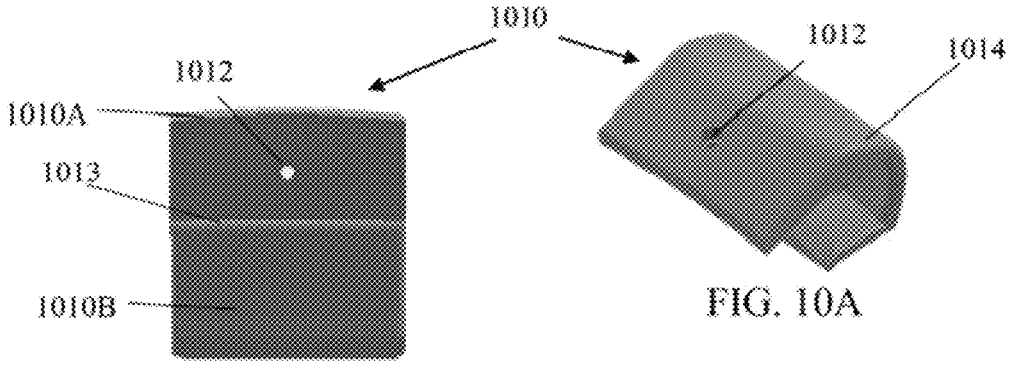
FIG. 10A
FIG. 10C
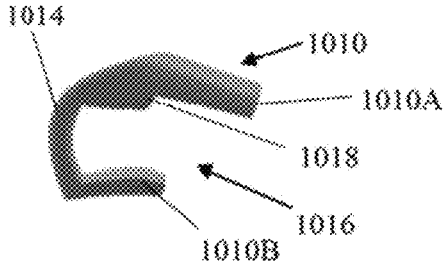
FIG. 10B
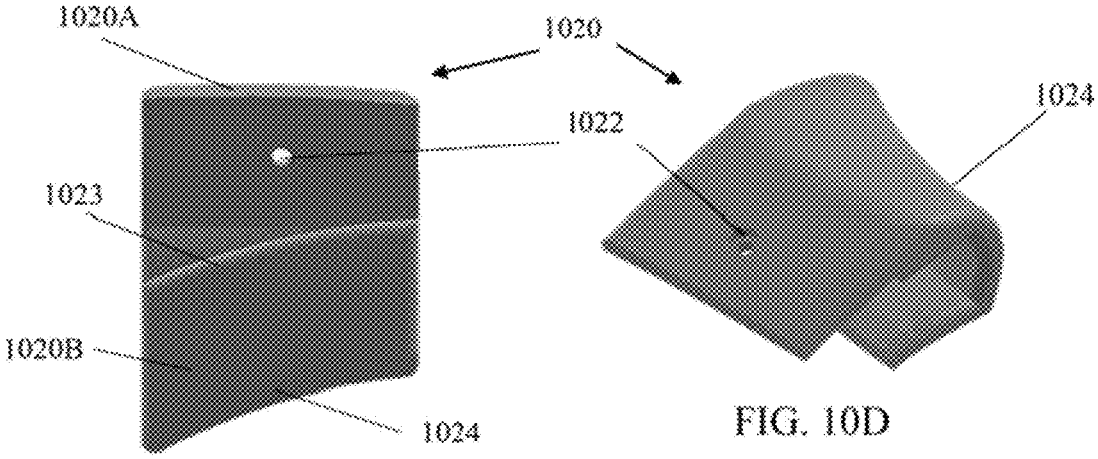
FIG. 10D
FIG. 10F
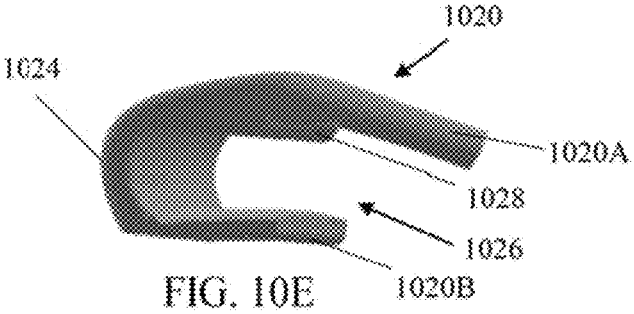
FIG. 10E FIG. 13H
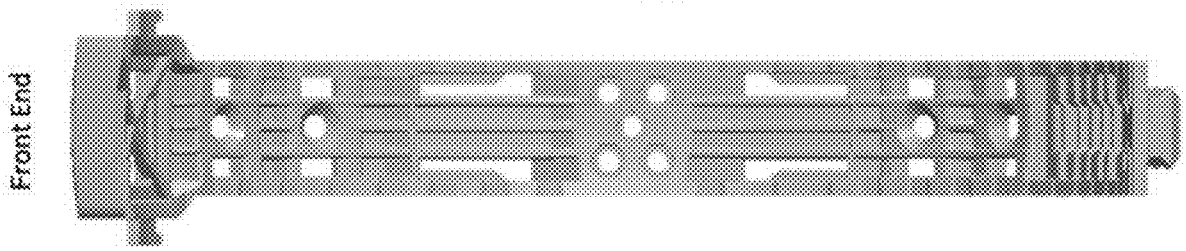
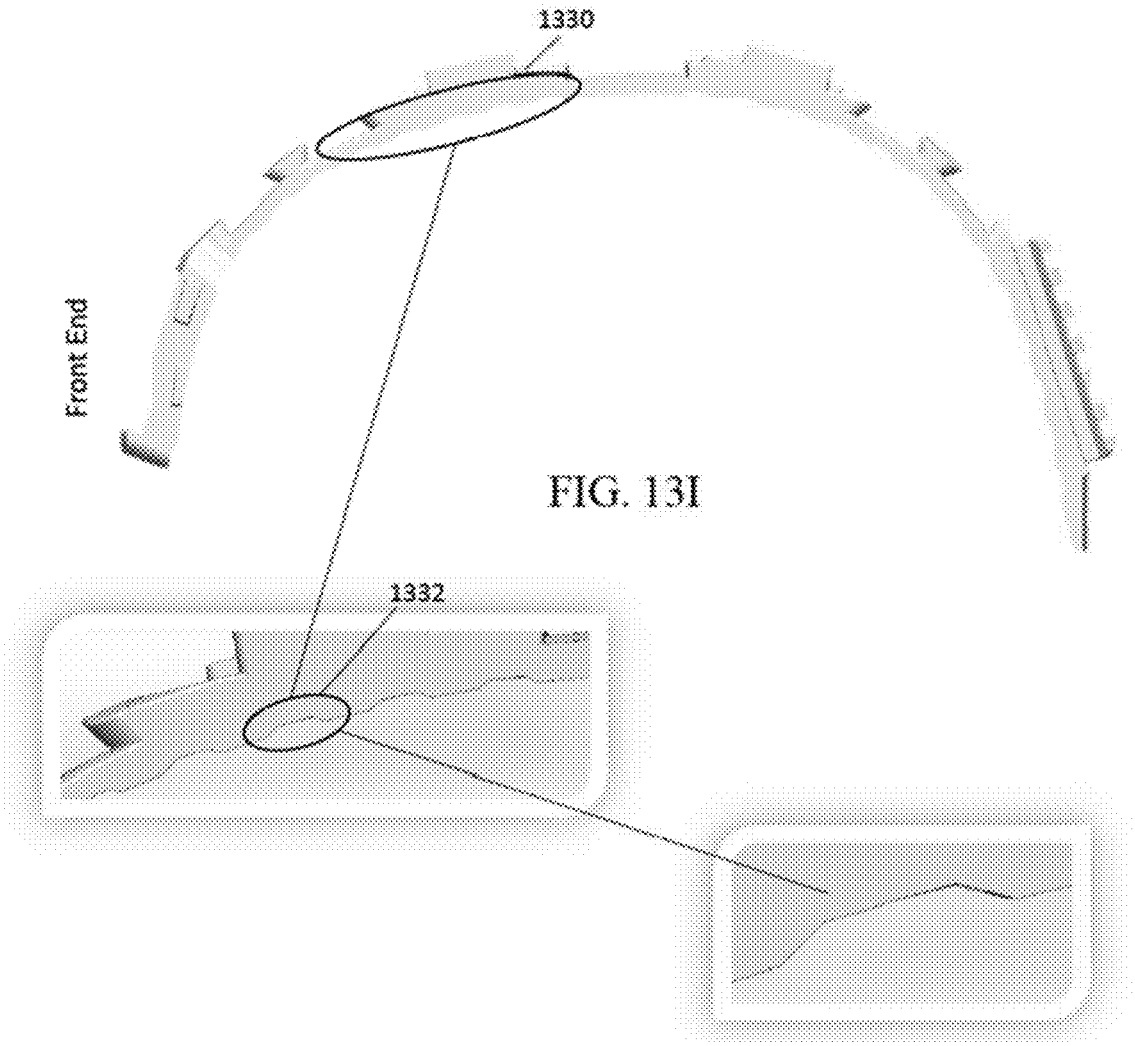
FIG. 13I FIG. 13K
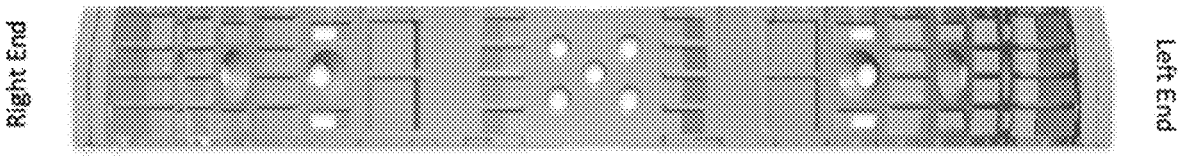
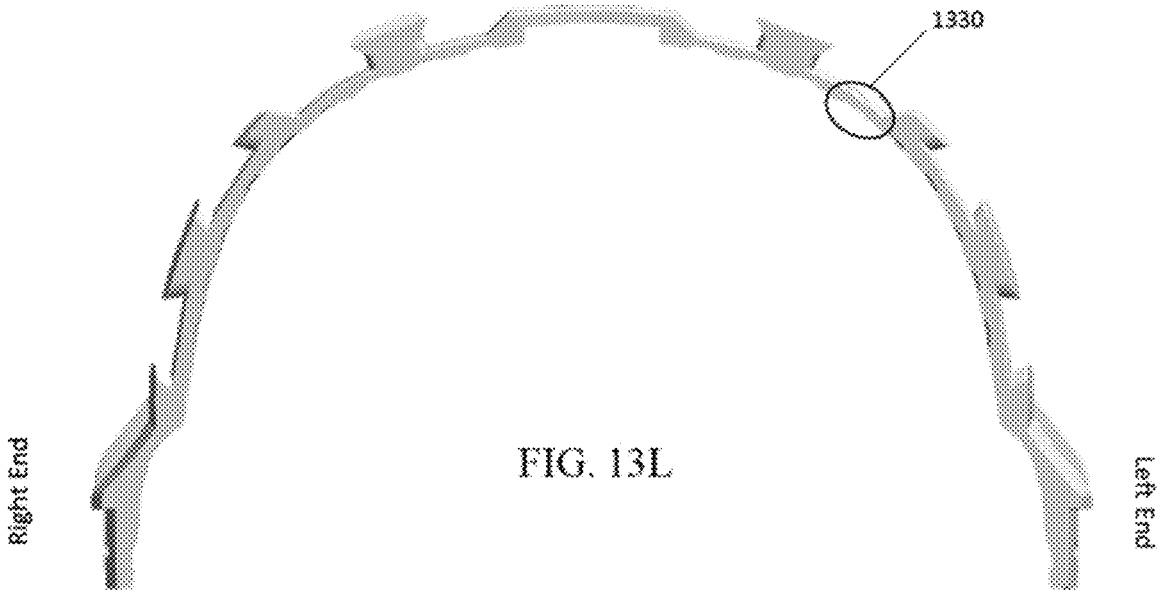
FIG. 13L

PLASTIC HELMET MOUNTING ASSEMBLY

FIELD OF THE INVENTION

The present disclosure generally relates to helmet assemblies, and more specifically to helmet mounting assemblies comprising a first mounting unit located across a second mounting unit.

BACKGROUND

Nowadays, helmets for military and/or law enforcement units (e.g., police) and/or civilian purposes (e.g., various sports), which are configured to carry various accessories e.g., a camera for example, night vision goggles), a flashlight or headphones, may comprise mounting units that are fixed to the helmet via screws, bolts, rivets or any other fastening means that penetrate through the helmet. Drilling holes through a helmet in order to enable use of such fastening means for attaching mounting units onto a helmet, may cause the helmet to be more exposed to damage e.g., to the possibility of breaking, at least around the areas of the drilled holes. For example, military helmets may be more exposed to penetration of projectiles or fragments through the helmet at those weak areas around the drilled holes. Furthermore, the drilled holes may cause protection degradation of a helmet with drilled holes with respect to a similar helmet comprising no holes.

Attempts to use glue instead of fastening means that penetrate through the helmet (or helmet shell) were not successful and did not provide a stable solution for attaching mounting units configured to carry helmet accessories onto the helmet.

There is therefore a need for an improved helmet assembly, which may be configured to have attached various helmet accessories, while avoiding the use of fastening means that penetrate through the helmet in order to attach the mounting units that are configured to carry the helmet accessories, thereby providing a more reliable, damage-proof helmet assembly.

SUMMARY

According to an aspect of some embodiments of the present invention, there is provided a helmet mounting assembly for attaching helmet accessories to a helmet, comprising: a front-to-back mounting unit comprising at least one rail, grip or connector configured for connecting at least one helmet accessory to the first mounting unit; at least one elastic friction pads attached to a bottom side of the front-to-back mounting unit; and at least one clipping elements for attaching a front and back edges of the front-to-back mounting unit to a front and back edges of the helmet, respectively, and pulling front-to-back mounting unit forcefully onto the helmet to squeeze the pad between the mounting unit and the helmet.

Optionally, the front-to-back mounting unit comprises on its bottom side a plurality of ribs or pits, and wherein the elastic friction pad comprises a protrusion designed in size and shape to fit snuggly between the ribs or in the pits of the mounting unit.

Optionally, the elastic friction pads are attached to the mounting unit by adhesive or glue material.

Optionally, a height of the pad is between 0.01 and 100 millimeters.

Optionally, the pad has a varying height along its length or width.

Optionally, the at least one pad, when attached to the bottom side of the mounting unit, leaves uncovered between 0.5 and 10 centimeters in the bottom side of the mounting unit.

Optionally, the helmet mounting assembly of claim includes a side-to-side mounting unit configured to be placed and connected across front-to-back mounting unit.

Optionally, the side-to-side mounting unit is a partial side-to-side mounting unit, which doesn't reach the side edges of the helmet when connected to the front-to-back mounting unit and the helmet.

Optionally, the side-to-side mounting unit is crossed by the front-to-back mounting unit in the middle of the side-to-side unit.

Optionally, on each side of the front-to-back mounting unit, the side-to-side mounting unit has a length of between 1 and 5 centimeters, when connected onto the surface of the helmet.

Optionally, on each side of the front-to-back mounting unit, the side-to-side mounting unit has a length of between 5 and 15 centimeters, when connected onto the surface of the helmet.

Optionally, on each side of the front-to-back mounting unit, the side-to-side mounting unit has a length of between 15 and 45 centimeters, when connected onto the surface of the helmet.

Optionally, the side-to-side mounting unit is directly attached to the front-to-back mounting unit and indirectly attached to the helmet via the front-to-back mounting unit.

Optionally, the side-to-side mounting unit and the front-to-back mounting unit comprise matching connection surfaces, the matching connection surfaces have matching shapes that facilitate positioning of the side-to-side mounting unit in a determined angle relative to the front-to-back mounting unit and prevent horizontal motion of the side-to-side mounting unit relative to the front-to-back mounting unit, when placed one on top of and across the other.

Optionally, the side-to-side mounting unit and the front-to-back mounting unit comprise matching connection surfaces, each comprising at least one hole in matching positions that coincide with each other when the side-to-side mounting unit is positioned across the front-to-back mounting unit with the connection surfaces one on top of the other.

Optionally, the side-to-side mounting unit comprises at least one elastic friction pad attached to a bottom side of the side-to-side mounting unit.

Optionally, the at least one elastic pad of the side-to-side mounting unit comprises at least one protrusion designed in size and shape to fit snuggly between corresponding ribs or into a pit on the bottom side of the side-to-side mounting unit.

Optionally at least one elastic pad of the side-to-side mounting unit are attached to the mounting unit by adhesive or glue material.

Optionally, the height of the at least one elastic pad of the side-to-side mounting unit is between about 0.01 and 100 millimeter and is thicker towards the edges of the side-to-side mounting unit than towards the middle of side-to-side mounting unit.

Optionally, the side-to-side mounting unit is a full side-to-side mounting unit, reaching side edges of the helmet when connected to the front-to-back mounting unit and adapted to be connected to the side edges of the helmet by side clipping elements.

BRIEF DESCRIPTION OF THE DRAWINGS

Some non-limiting exemplary embodiments or features of the disclosed subject matter are illustrated in the following drawings.

Identical or duplicate or equivalent or similar structures, elements, or parts that appear in one or more drawings are generally labeled with the same reference numeral, and may not be repeatedly labeled and/or described.

Figure 1A:
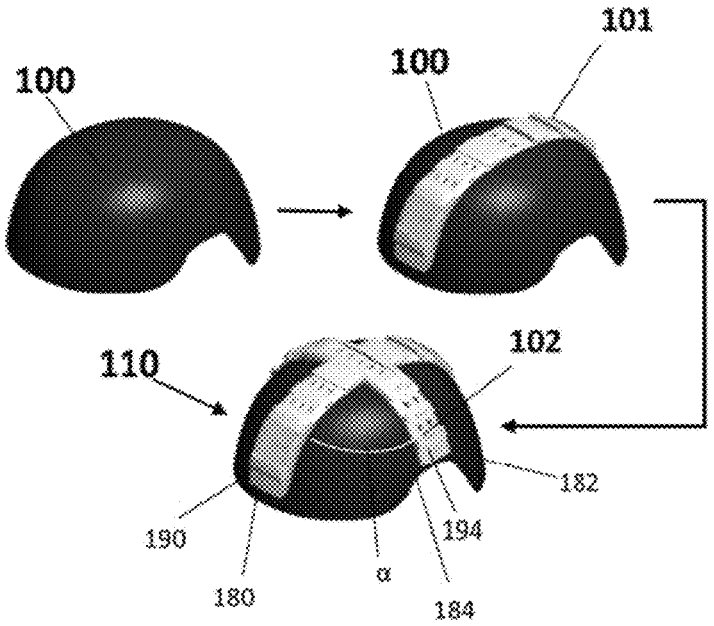

Dimensions of components and features shown in the figures are chosen for convenience or clarity of presentation and are not necessarily shown to scale or true perspective. For convenience or clarity, some elements or structures are not shown or shown only partially and/or with different perspective or from different point of views.

References to previously presented elements are implied without necessarily further citing the drawing or description in which they appear.

Figure 1B:
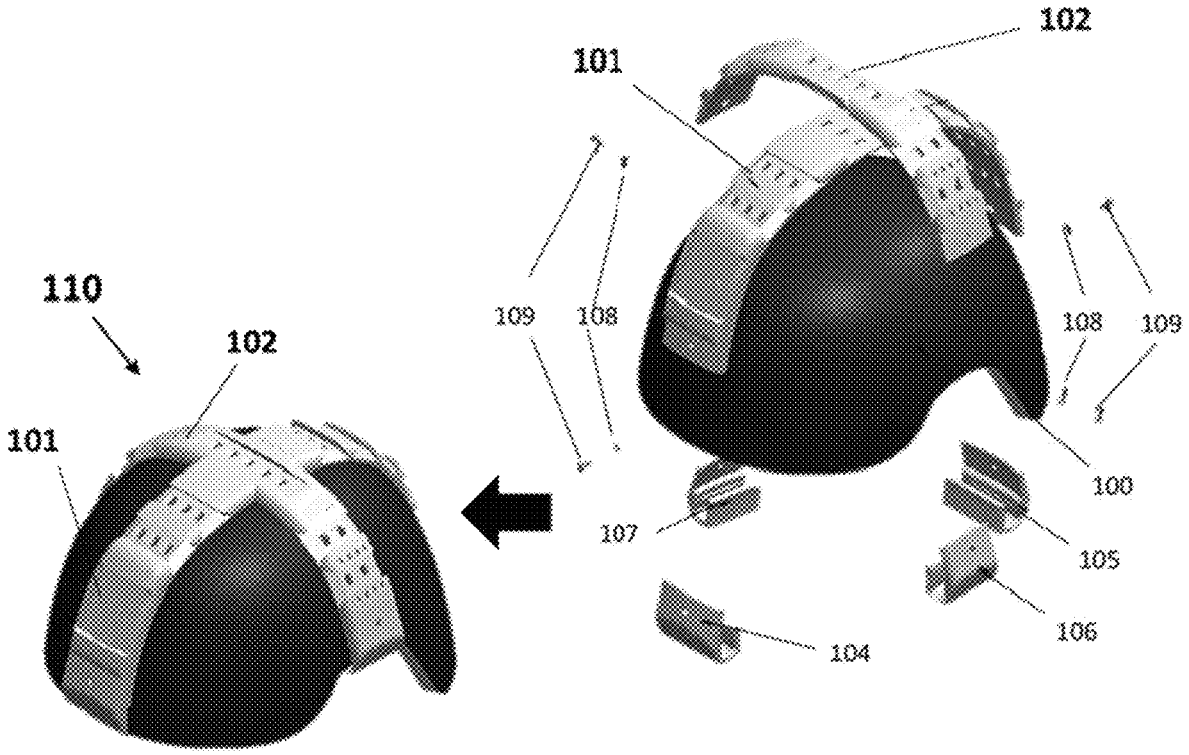
Figure 1C:
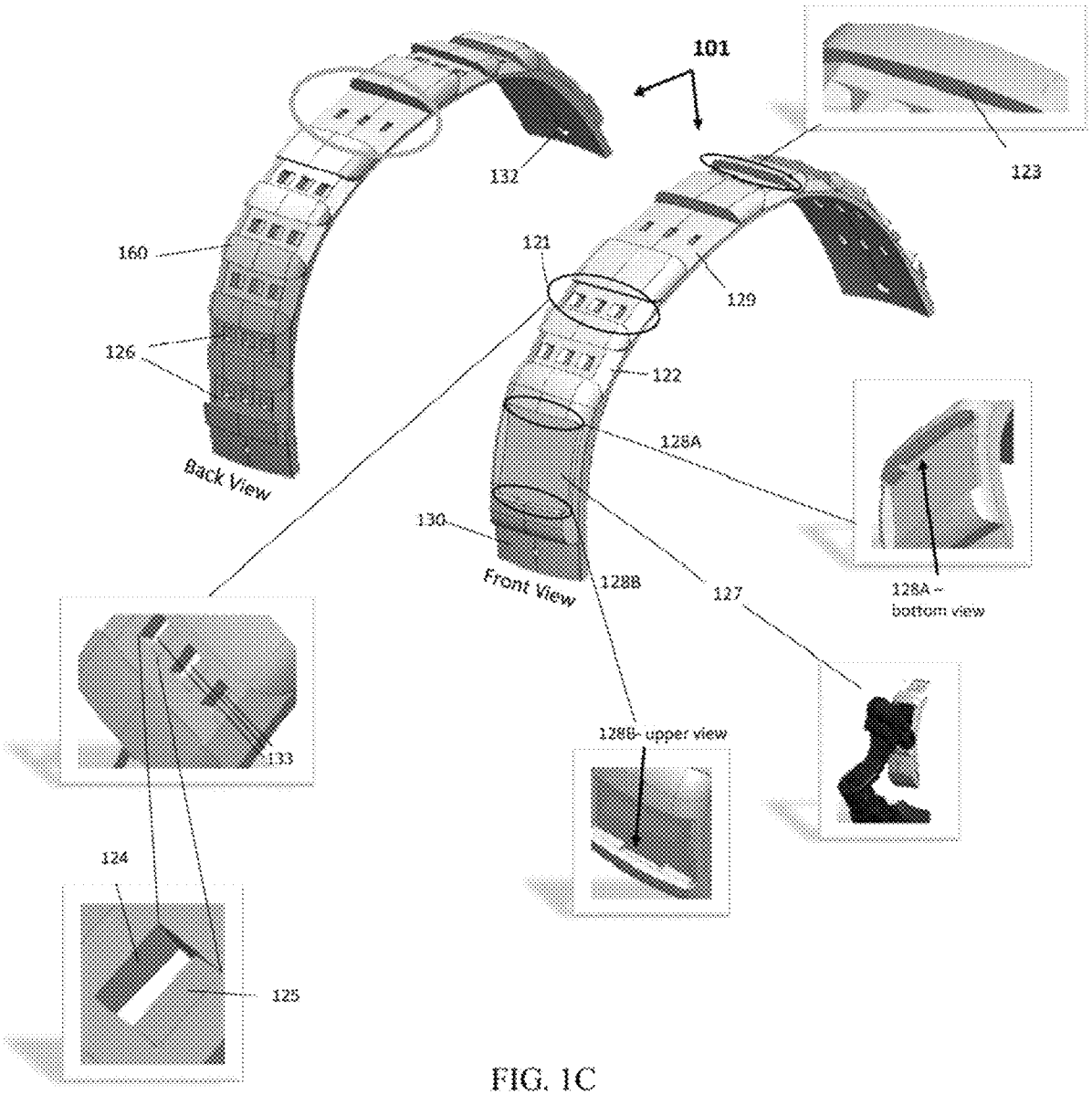
Figure 1D:
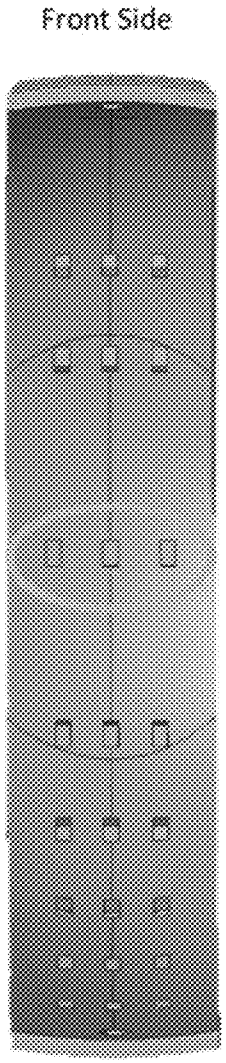
Figure 1E:
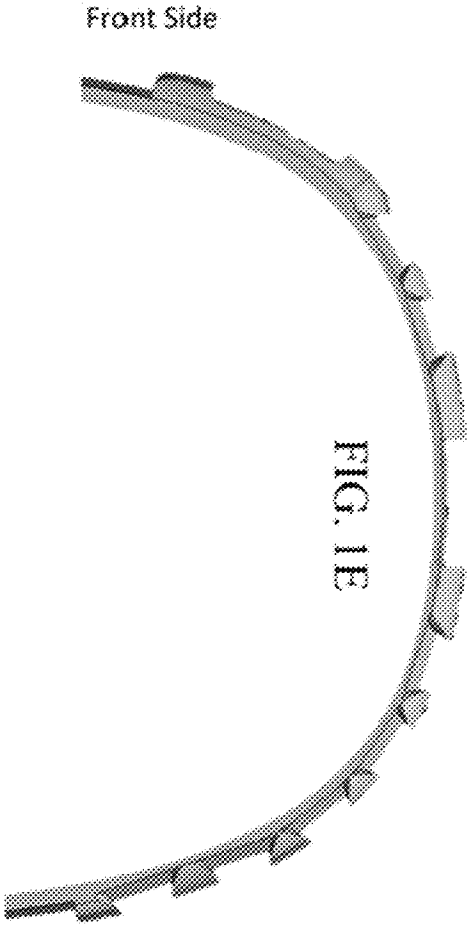
Figure 1F:
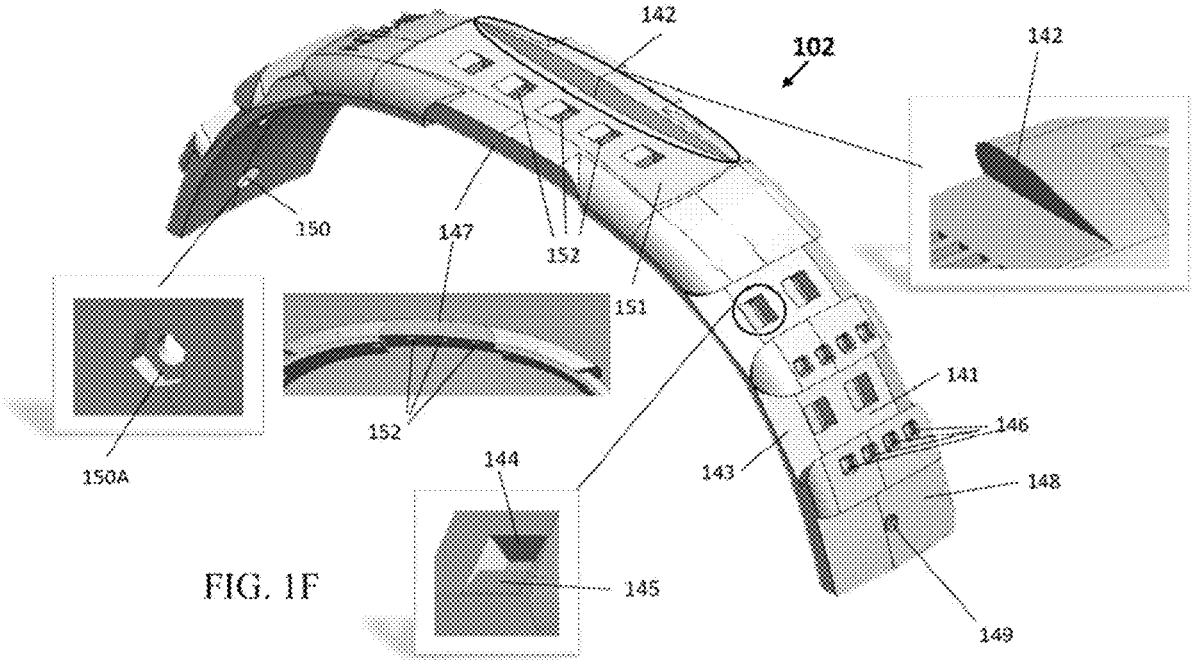
Figure 1G:
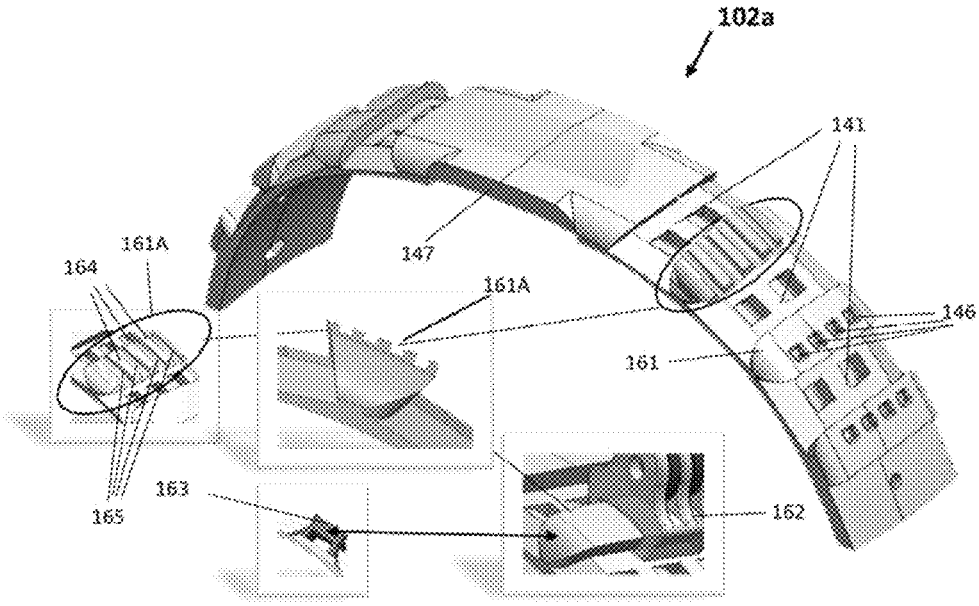
Figure 1H:
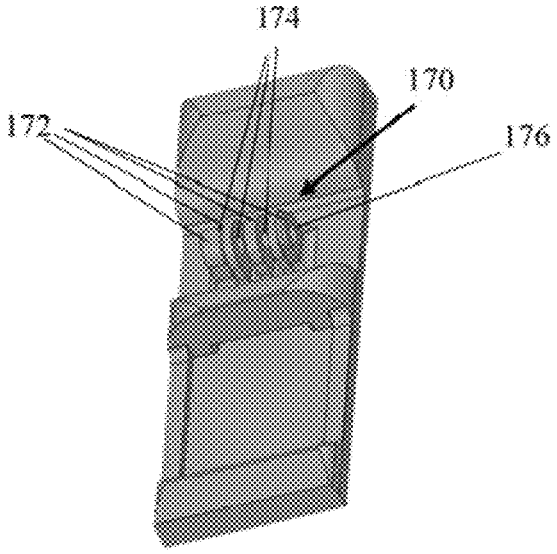
Figure 1I:
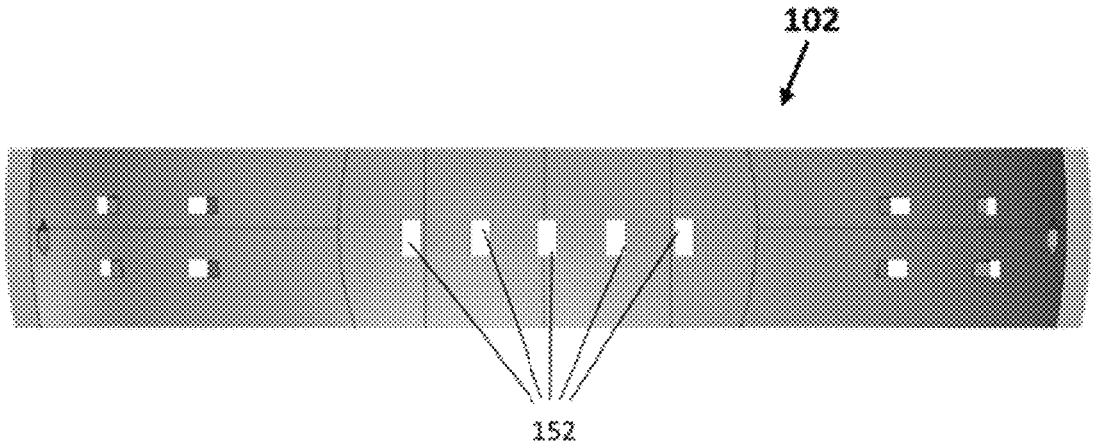
Figure 1J:
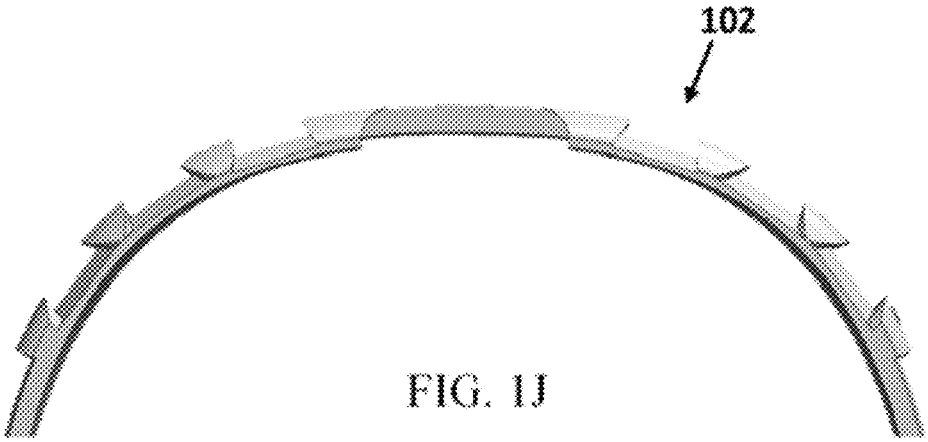
Figure 2A:
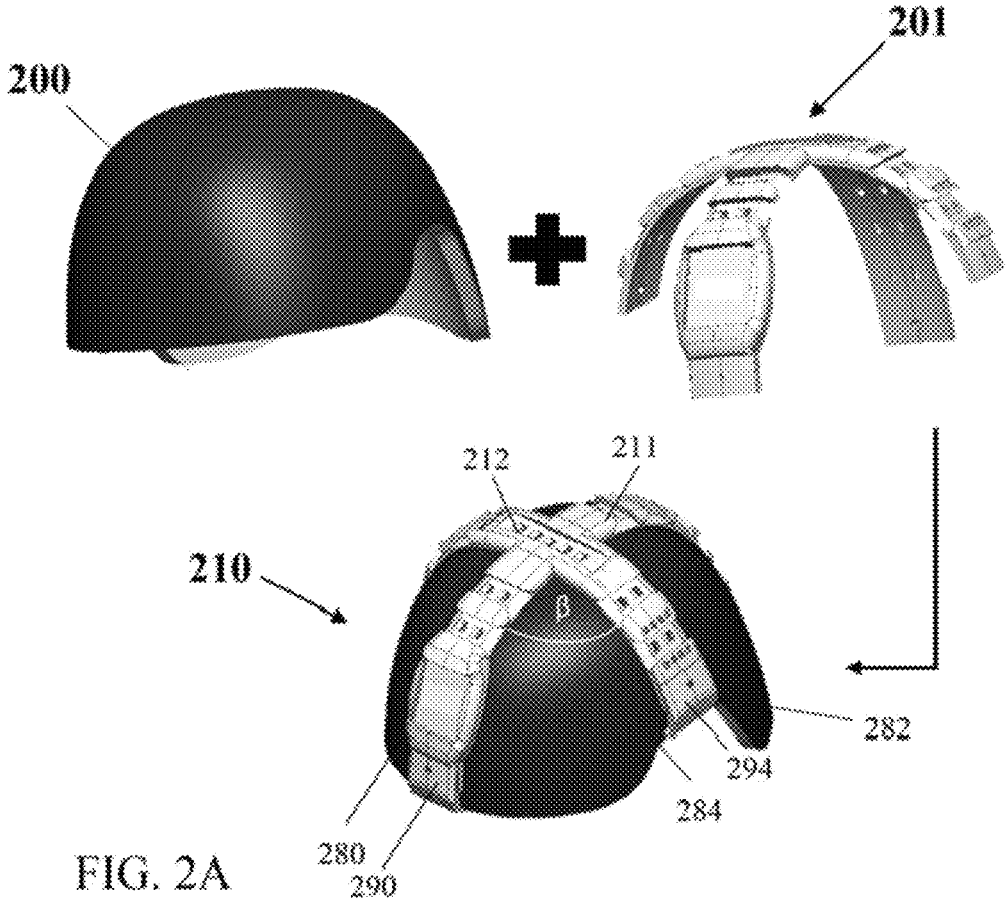
Figure 2B:
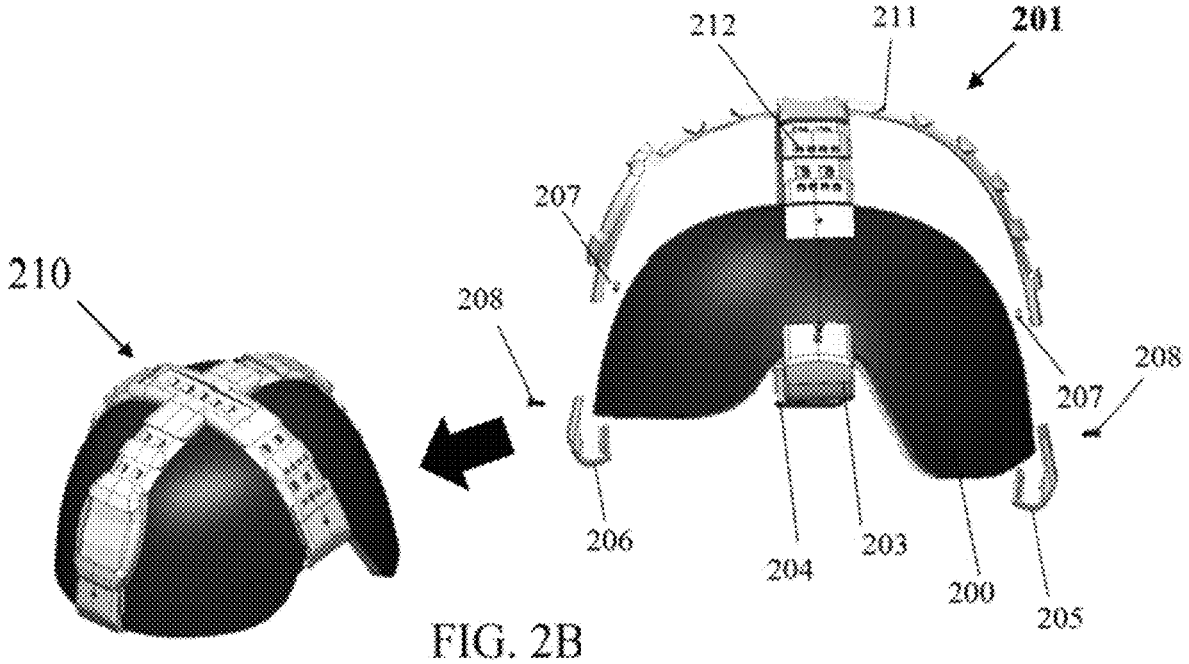
Figure 2C:
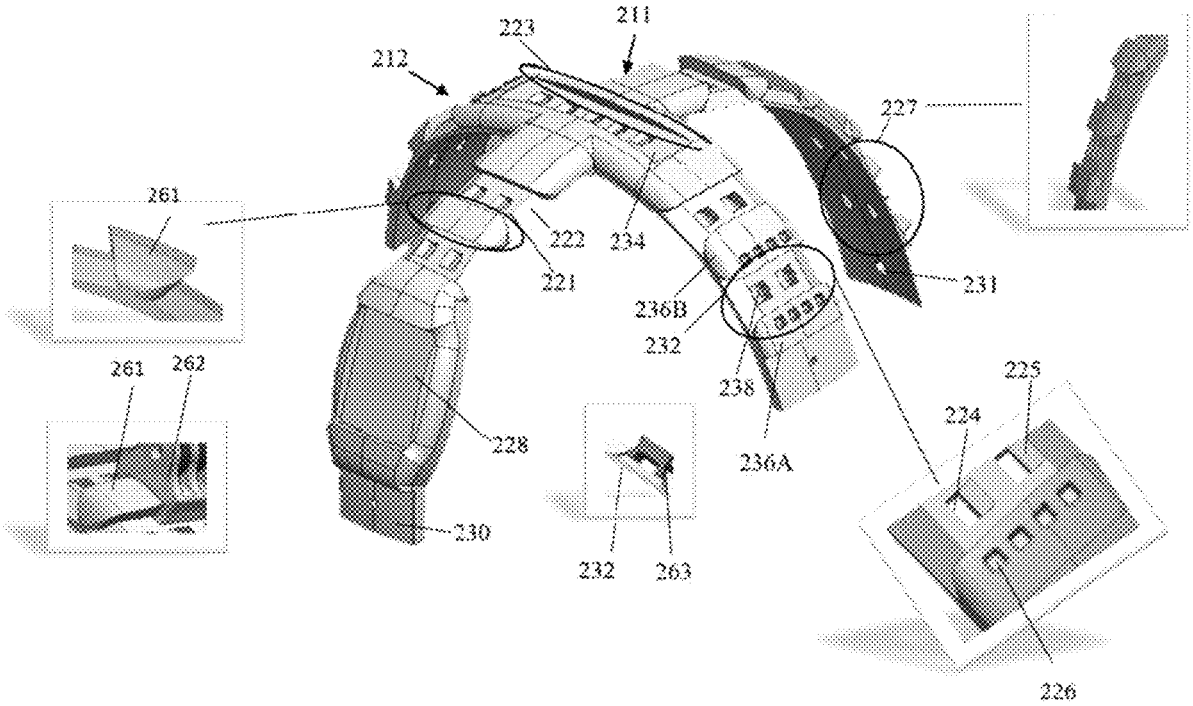
Figure 2D:
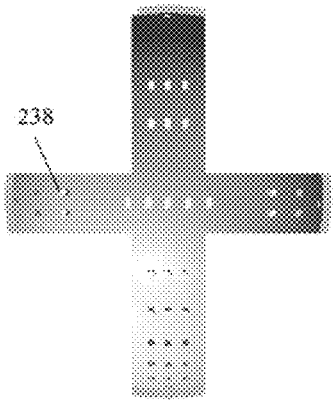
Figure 3:
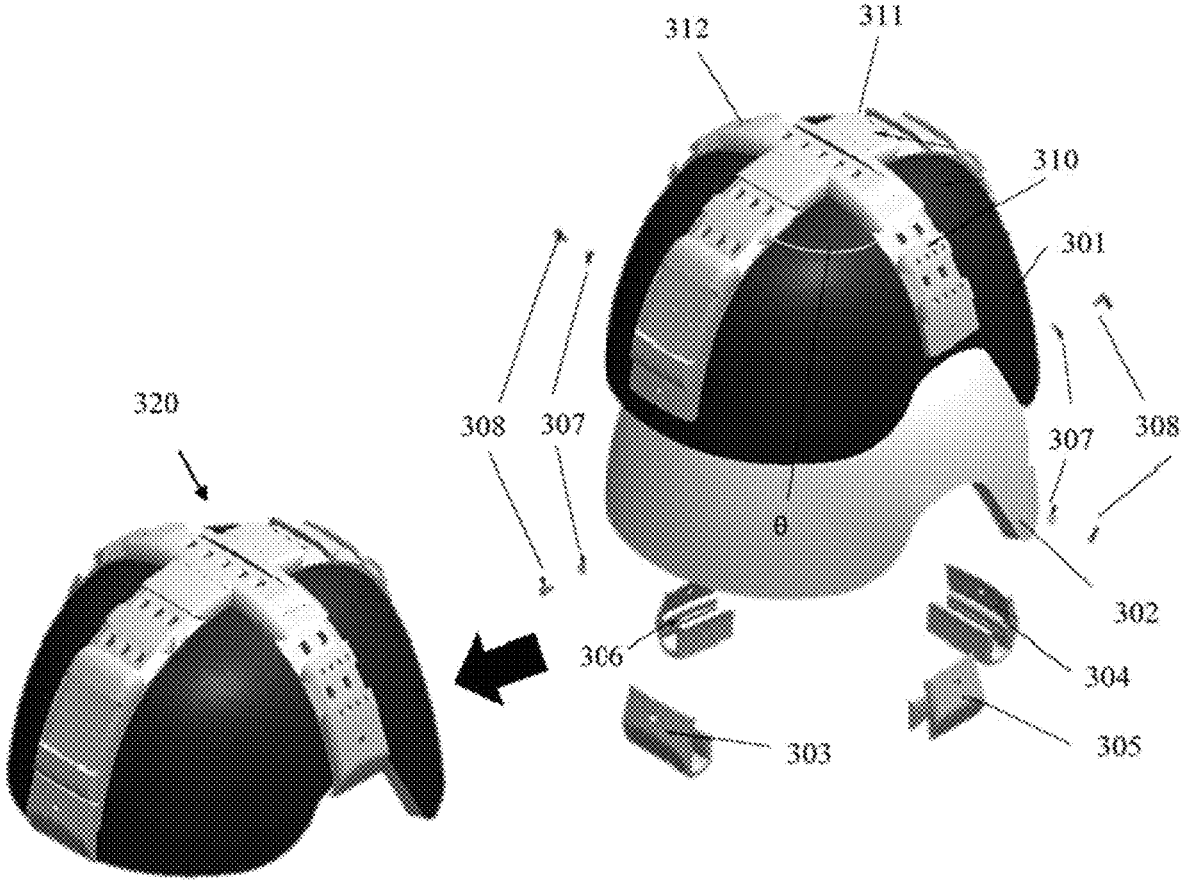
Figure 4:
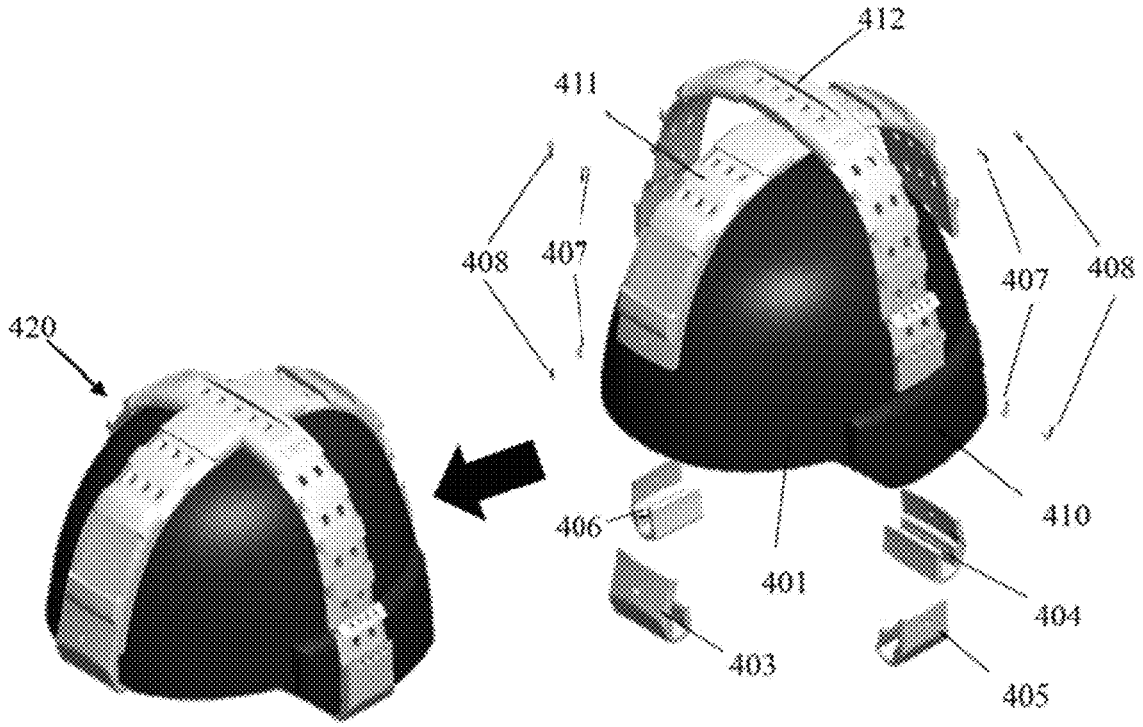
Figure 5A:
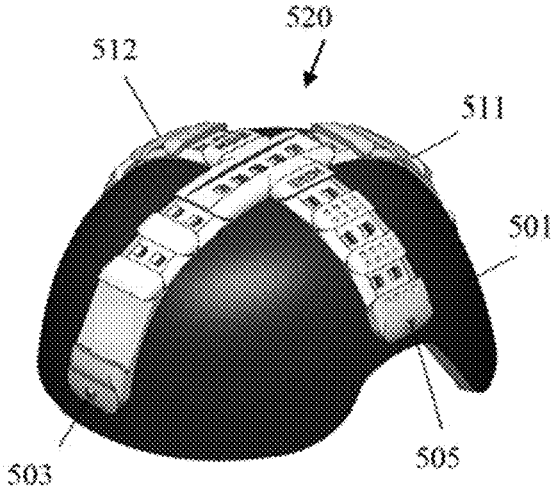
Figure 5B:
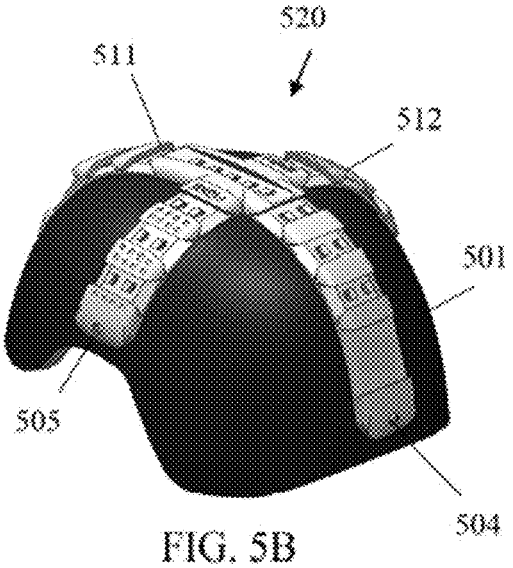
Figure 6A:
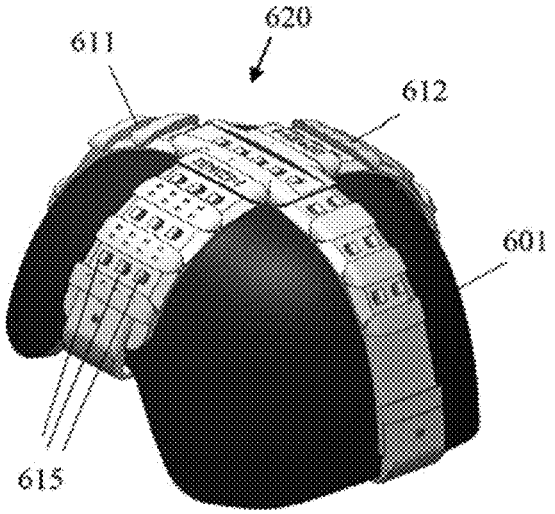
Figure 6B:
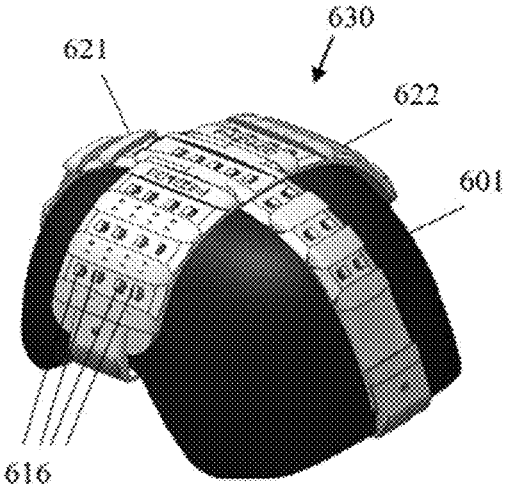
Figure 7A:
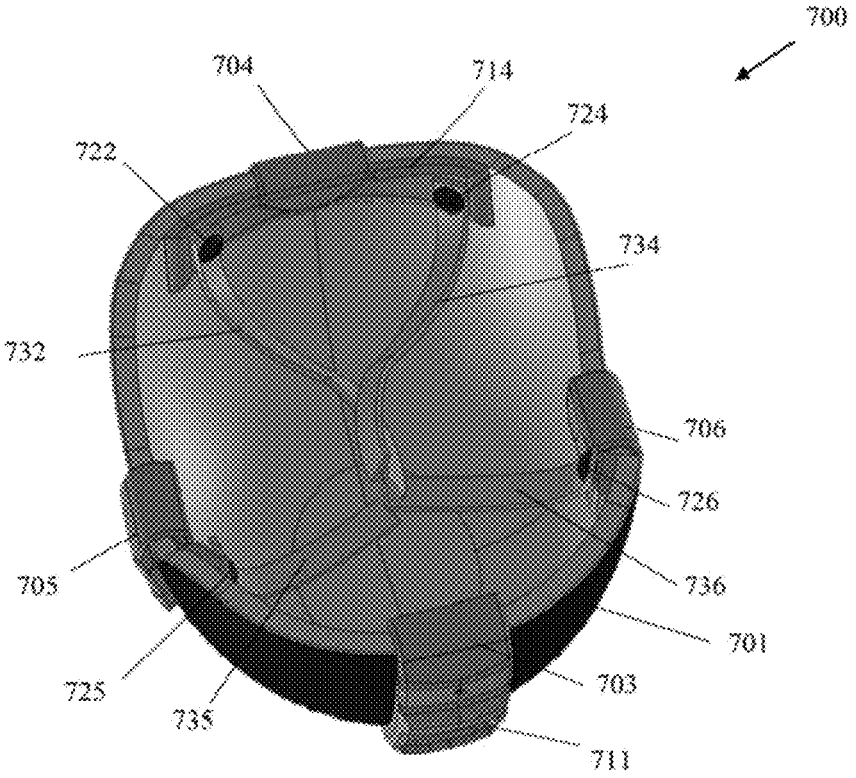
Figure 7B:
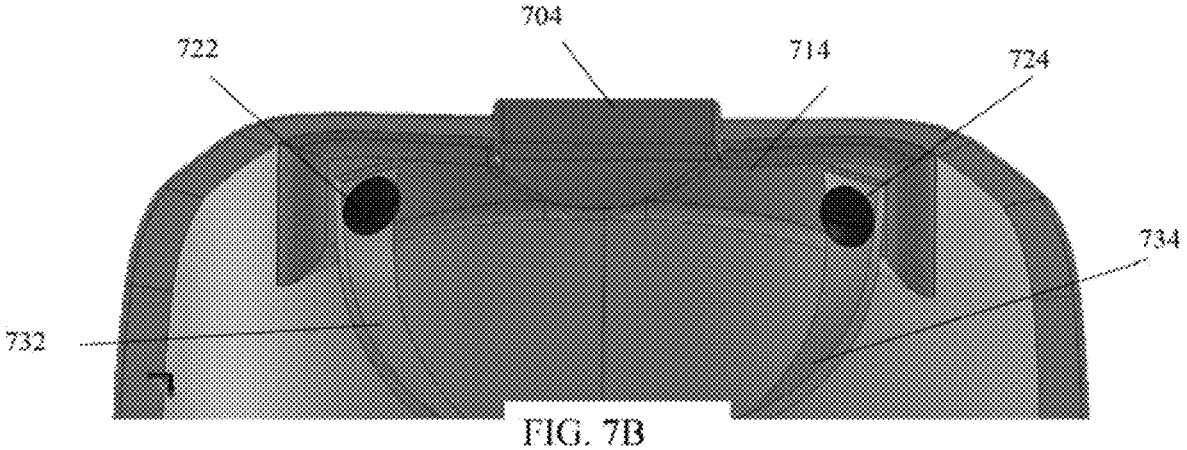
Figure 7C:
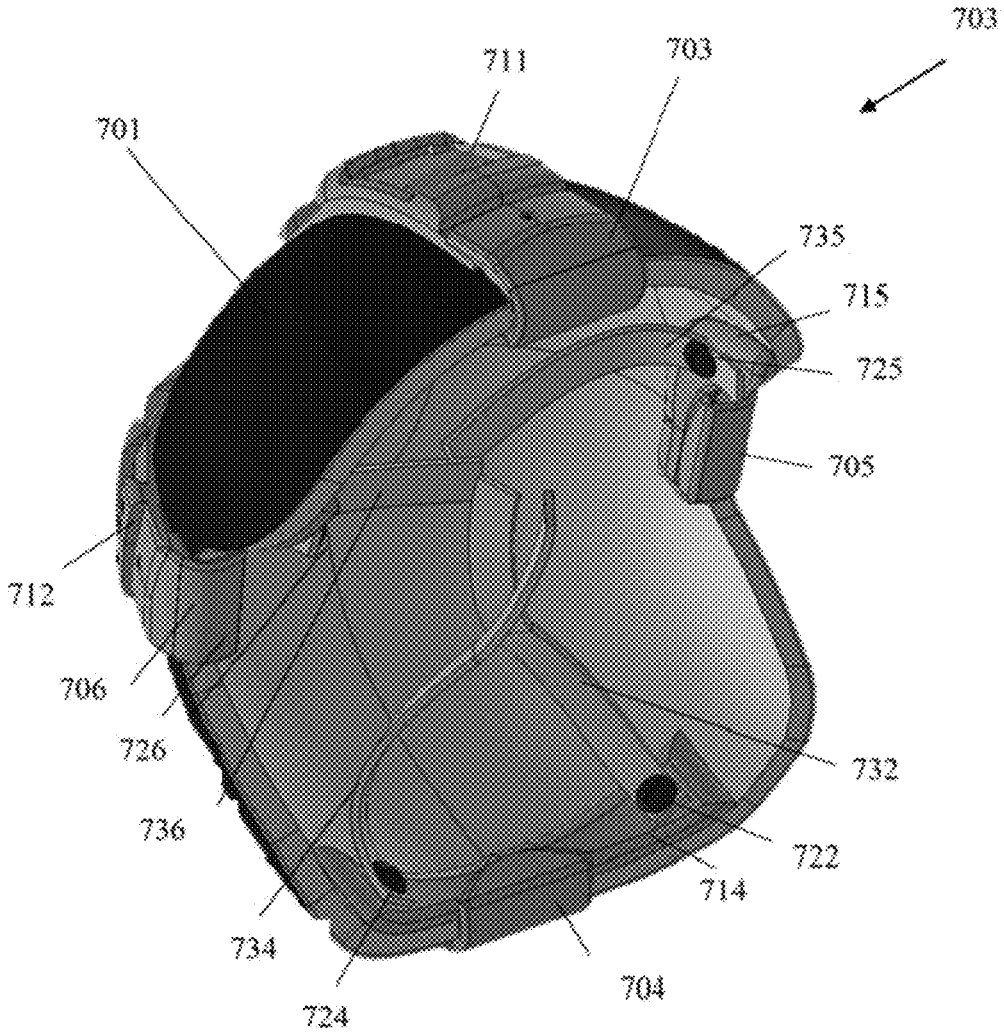
Figure 7D:
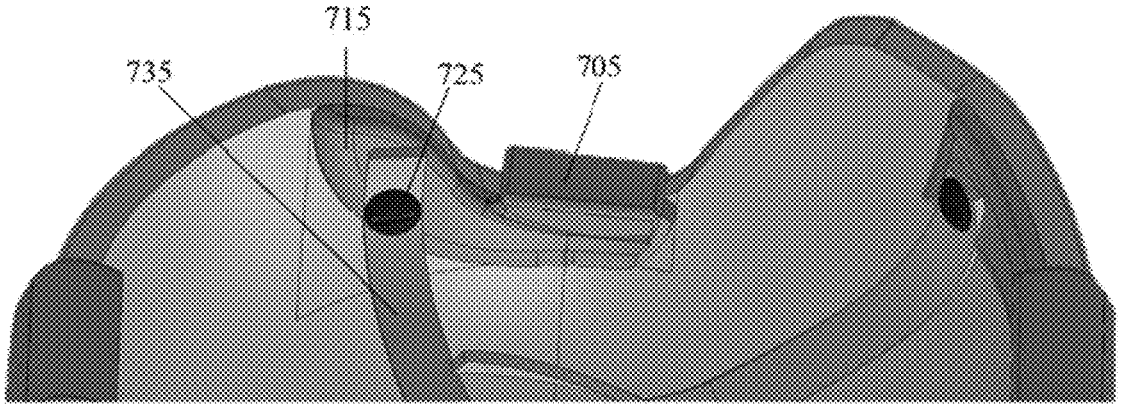
Figure 7E:
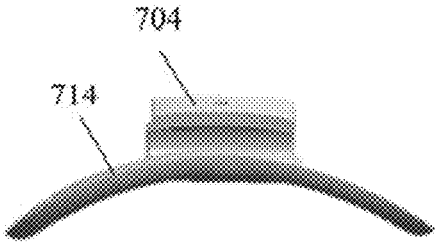
Figure 7F:
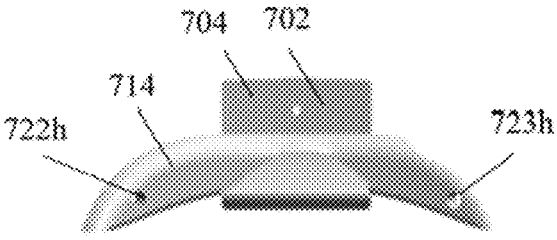
Figure 7G:
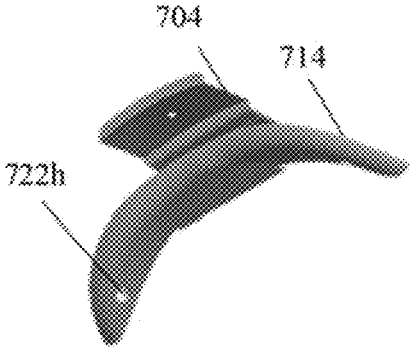
Figure 7H:
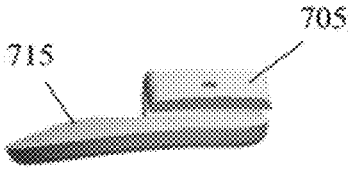
Figure 7I:
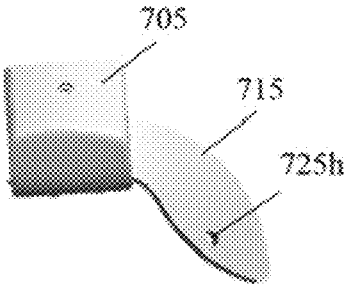
Figure 7J:
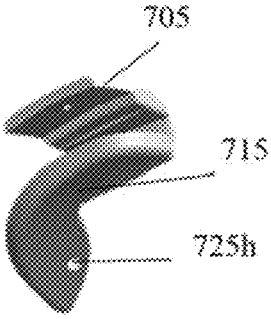
Figure 8A:
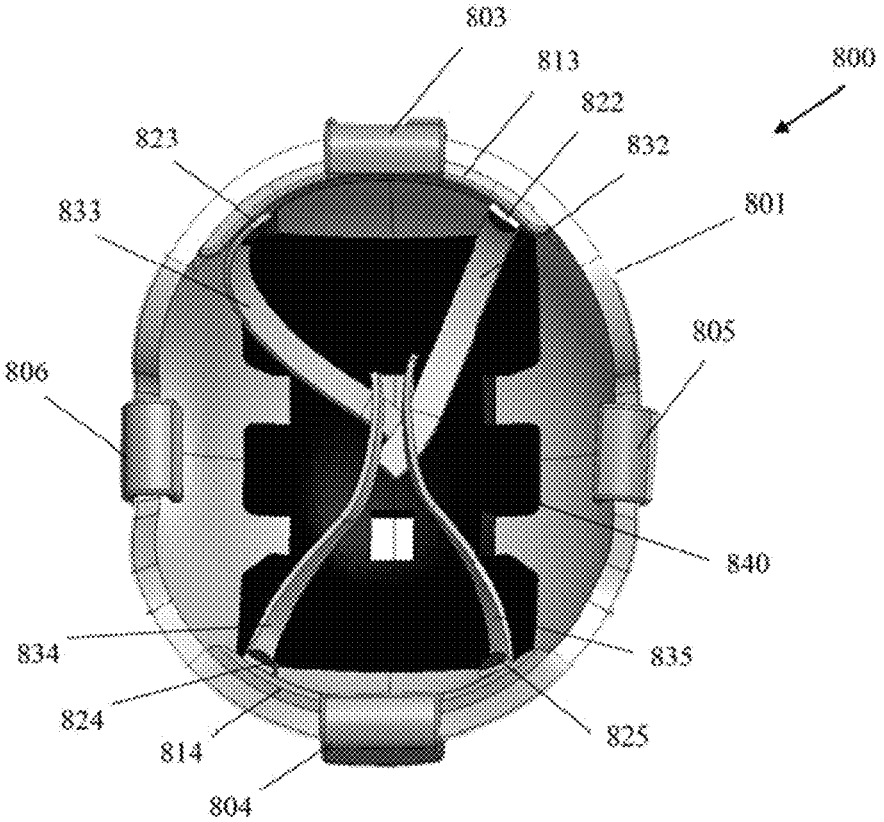
Figure 8B:
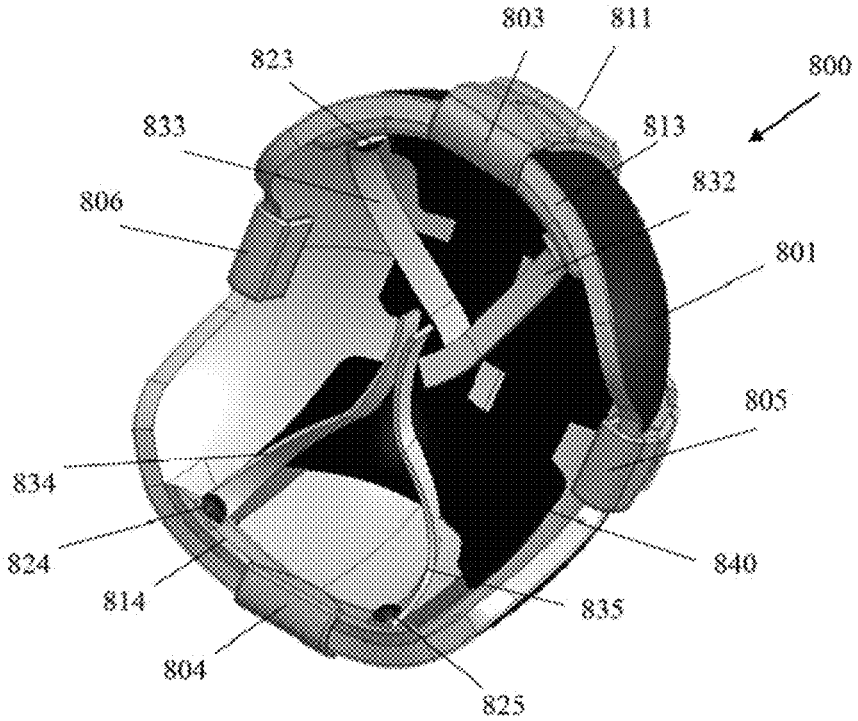
Figure 8C:
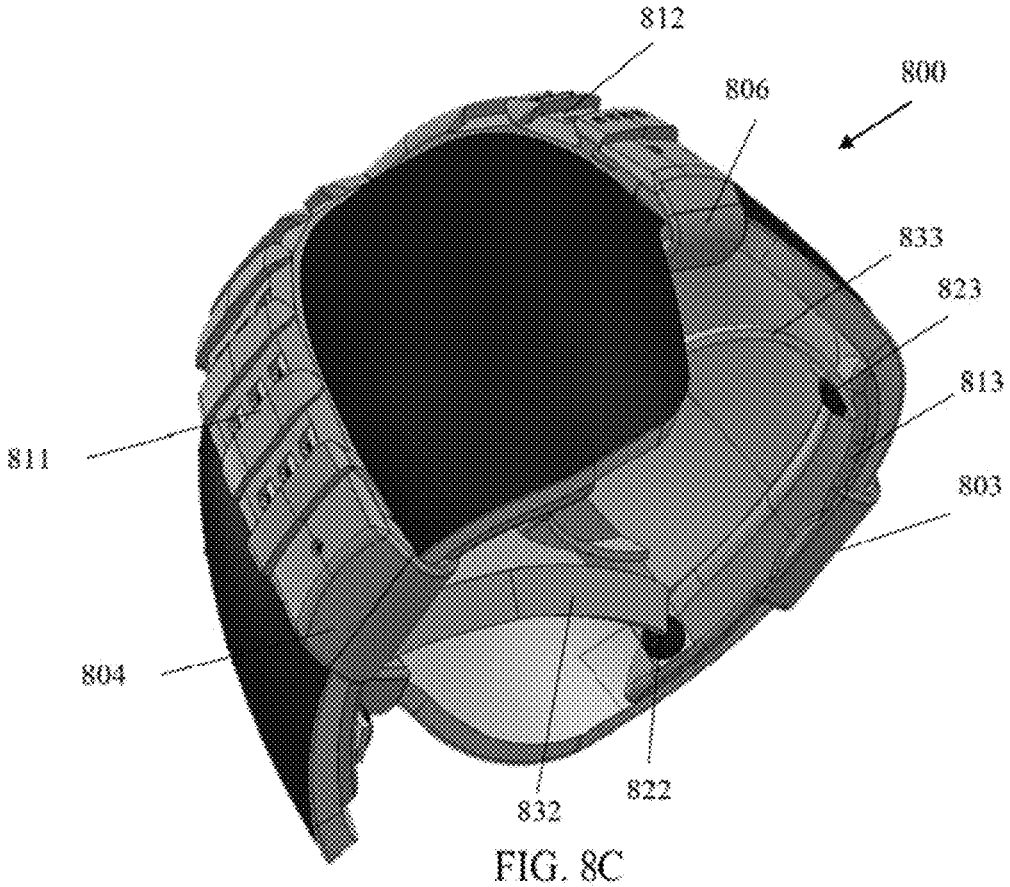
Figure 8D:
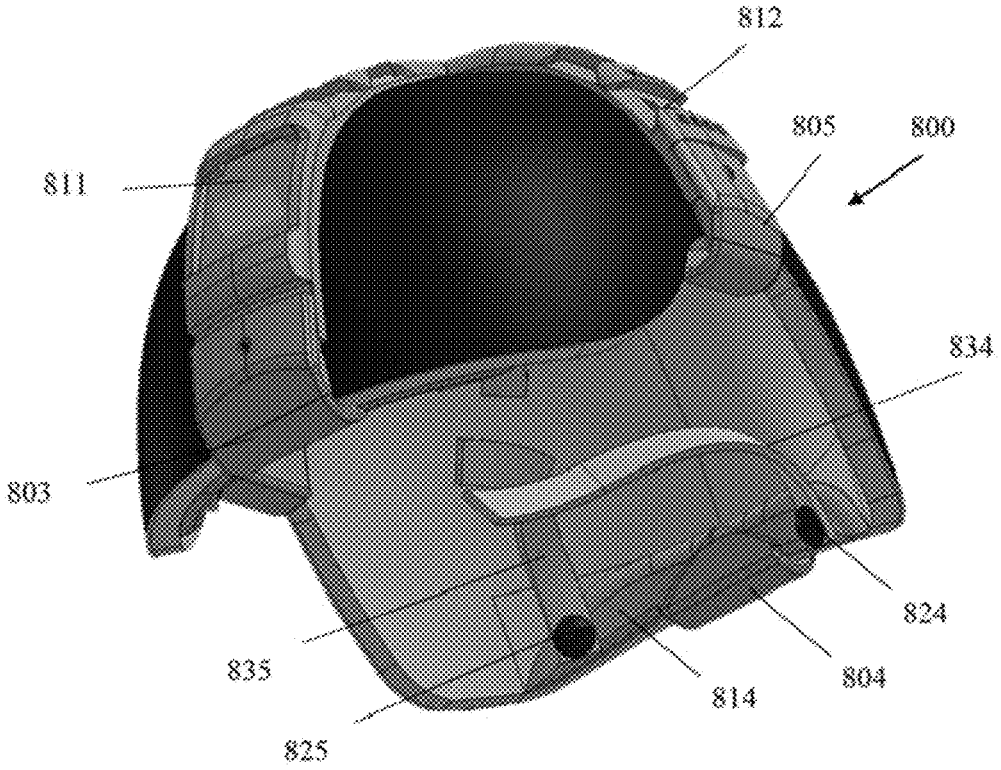
Figure 9A:
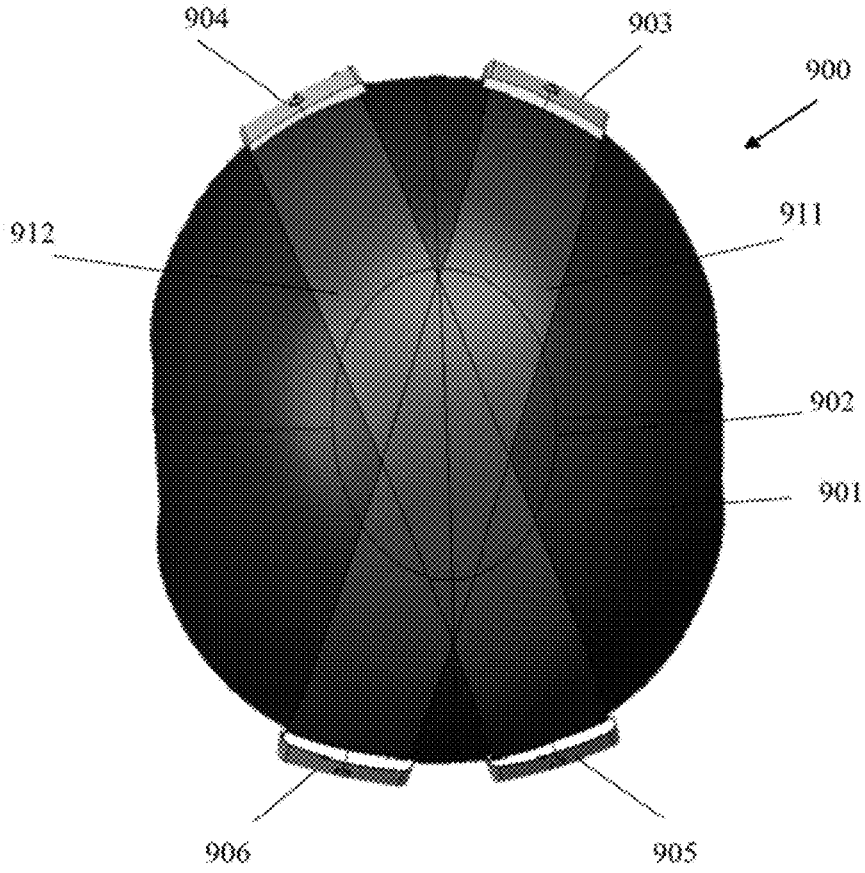
Figure 9B:
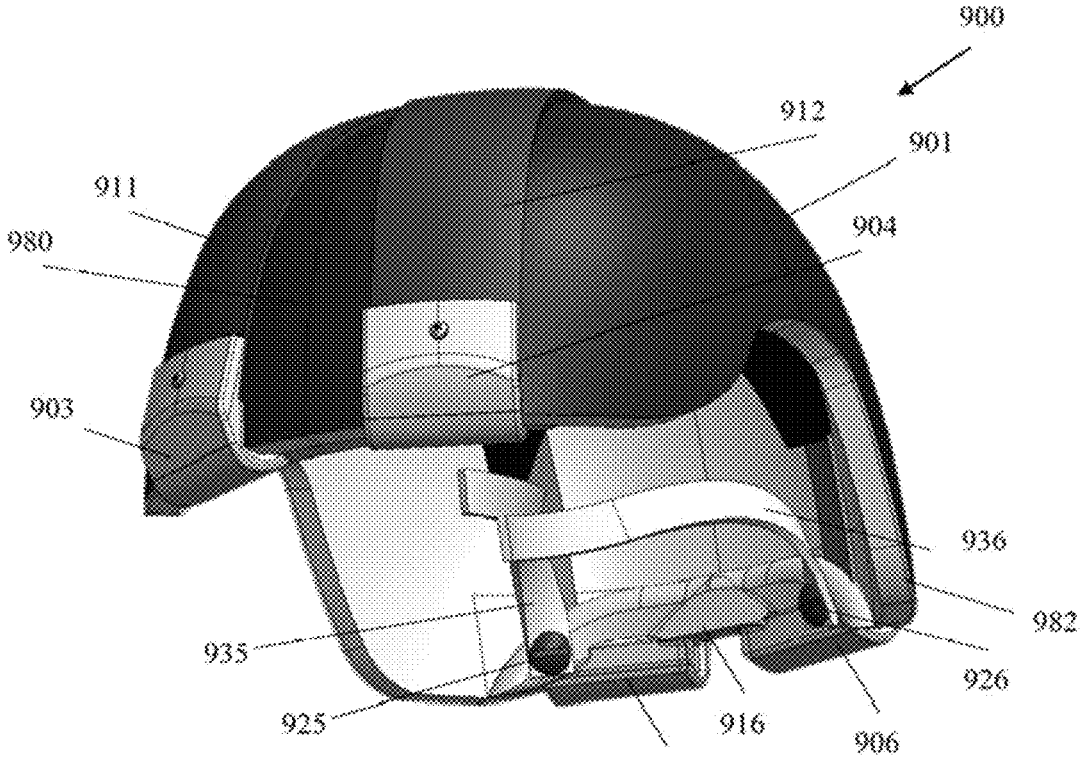
Figure 9C:
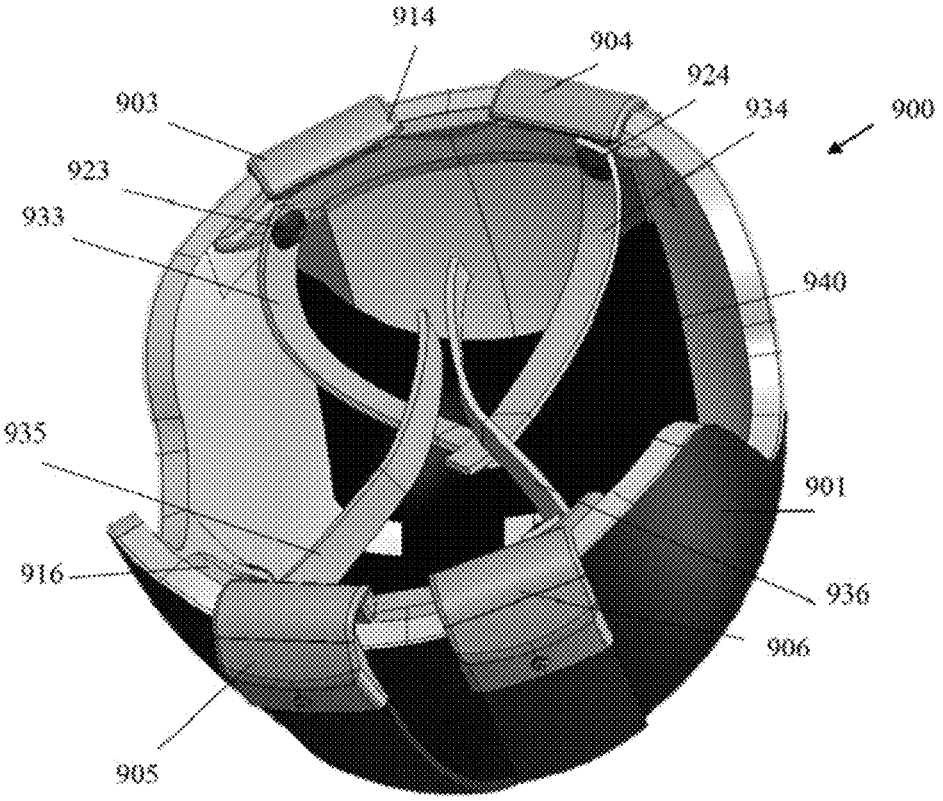
Figure 9D:
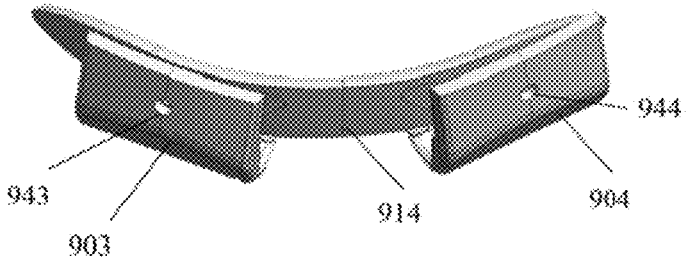
Figure 9E:
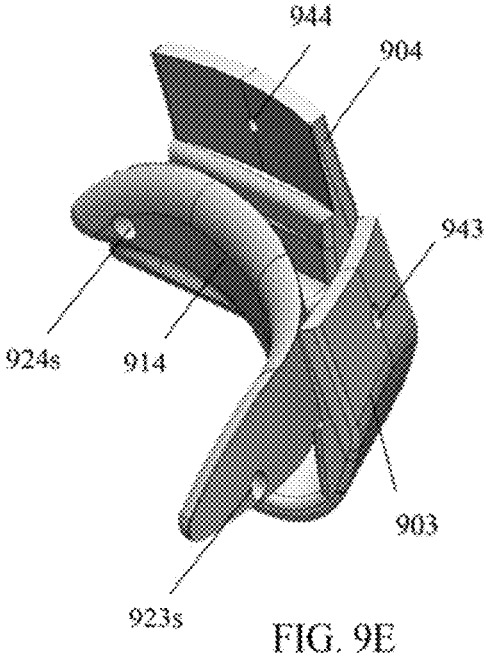
Figures 10G, 10H, 10I:
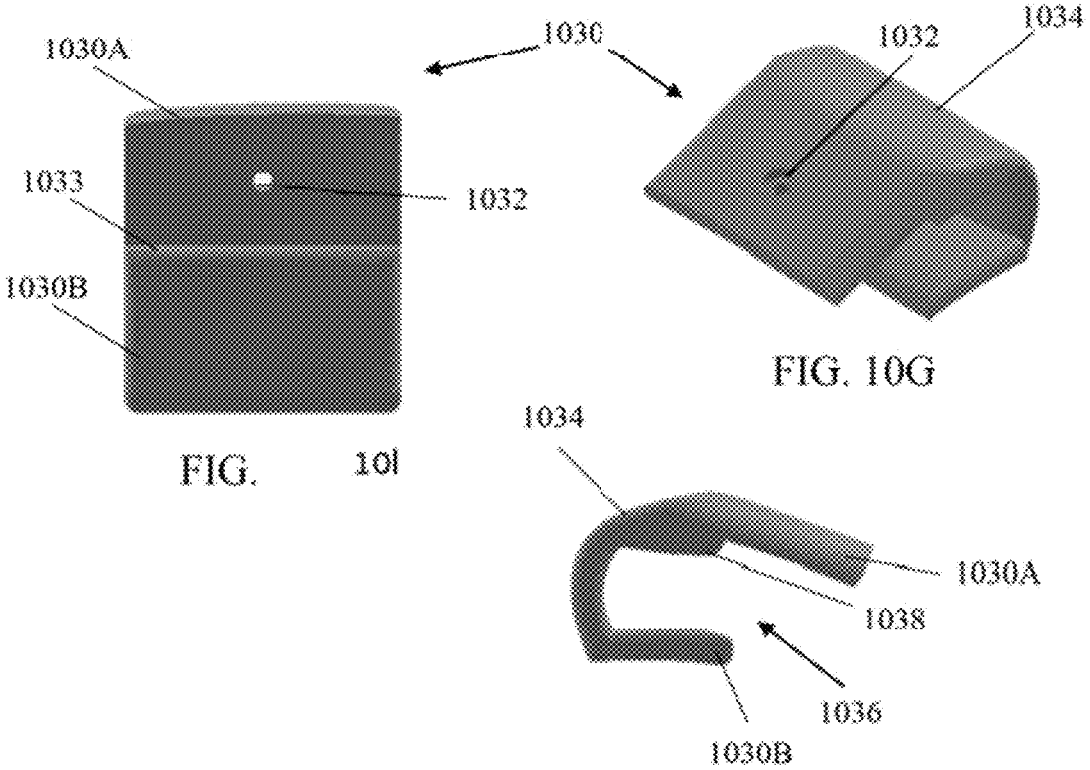
Figure 11:
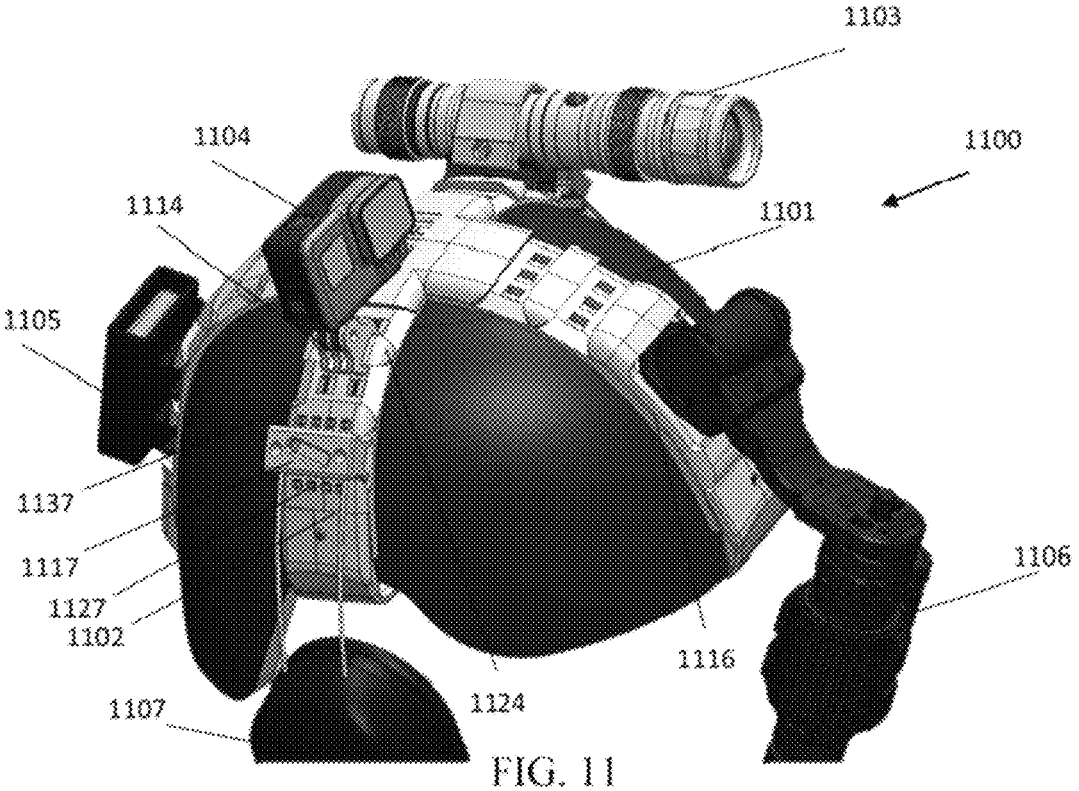
Figure 12:
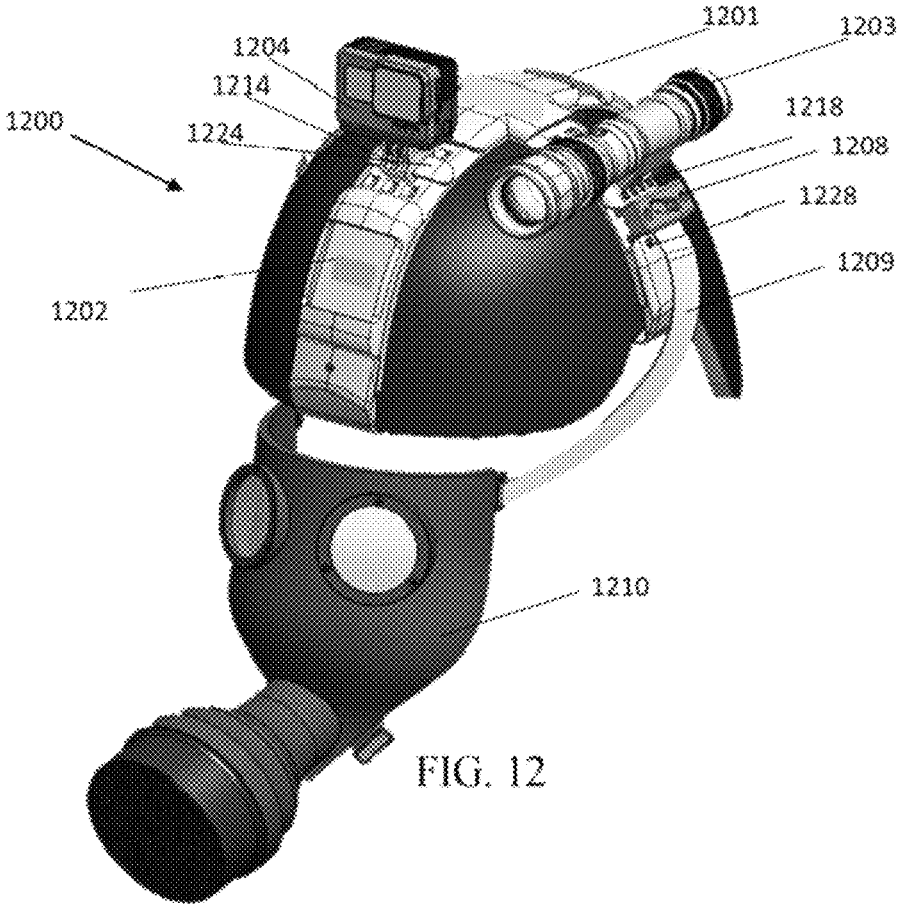
Figure 13:
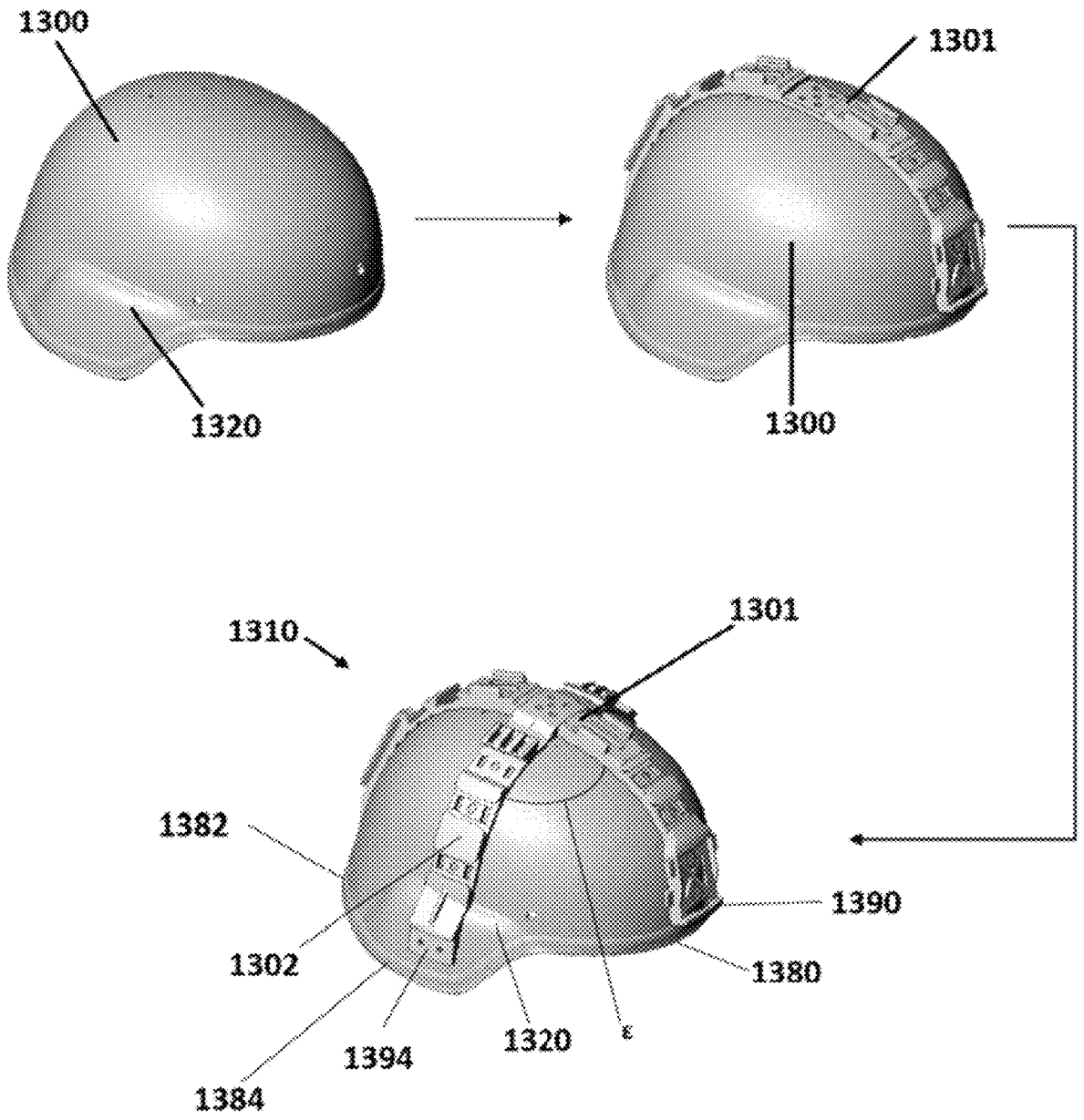
Figures 13A, 13B:
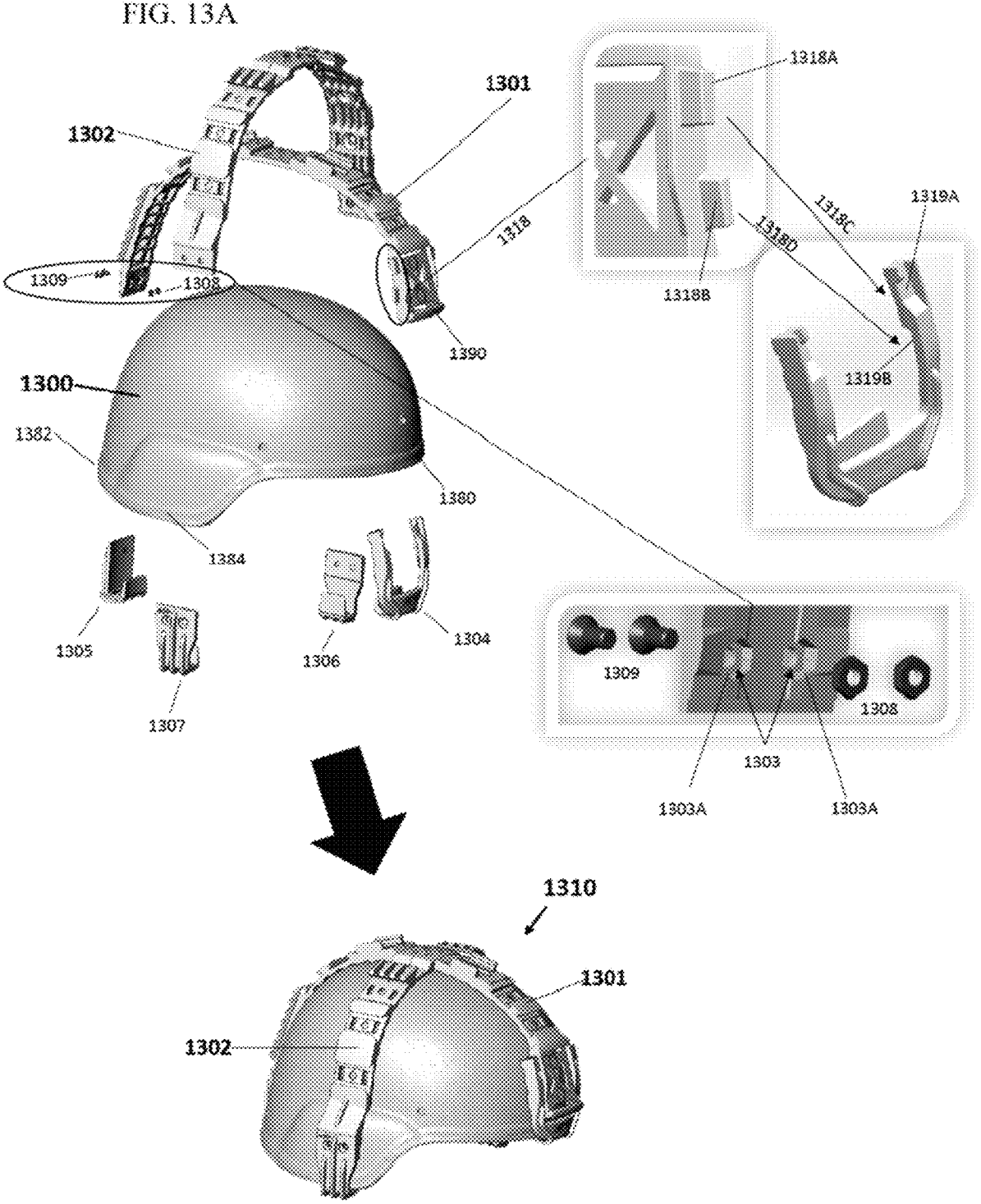
Figure 13C:
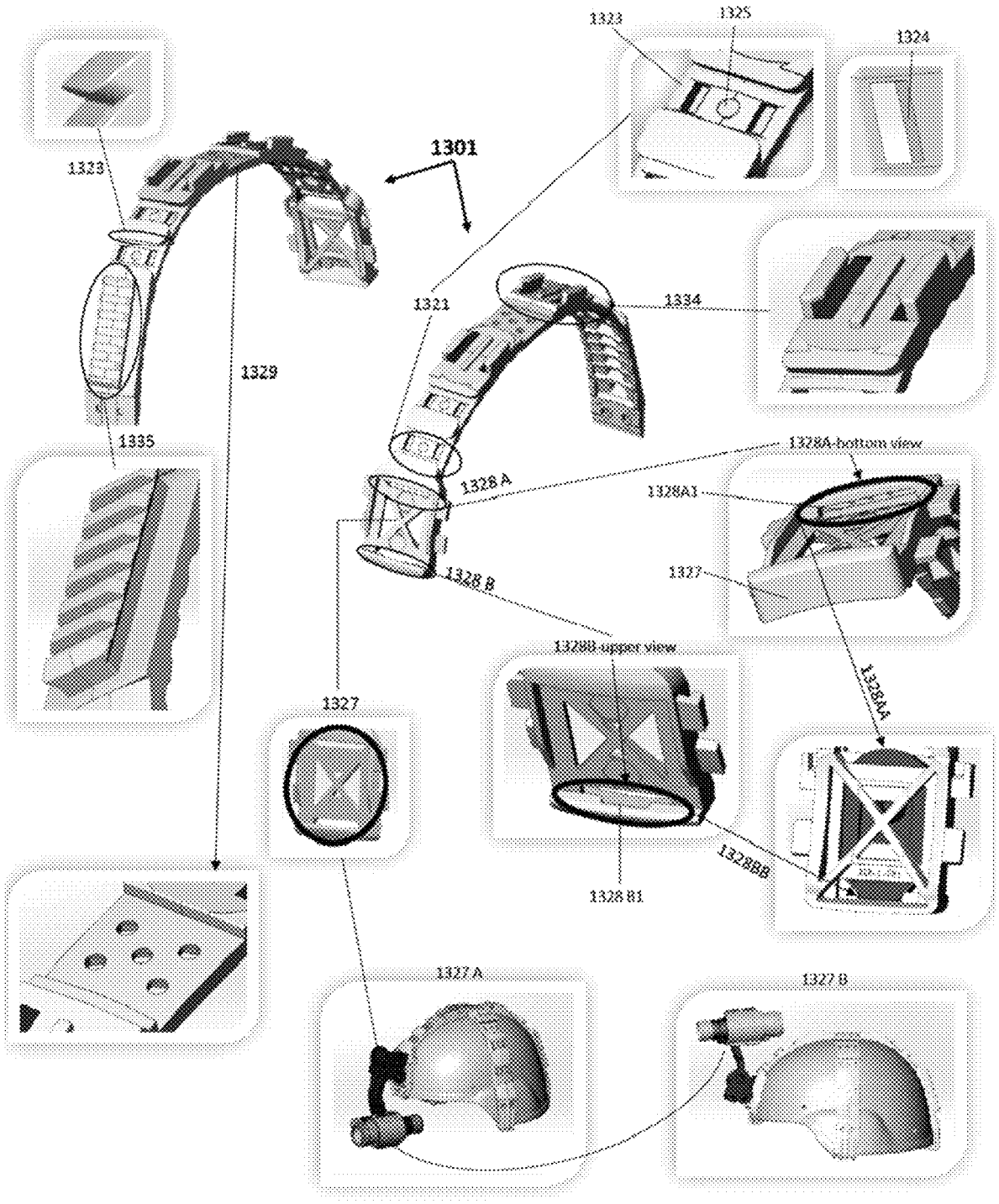
Figure 13D:
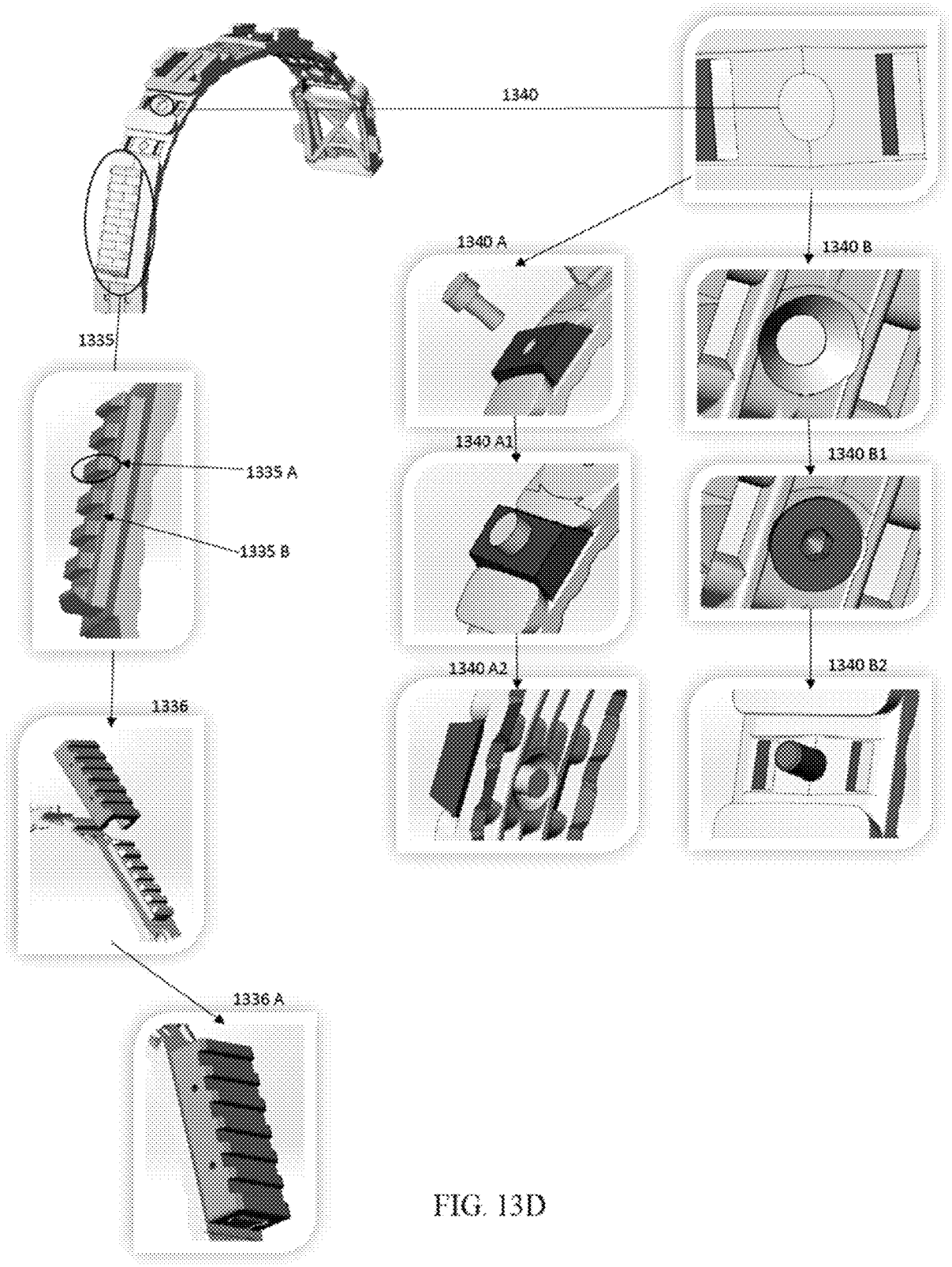
Figure 13E:
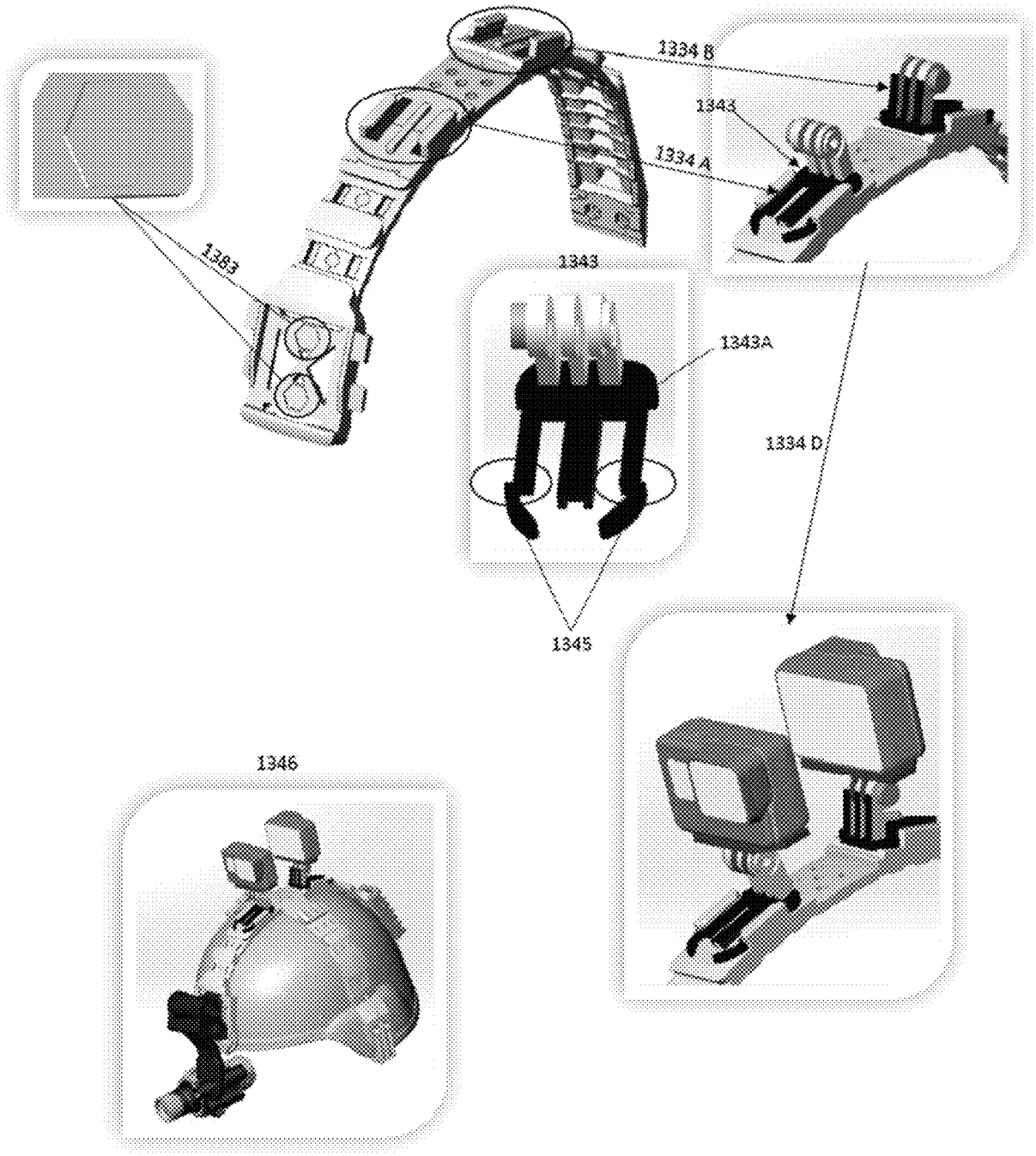
Figure 13F:
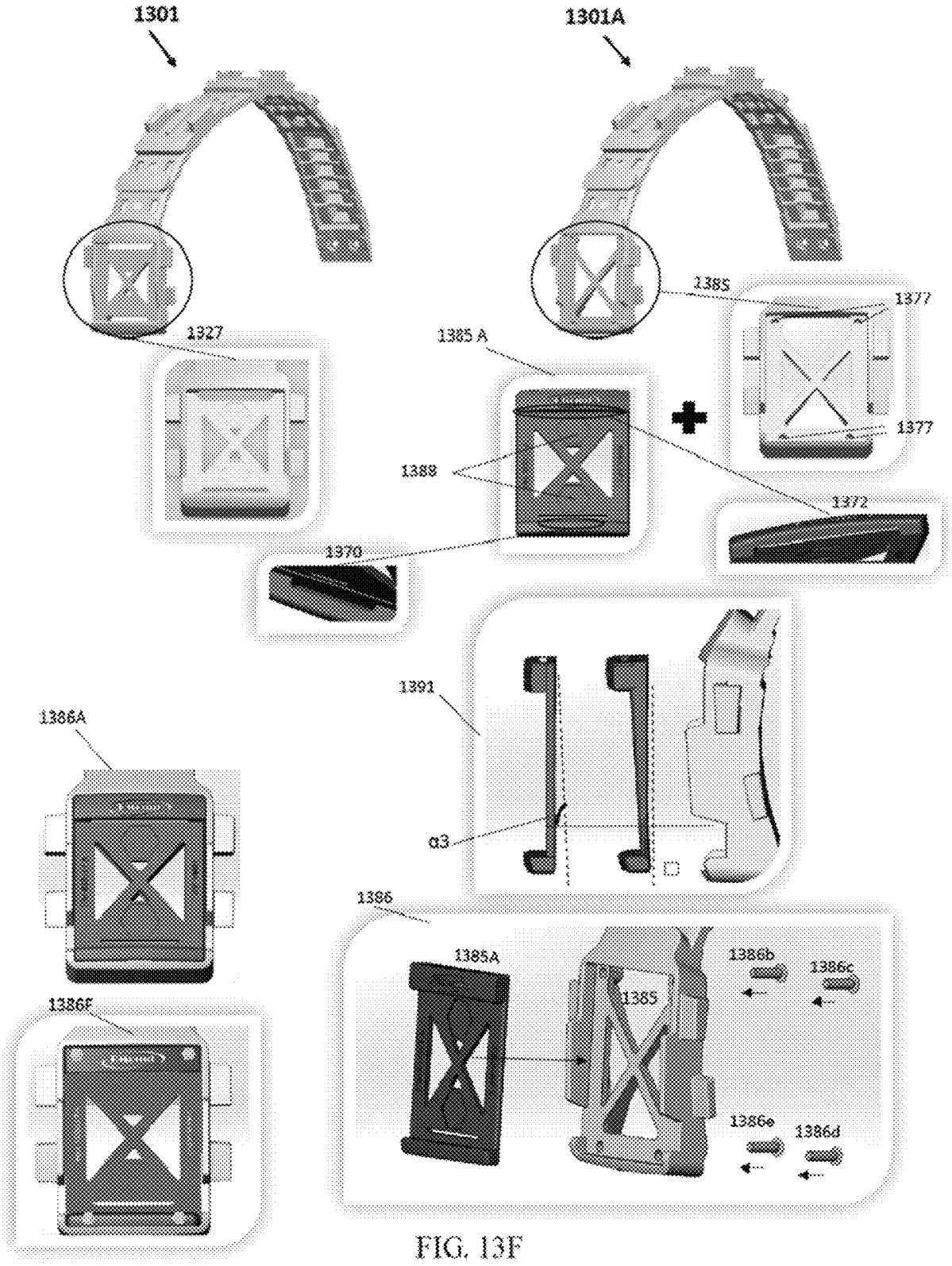
Figure 13G:
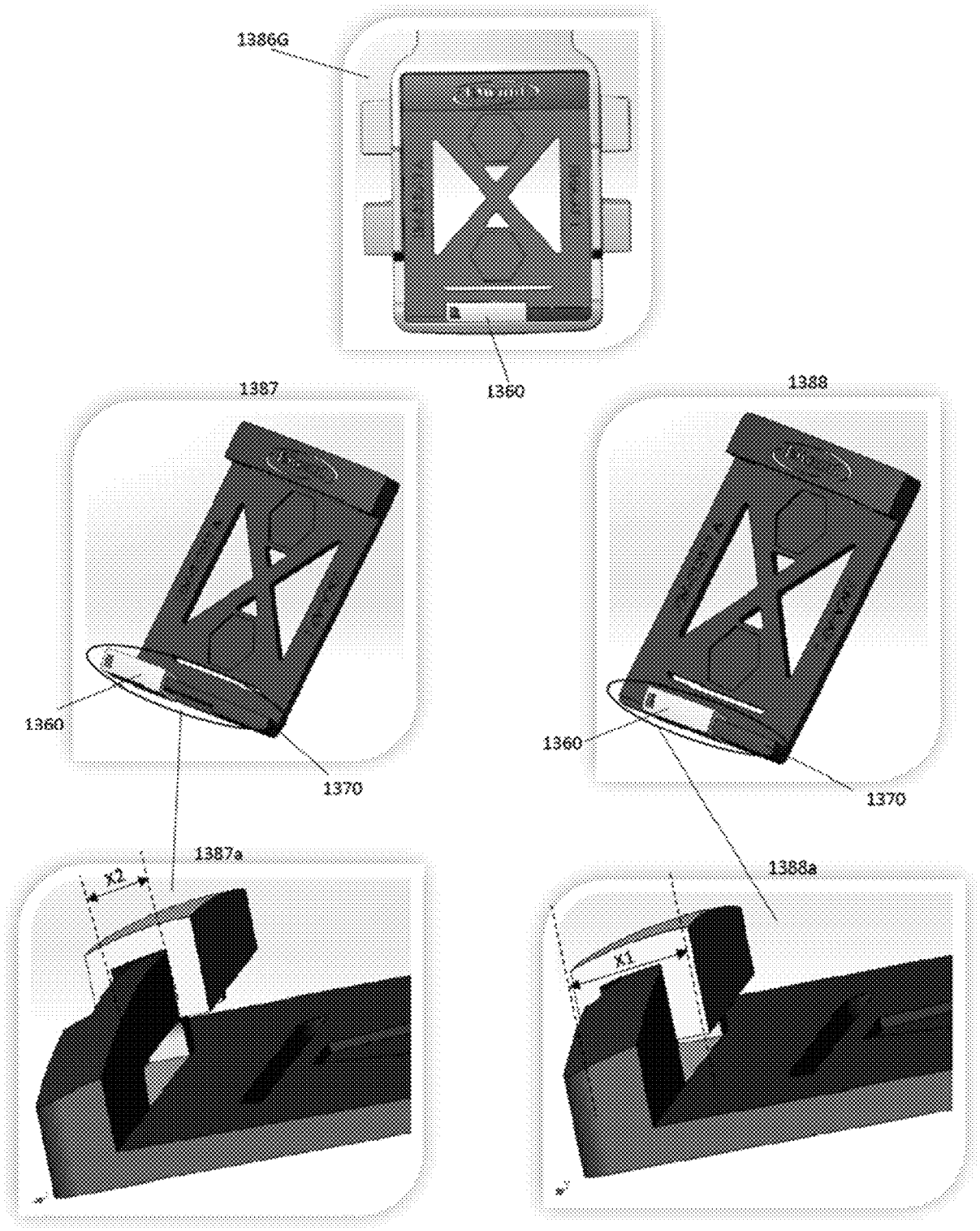

FIG. 1A schematically illustrates an assembly of a helmet, a first mounting unit, and a second mounting unit, in accordance with an embodiment of the present invention;

FIG. 1B schematically illustrates a helmet mounting assembly, in accordance with an embodiment of the present invention;

FIG. 1C schematically illustrates a first mounting unit, in accordance with an embodiment of the invention;

FIG. 1D schematically illustrates a bottom view of the first mounting unit, in accordance with an embodiment of the invention;

FIG. 1E schematically illustrates a side-view of the first mounting unit, in accordance with an embodiment of the invention;

FIG. 1F schematically illustrates a second mounting unit, in accordance with an embodiment of the invention;

FIG. 1G schematically illustrates a second mounting unit, in accordance with another embodiment of the invention;

FIG. 1H schematically illustrates a grip configured to have attached thereon a camera gripper, in accordance with an embodiment of the invention;

FIG. 1I schematically illustrates a bottom view of the second mounting unit of FIG. 1F, in accordance with an embodiment of the invention;

FIG. 1J schematically illustrates a side-view of the second mounting unit of FIG. 1F, in accordance with an embodiment of the invention;

FIG. 2A schematically illustrates an assembly of a helmet and a helmet mounting assembly, in accordance with an embodiment of the present invention;

FIG. 2B schematically illustrates a helmet mounting assembly, in accordance with an embodiment of the present invention;

FIG. 2C schematically illustrates a mounting unit comprising a first mounting section and a second mounting section, in accordance with an embodiment of the present invention;

FIG. 2D schematically illustrates a bottom view of the mounting unit, in accordance with an embodiment of the present invention;

FIG. 3 schematically illustrates a helmet mounting assembly, in accordance with an embodiment of the present invention;

FIG. 4 schematically illustrates an assembly of a helmet mounting unit and a helmet, in accordance with another embodiment of the present invention;

FIGS. 5A-5B schematically illustrate a front-side view and a back-side view, respectively, of helmet mounting units attached onto a helmet via fastening means that penetrate through the helmet, in accordance with embodiments of the present invention;

FIGS. 6A-6B schematically illustrate back-side-views of helmet mounting units with different types of rails, in accordance with embodiments of the present invention;

FIGS. 7A-7D schematically illustrate a helmet mounting assembly comprising straps attached to fastenable connectors of the assembly, in accordance with an embodiment of the present invention;

FIGS. 7E-7G, schematically illustrate an upper-view, front-view and side-view, respectively, of a fastenable connector configured to attach a first mounting unit to a helmet and configured to comprise chin straps and/or liner, in accordance with an embodiment of the present invention;

FIGS. 7H-7J, schematically illustrate an upper-view, front-view and side-view, respectively, of a fastenable connector configured to attach a second mounting unit to a helmet and configured to comprise chin straps and/or liner, in accordance with an embodiment of the present invention;

FIGS. 8A-8D schematically illustrate a helmet mounting assembly comprising straps attached to fastenable connectors of the assembly, in accordance with another embodiment of the present invention;

FIGS. 9A-9C schematically illustrate a top-view, front-side-view and bottom-side-view, respectively, of a helmet assembly comprising chin straps and/or liner attached to fastenable connectors of the assembly, in accordance with an embodiment of the present invention;

FIGS. 9D-9E schematically illustrate a front-view and side-view, respectively, of a fastenable connector configured to attach chin and/or liner straps to a helmet, in accordance with an embodiment of the present invention;

FIGS. 10A-10C schematically illustrate upper-side view, side view, and back view, respectively, of a fastenable connector configured to attach a mounting unit (or section) to a helmet, in accordance with an embodiment of the present invention;

FIGS. 10D-10F schematically illustrate upper-side view, side view, and back view, respectively, of a fastenable connector configured to attach a mounting unit (or section) to a helmet, in accordance with another embodiment of the present invention;

FIGS. 10G-10I schematically illustrate upper-side view, side view, and back view, respectively, of a fastenable connector configured to attach a mounting unit (or section) to a helmet, in accordance with yet another embodiment of the present invention;

FIG. 11 schematically illustrates a helmet comprising a helmet mounting assembly having attached thereon exemplary helmet accessories, in accordance with one embodiment of the present invention;

FIG. 12 schematically illustrates a helmet comprising a helmet mounting assembly having attached thereon exemplary helmet accessories, in accordance with another embodiment of the present invention;

FIG. 13 schematically illustrates an assembly of a helmet, a first mounting unit, and a second mounting unit, in accordance with an embodiment of the present invention;

FIG. 13A schematically illustrates a helmet, a first mounting unit, a second mounting unit and fastenable connectors, e.g., clips, in pre-assembled or exploaded state, in accordance with an embodiment of the present invention;

FIG. 13B schematically illustrates an assembly of a helmet, a first mounting unit, a second mounting unit, and fastenable connectors, in accordance with an embodiment of the present invention;

FIG. 13C schematically illustrates a first mounting unit, in accordance with an embodiment of the invention;

FIG. 13D schematically illustrates a back-side view of the first mounting unit of FIG. 13C, in accordance with an embodiment of the invention;

FIG. 13E schematically illustrates a front-side view of the first mounting unit of FIG. 13C, in accordance with an embodiment of the invention;

FIG. 13F schematically illustrates variants of an external plate before and after assembly onto the first mounting unit, in accordance with embodiments of the invention;

FIG. 13G schematically illustrates a safe release of an external plate, in accordance with embodiments of the invention.

Figure 13J:
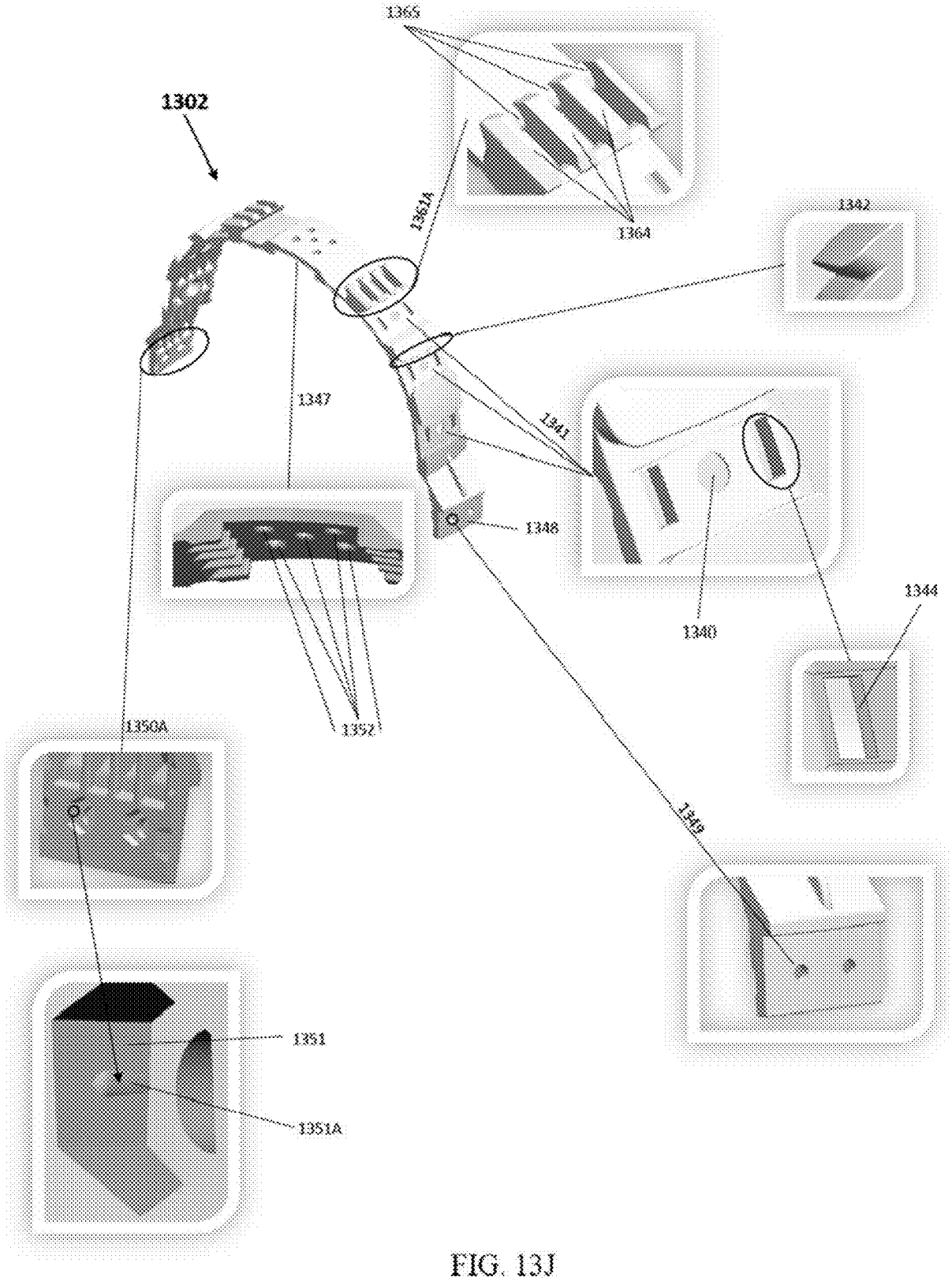
Figure 13M:
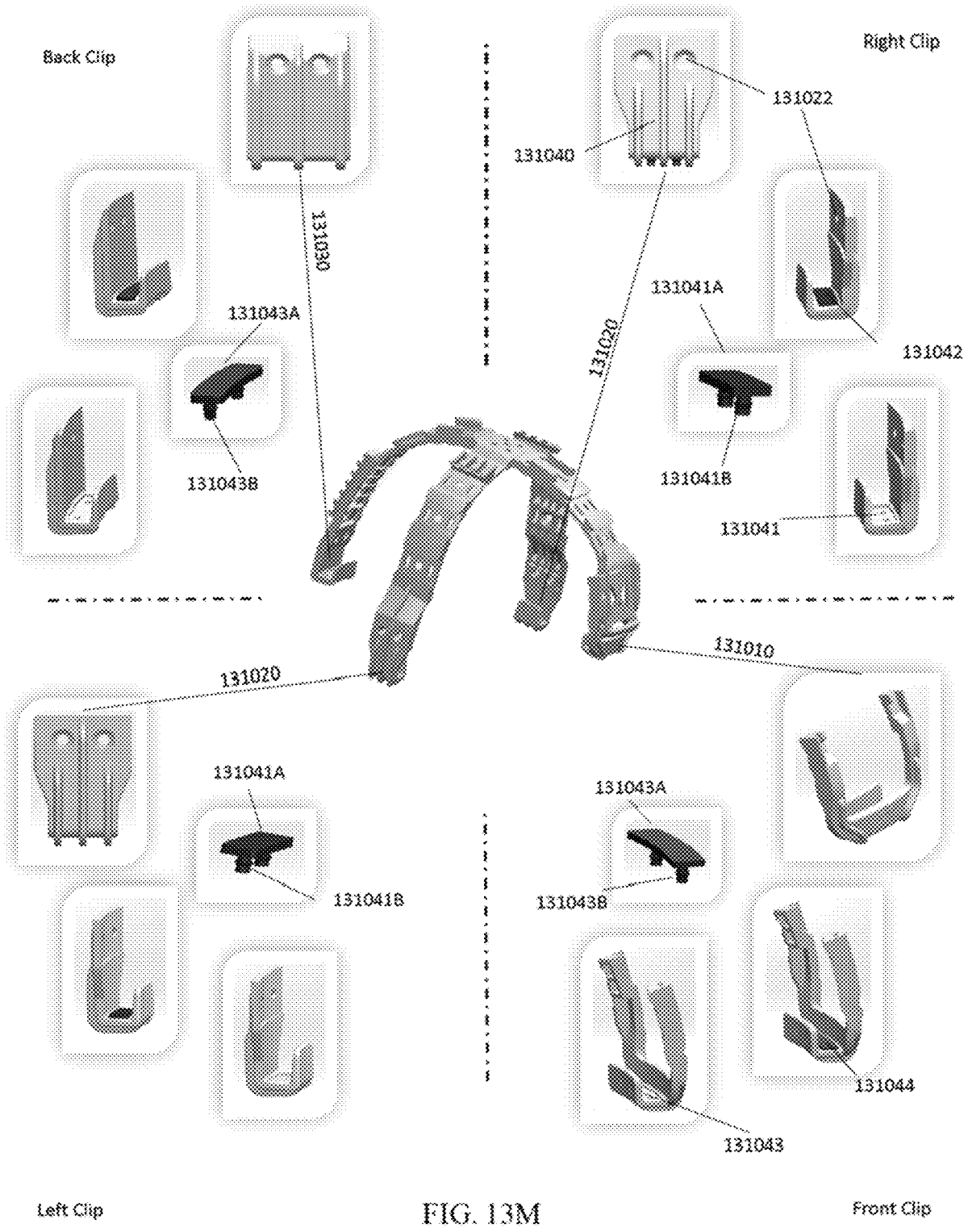
Figure 14:
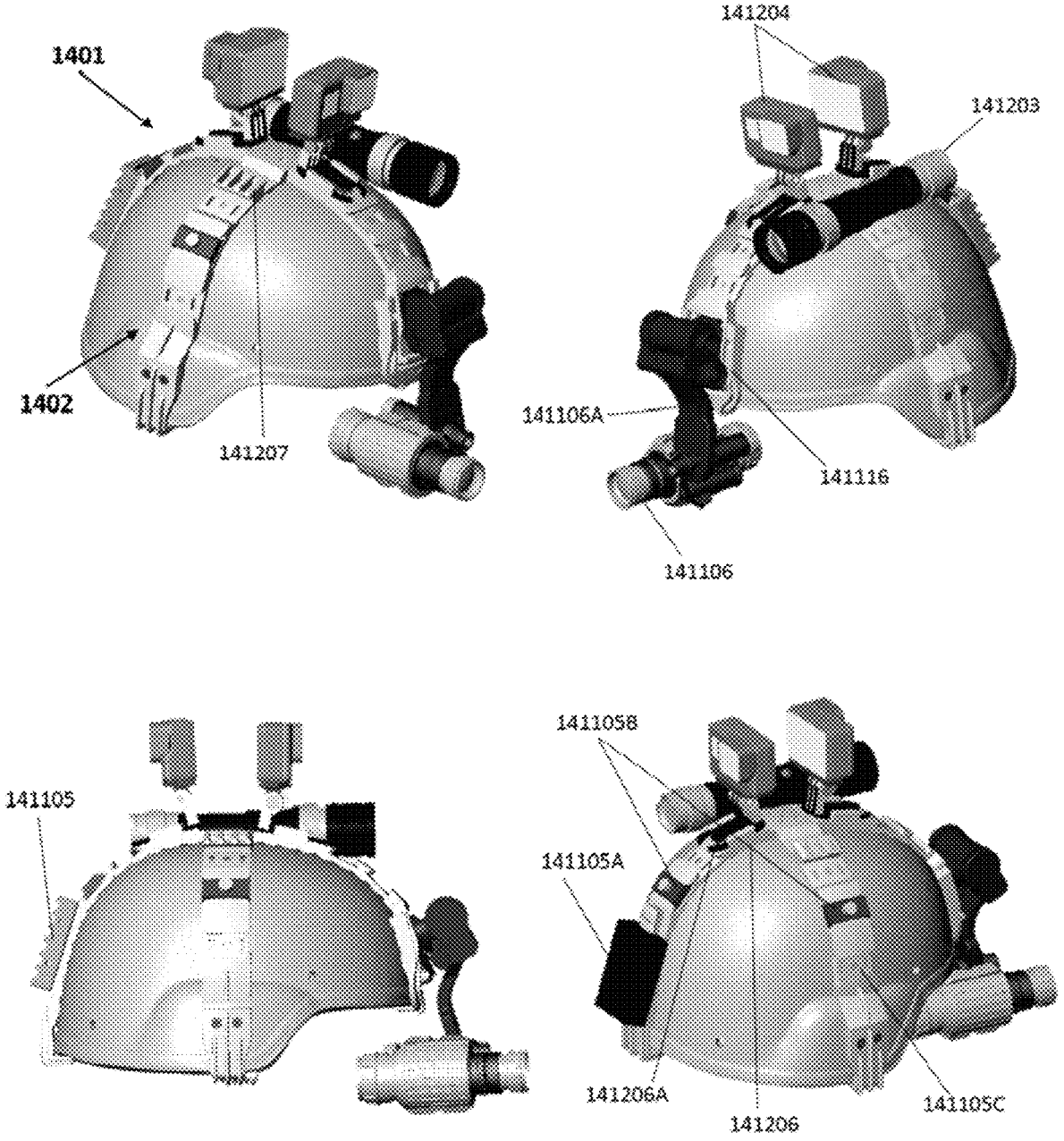
Figure 15A:
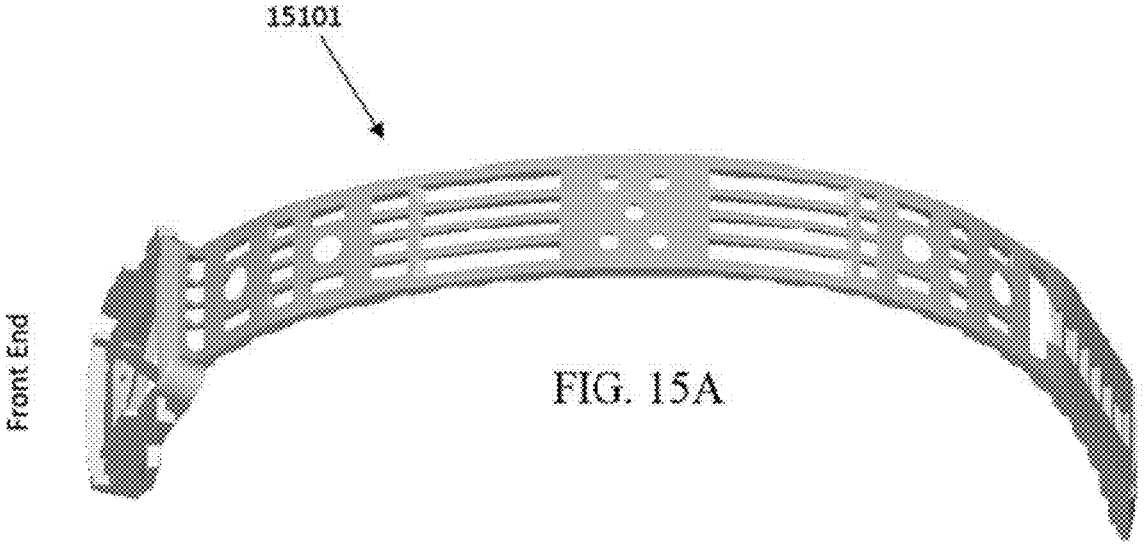
Figure 15B:
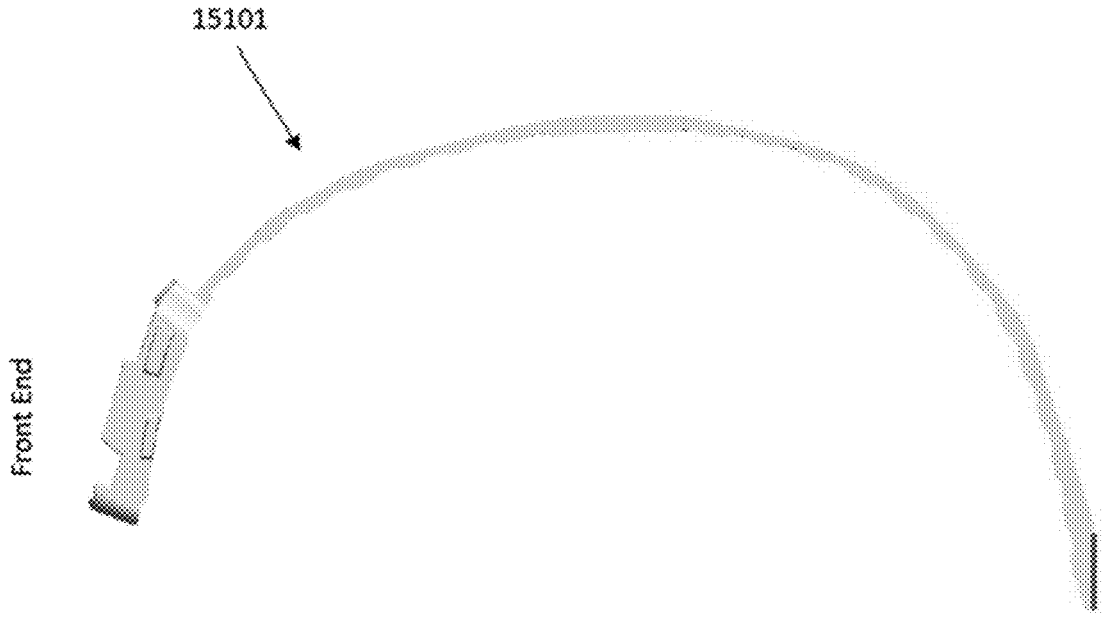
Figure 16A:
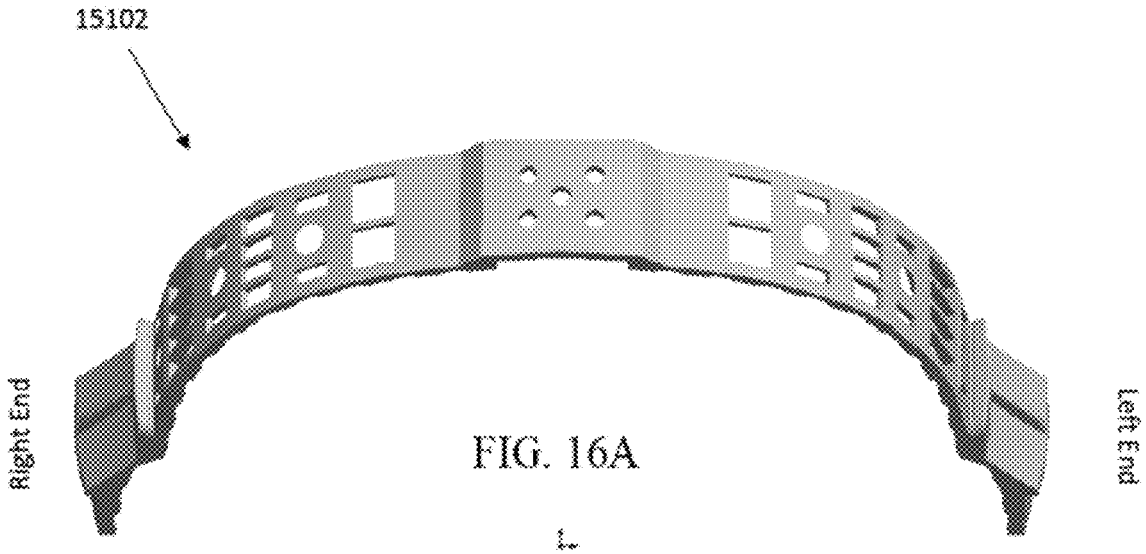
Figure 16B:
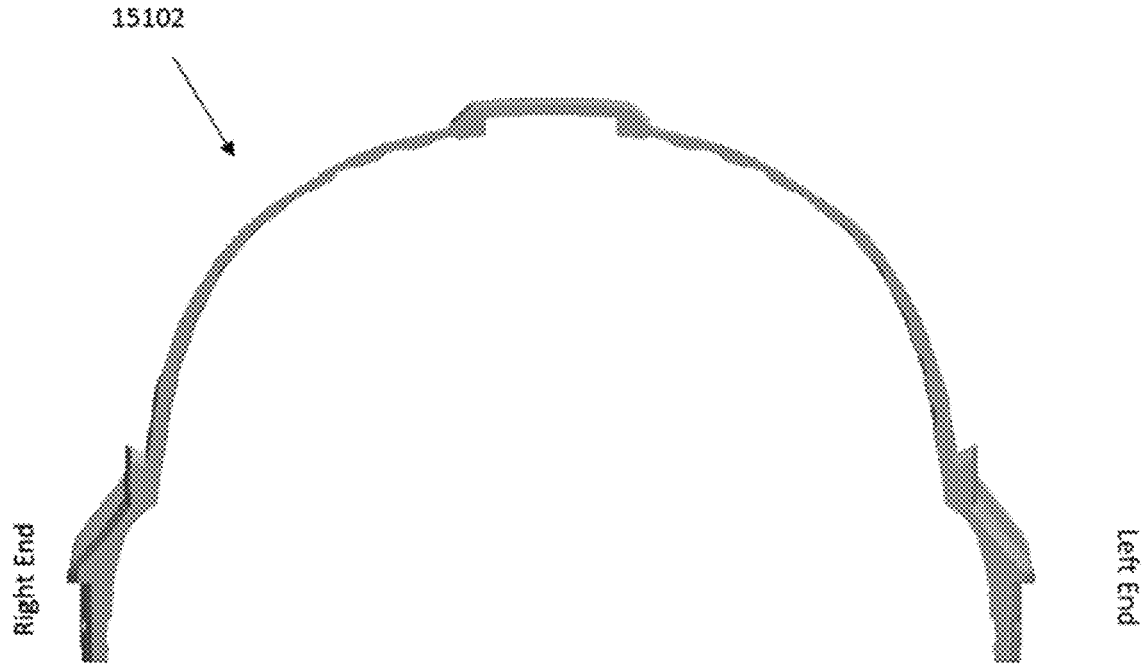
Figure 17A:
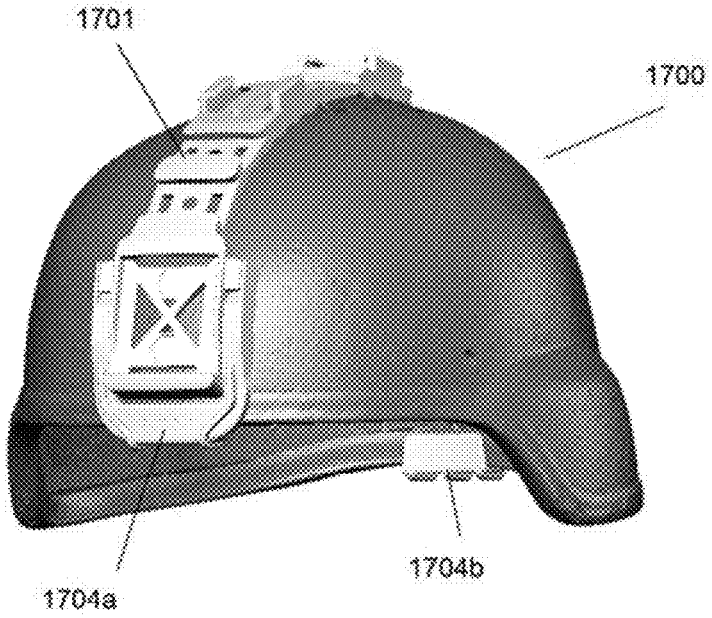
Figure 17A:
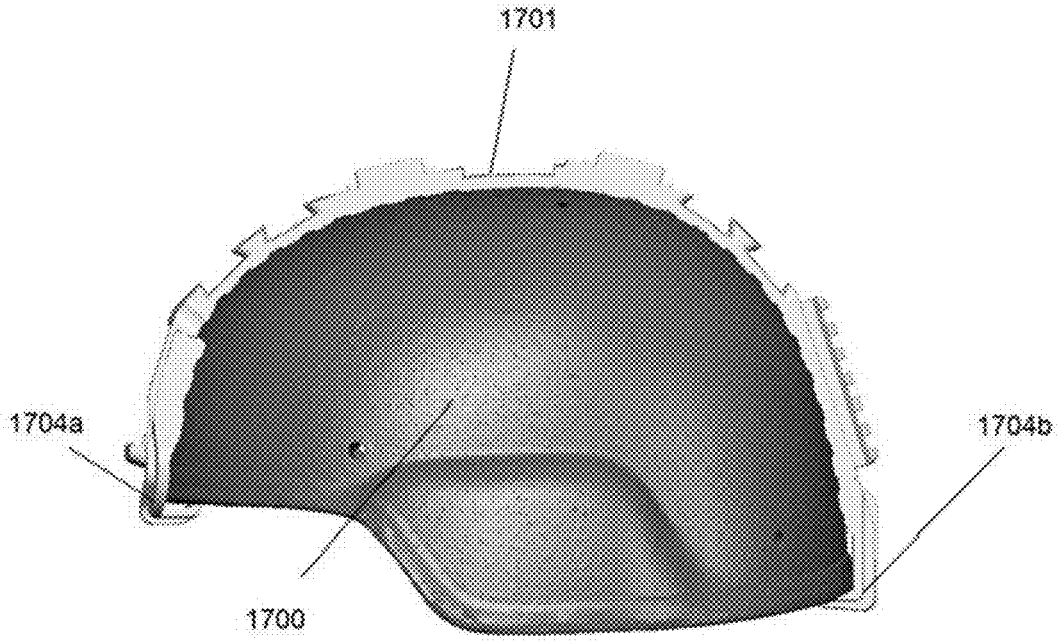
Figure 17B:
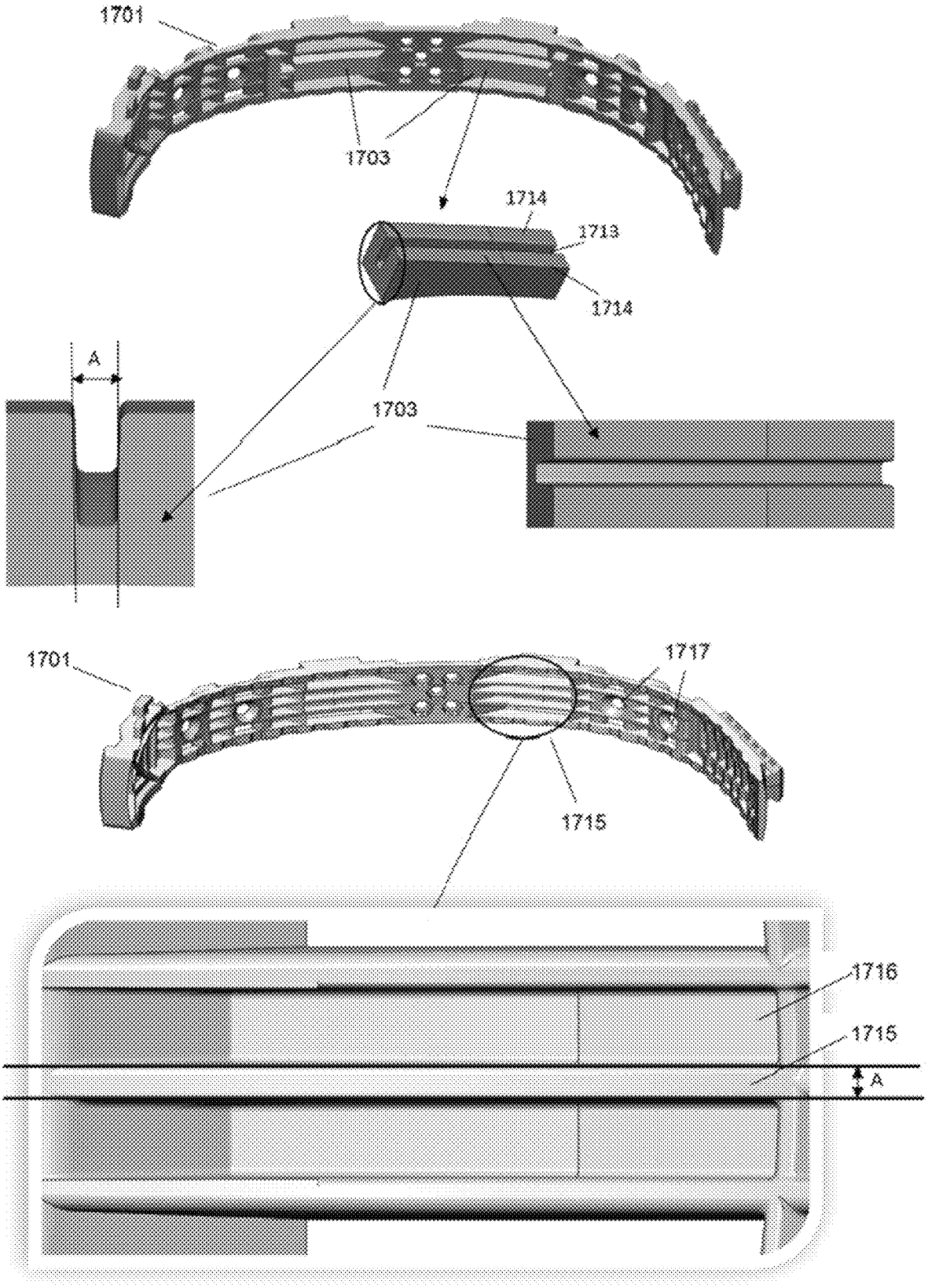
Figure 17C:
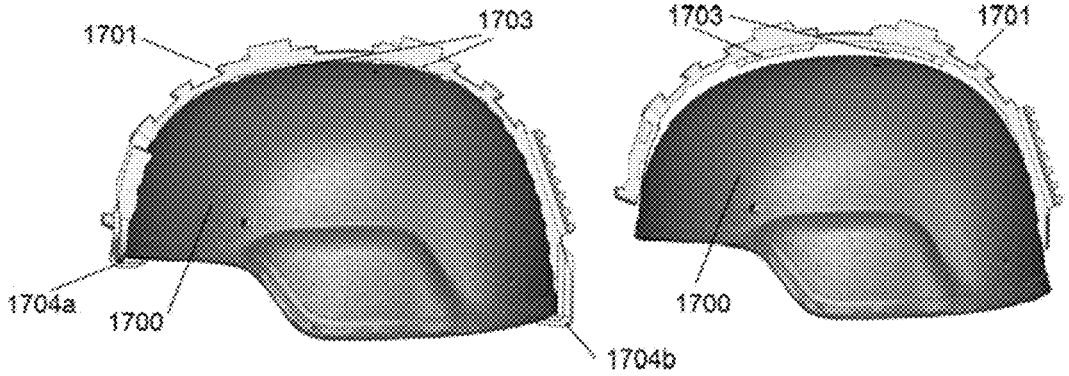
Figure 17D:
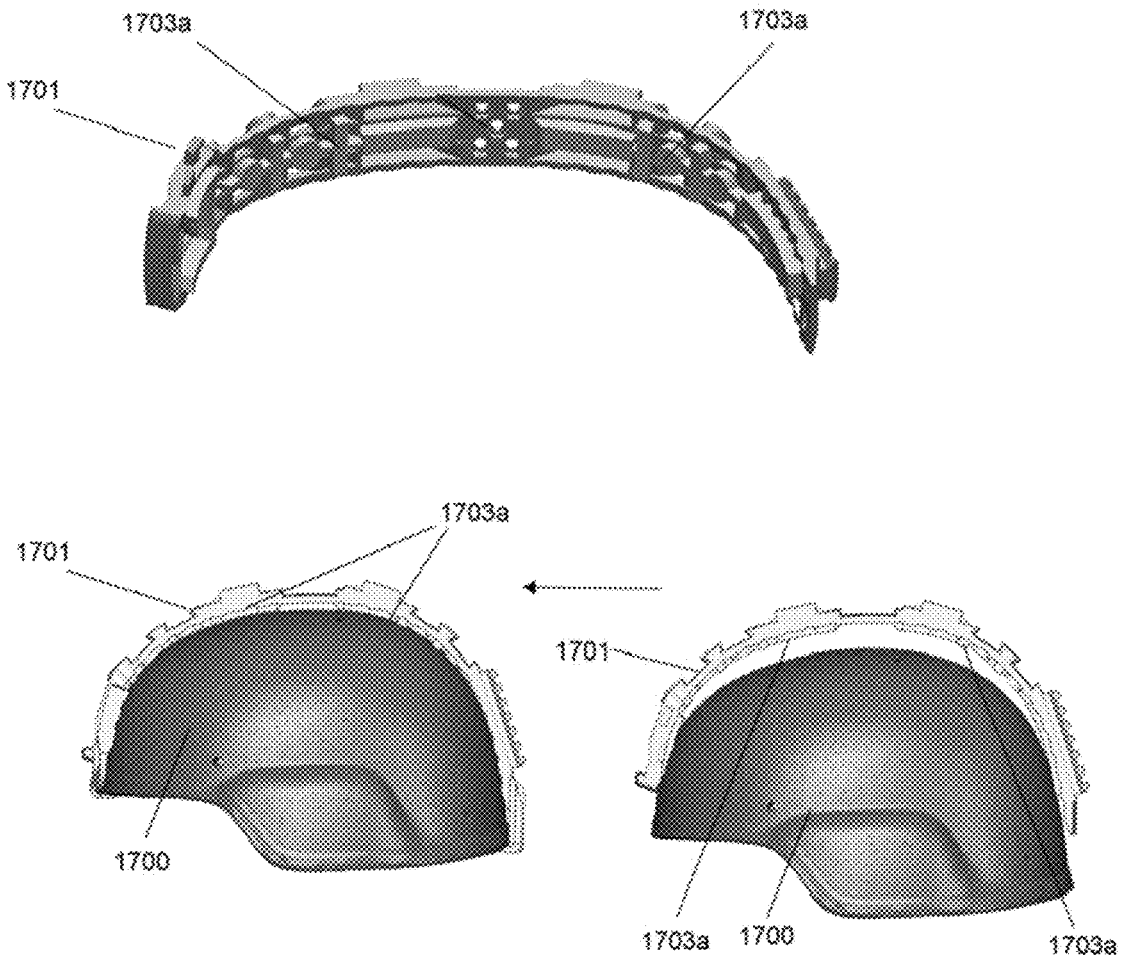
Figure 17E:
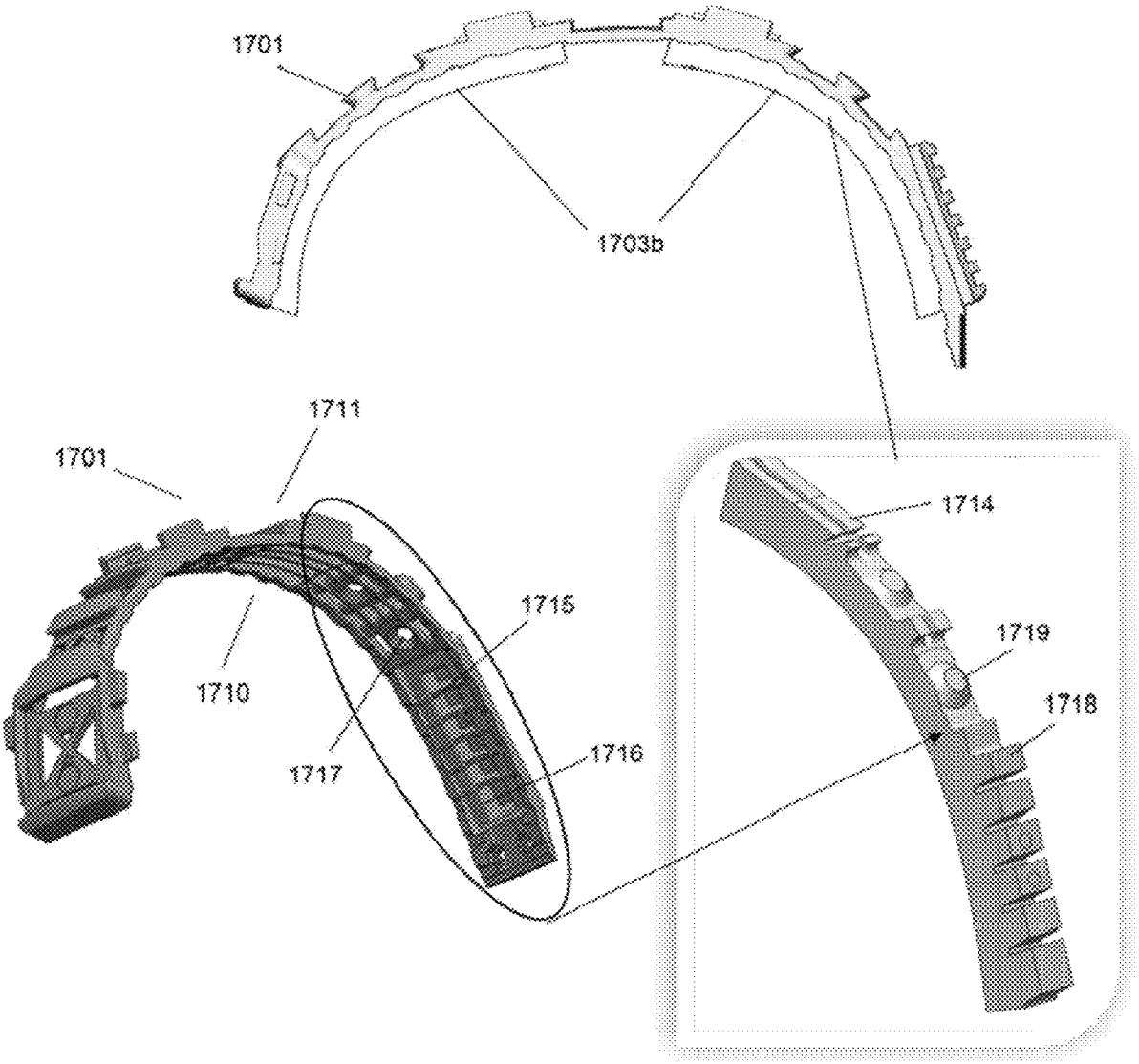
Figure 17F:
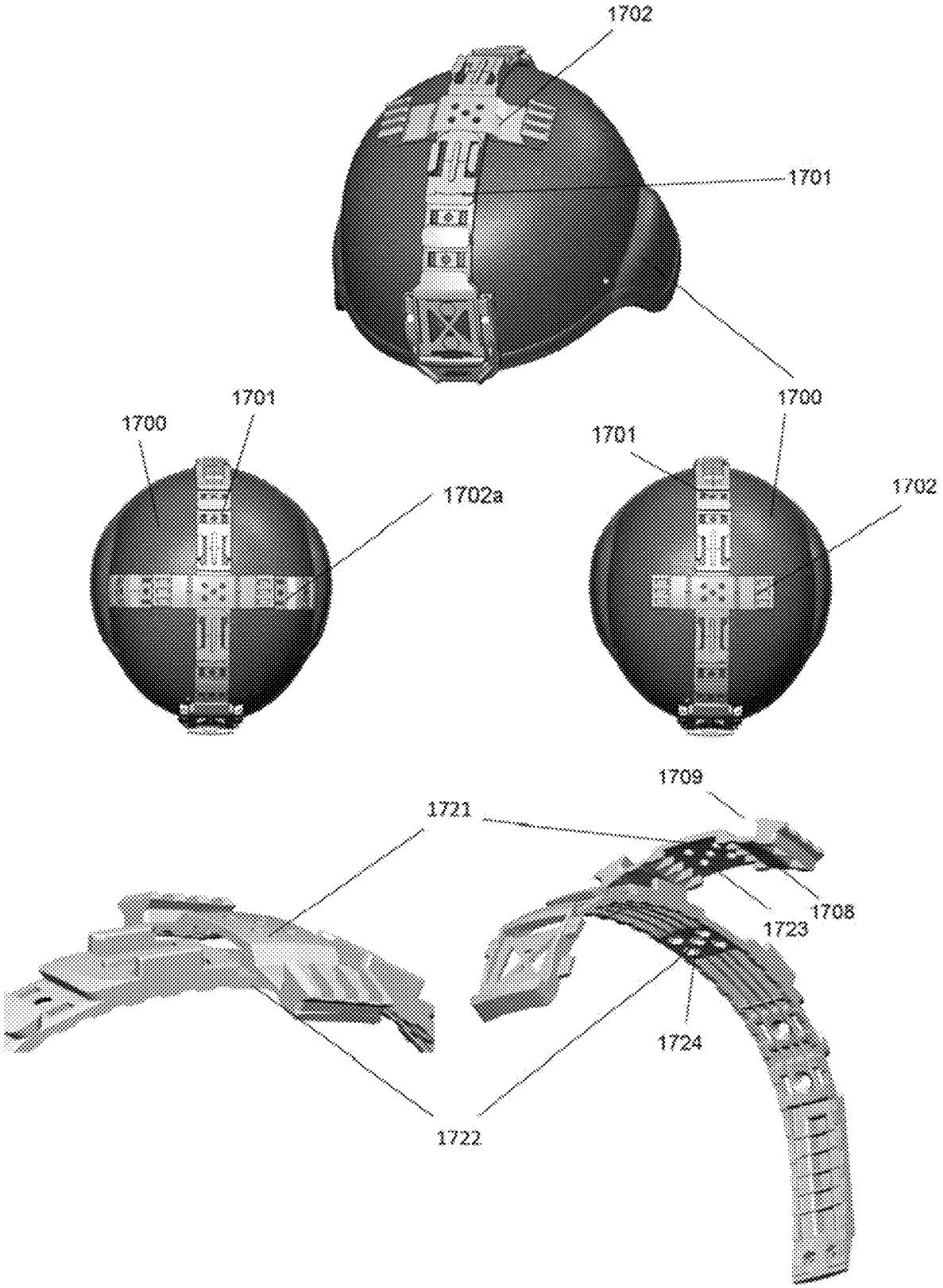
Figure 17G:
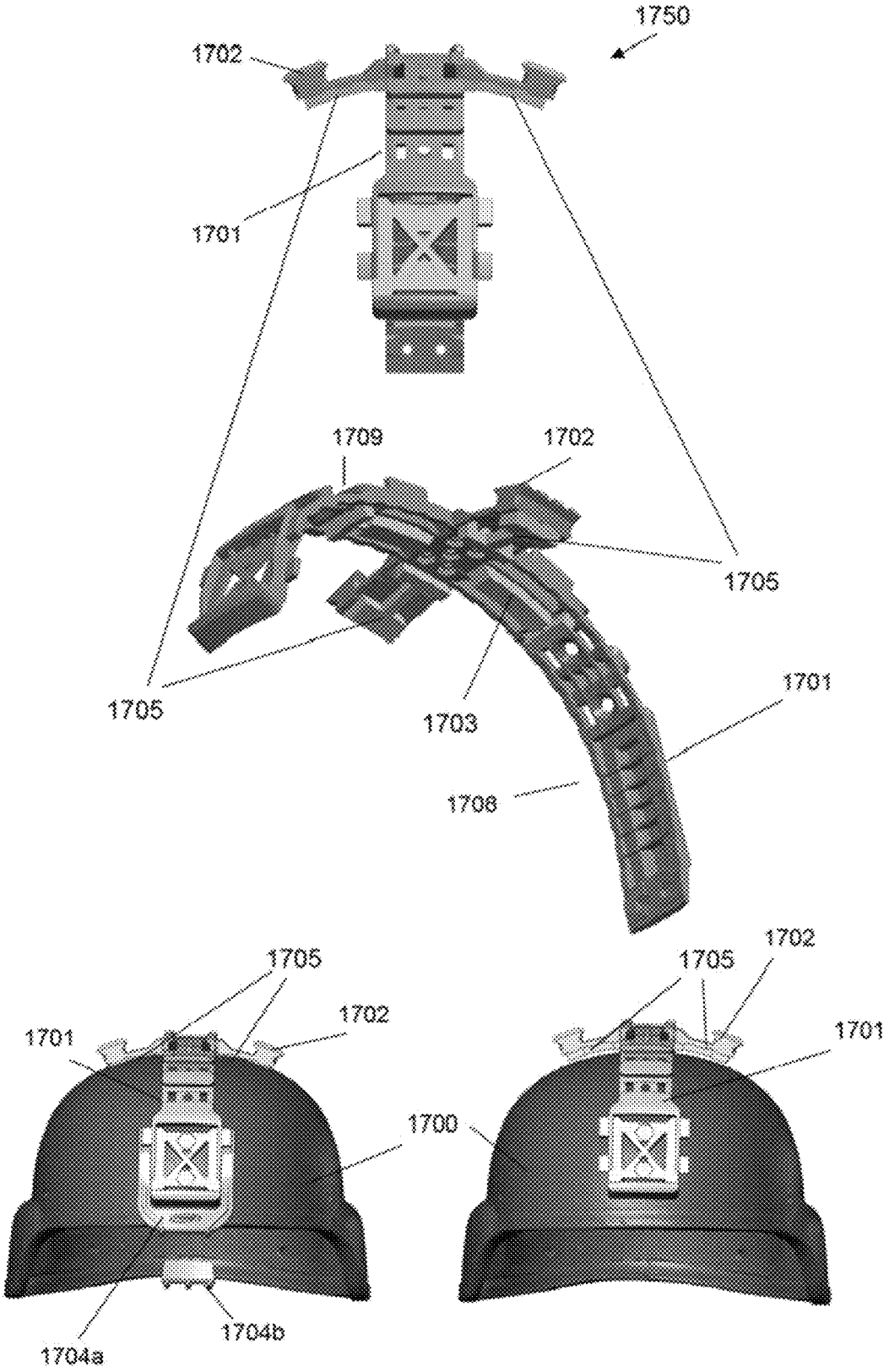
Figure 17H:
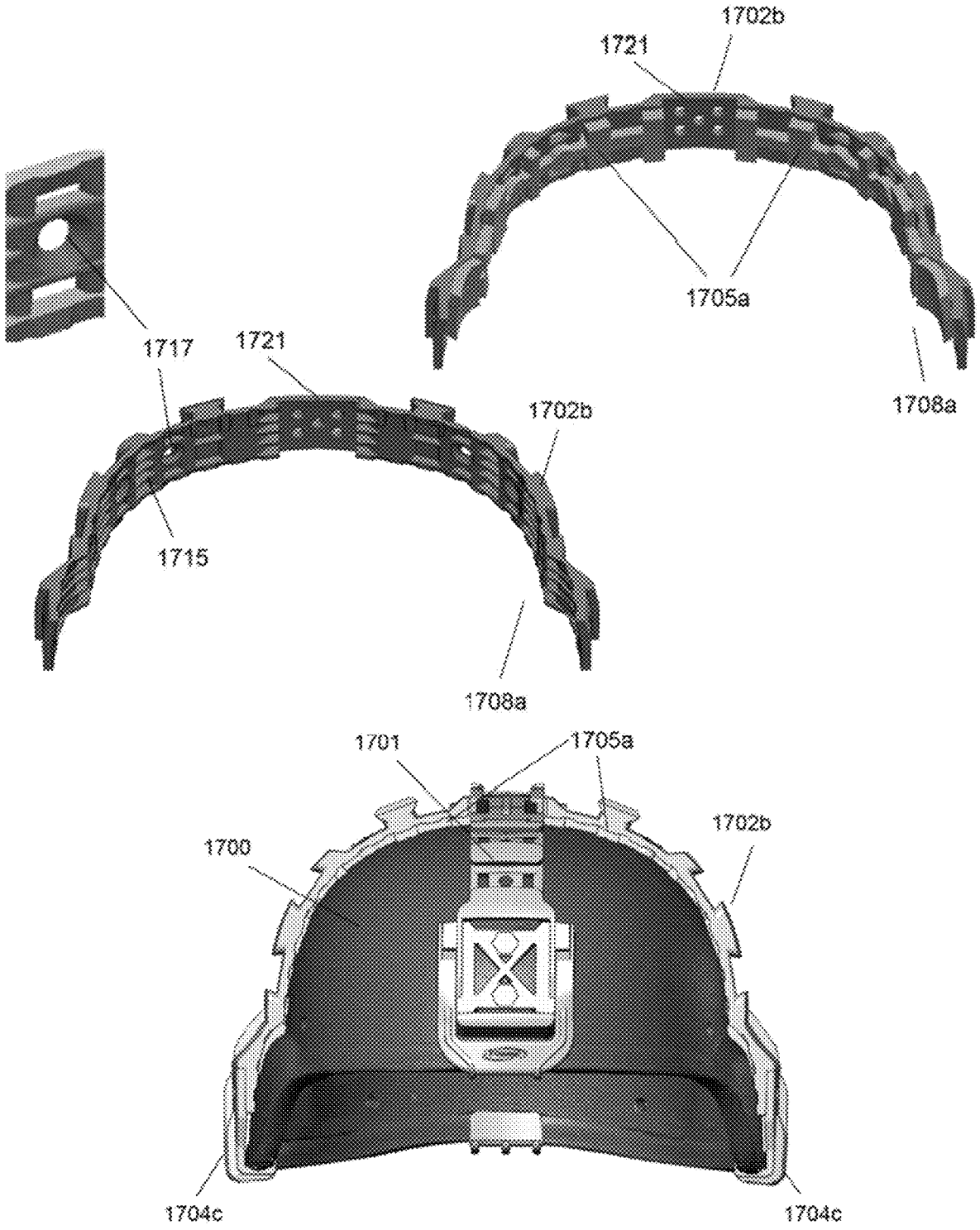
Figure 17I:
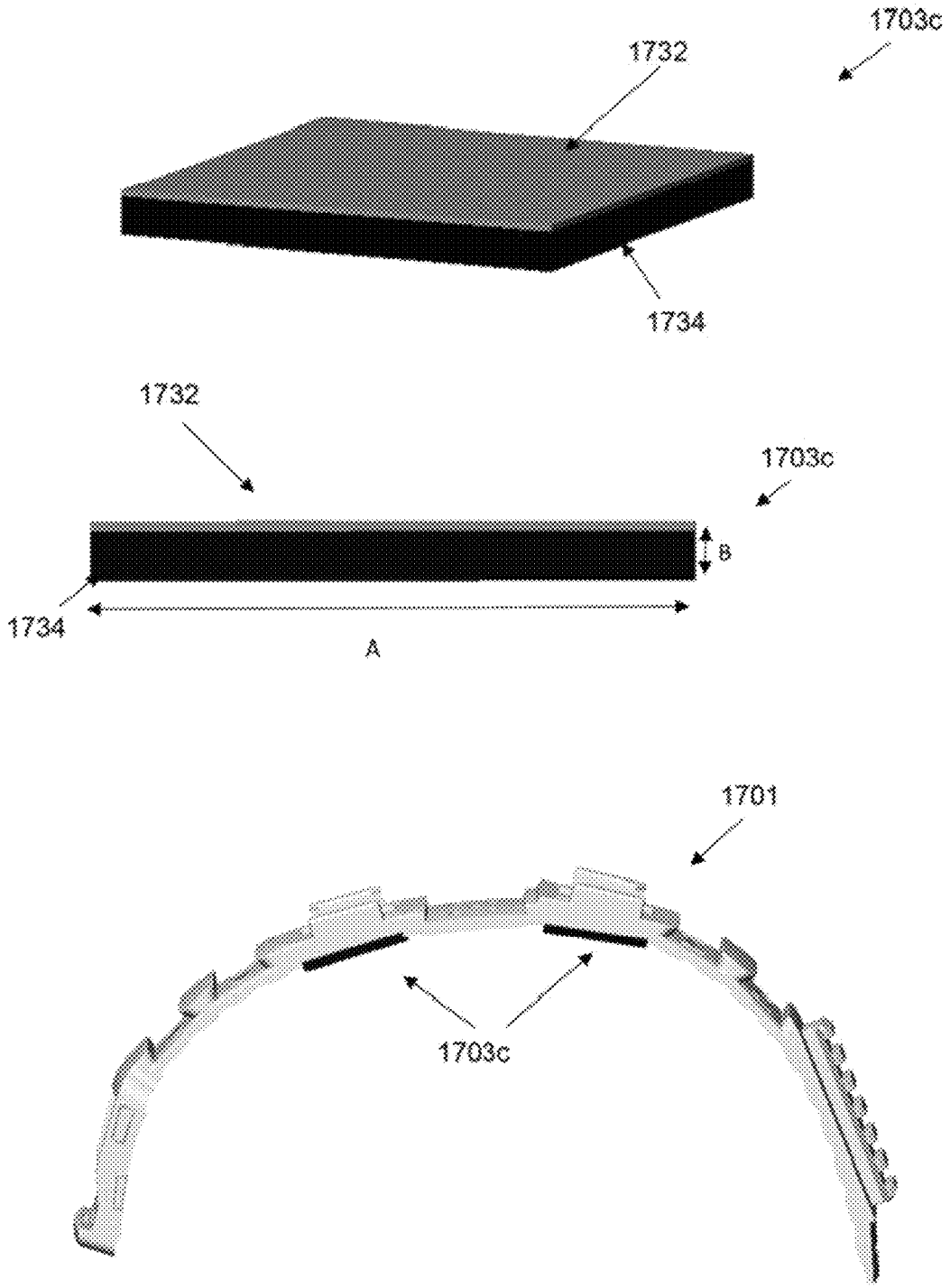
Figure 18A:
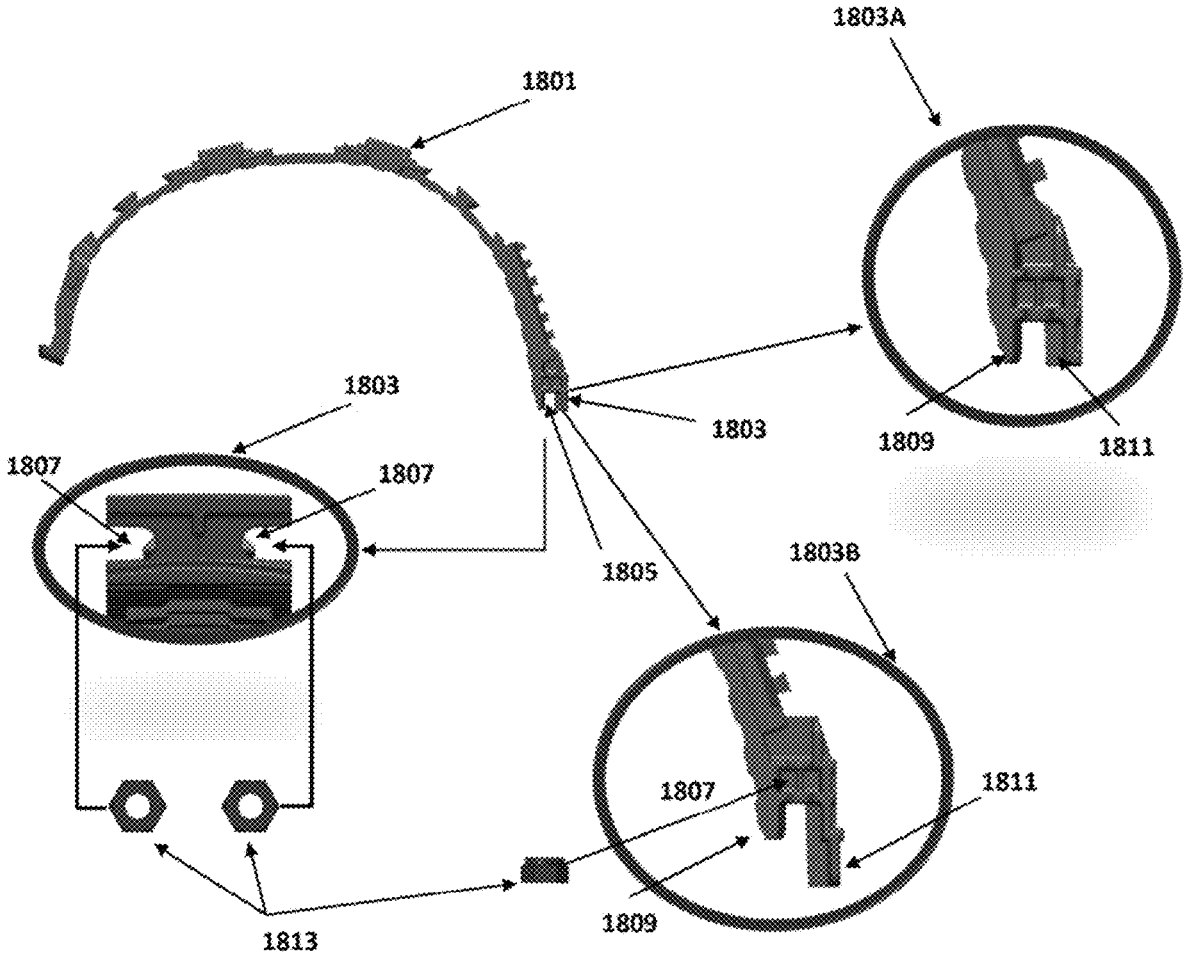
Figure 18B:
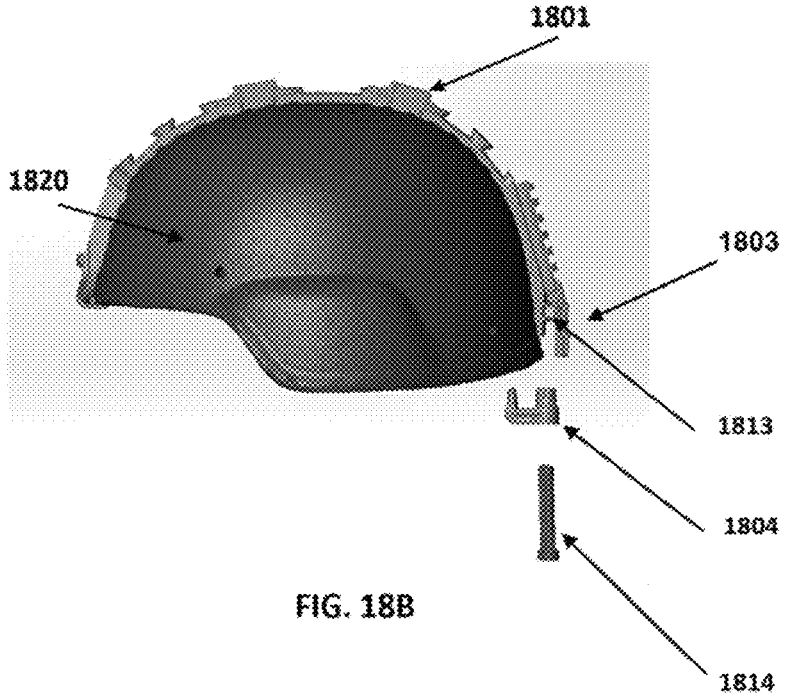
Figure 18C:
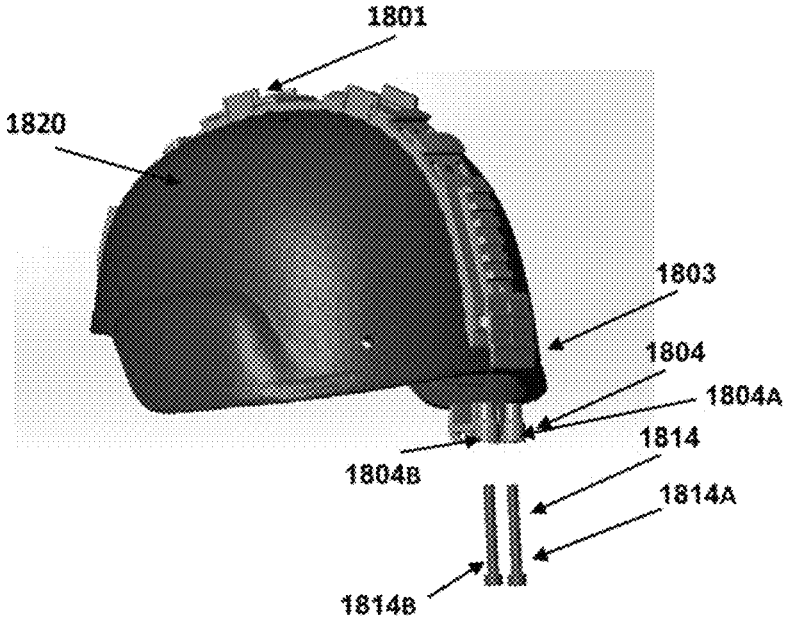
Figure 18D:
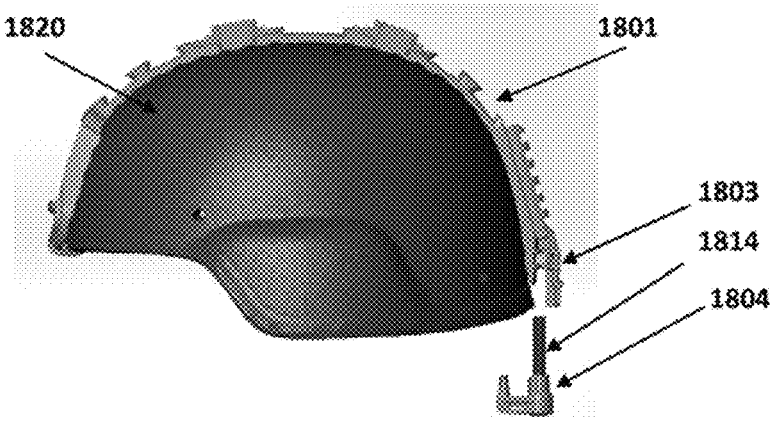
Figure 18E:
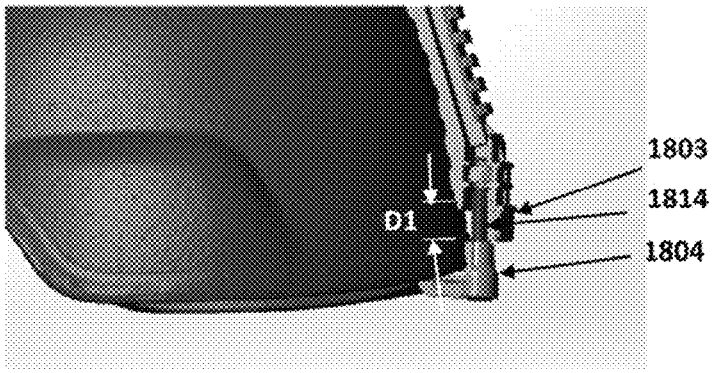
Figure 18F:
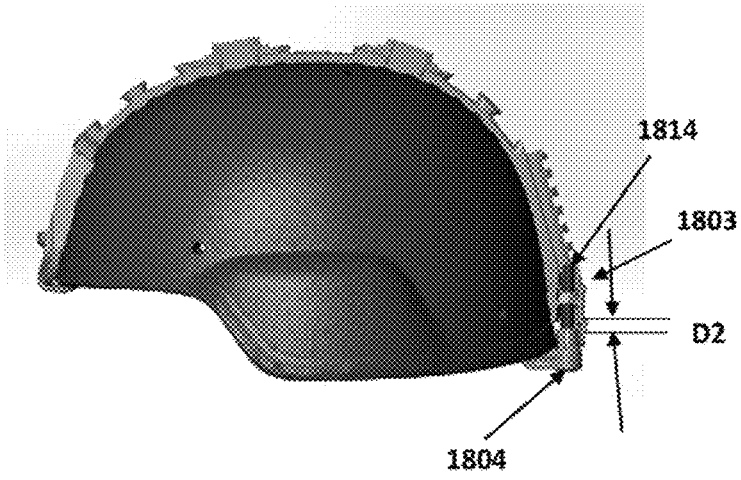
Figure 18G:
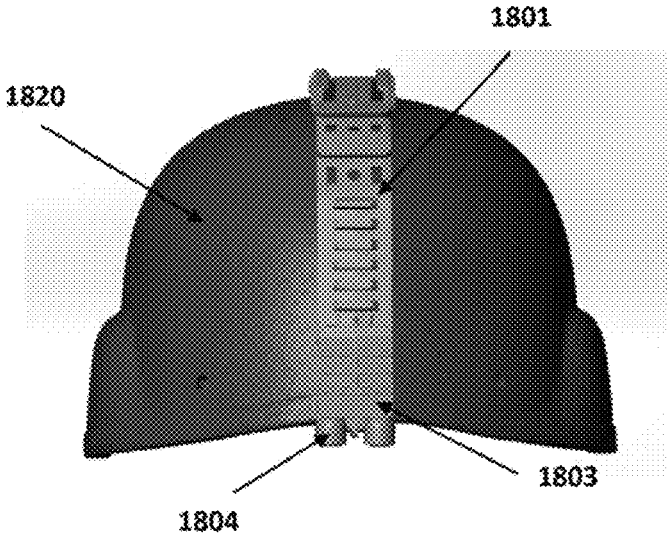
Figure 18H:
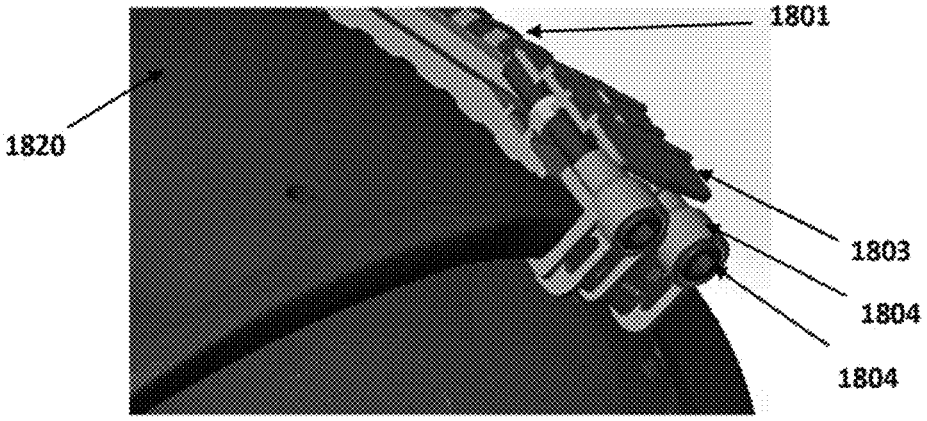

FIG. 13H schematically illustrates a bottom view of the first mounting unit, in accordance with an embodiment of the invention;

FIG. 13I schematically illustrates a side view of the first mounting unit, in accordance with an embodiment of the invention;

FIG. 13J schematically illustrates a second mounting unit, in accordance with an embodiment of the invention;

FIG. 13K schematically illustrates a bottom view of the second mounting unit of FIG. 13J, in accordance with an embodiment of the invention;

FIG. 13L schematically illustrates a side view of the second mounting unit of FIG. 13J, in accordance with an embodiment of the invention FIG. 13M schematically illustrates a front fastenable connector, a back fastenable connector, a left fastenable connector, and a right fastenable connector in accordance with an embodiment of the invention;

FIG. 14 schematically illustrates a helmet comprising a helmet mounting assembly having attached thereon exemplary helmet accessories, in accordance with embodiments of the present invention;

FIGS. 15A-15B schematically illustrate a top-view and side view of a first mounting unit, respectively, in accordance with an embodiment of the present invention;

FIGS. 16A-16B schematically illustrate a top-view and side view of a second mounting unit, respectively, in accordance with an embodiment of the present invention;

FIG. 17A schematically illustrates frontal and side views of a helmet including a first front-to-back mounting unit in accordance with the embodiment of the present invention;

FIG. 17B schematically illustrates a bottom view of a front-to-back mounting unit, with and without attached friction pads, and various views of an exemplary pad in accordance with the embodiment of the present invention;

FIG. 17C schematically illustrates installation of a front-to-back mounting unit on top of a helmet, in accordance with the embodiment of the present invention;

FIG. 17D schematically illustrates half-full length elastic friction and adjustment pads attached to front-to-back mounting unit, in accordance with the embodiment of the present invention;

FIG. 17E schematically illustrates a front-to-back mounting unit, with and without attached half-full length elastic friction and adjustment pads, and a perspective view of a pad in accordance with the embodiment of the present invention;

FIG. 17F schematically illustrates a helmet mounting assembly, including a front-to-back mounting unit and a partial side-to-side mounting unit in accordance with the embodiment of the present invention;

FIG. 17G schematically illustrates elastic friction pads attached to a partial side-to-side mounting unit in accordance with the embodiment of the present invention;

FIG. 17H schematically illustrates half-full length elastic friction pads attached to a full side-to-side mounting unit in accordance with the embodiment of the present invention;

FIG. 17I is a schematic illustration of adhesive elastic pads and of a mounting unit with attached adhesive pads, according to some embodiments of the present invention;

FIG. 18A schematically illustrates a side view of a front-to-back mounting unit including a connecting section, in accordance with an embodiment of the invention;

FIG. 18B schematically illustrates a side view of a front-to-back mounting unit to be installed on top of a helmet, prior to full installation, in accordance with an embodiment of the present invention;

FIG. 18C schematically illustrates a perspective side view of a front-to-back mounting unit to be installed on top of a helmet, prior to foil installation, in accordance with an embodiment of the present invention;

FIG. 18D schematically illustrates a side view of a front-to-back mounting unit to be installed on top of a helmet, during first stage of installation, in accordance with an embodiment of the present invention;

FIG. 18E schematically illustrates a side view of a front-to-back mounting unit to be installed on top of a helmet, during second stage of installation, in accordance with an embodiment of the present invention;

FIG. 18F schematically illustrates a side view of a front-to-back mounting unit to be installed on top of a helmet, during third stage of installation, in accordance with an embodiment t of the present invention;

FIG. 18G schematically illustrates a back view of a front-to-back mounting unit installed on top of a helmet, in accordance with an embodiment of the present invention; and FIG. 18H schematically illustrates a bottom-side view of a front-to-back mounting unit installed on top of a helmet, in accordance with an embodiment of the present invention.

DETAILED DESCRIPTION

In the context of the present disclosure, without limiting, the term 'helmet shell' refers to an inner part of an entire helmet, which does not include a color coating nor any cosmetic finish, and which is to be covered with a helmet cover in order to create a complete helmet assembly.

In the context of the present disclosure, without limiting, the term 'helmet cover' refers to an external part of an entire helmet. The helmet cover is typically a thin unit that may be colored with a certain predefined color and/or pattern, and/or may comprise esthetic features. The helmet cover may be positioned onto a helmet shell in order to create a complete helmet assembly.

In the context of the present disclosure, without limiting, the term 'helmet accessory' refers to any device or apparatus that may be attached to a helmet mounting unit, either directly or via a suitable adaptor. Examples for helmet accessories may be: goggles, night vision goggles, a night vision goggles batteries or battery pack, an illumination source (e.g., an infrared light source, a standard white light flashlight, a tactical flashlight, etc.), headphones, noise cancellation headphones, a gas mask, a camera, a face protector shield, a microphone, a radio, a radio microphone, an antenna, GPS (Global Positioning System), ear protection shield, mobile phone connection, etc.

The terms cited above denote also inflections and conjugates thereof.

A general non-limiting presentation of practicing the present disclosure is given below, outlining exemplary practice of embodiments of the present disclosure and providing a constructive basis for variant and/or alternative embodiments, some of which are subsequently described.

The present invention describes helmet mounting assemblies that may be used for military and law enforcement helmets, e.g., for police forces. Other helmet mounting assemblies may be used for sports e.g., hiking, biking, and mountain climbing, or other civilian purposes. Helmets or helmet assemblies are typically used in order to protect the wearer or user of the helmet. However, helmet assemblies according to the present invention may have an additional function of carrying a plurality of helmet accessories that the wearer may wish to use, e.g., a military soldier may wish to use night vision goggles along with an infrared (IR) illumination source or an IR or regular camera, in order to assist him during an operation taking place at night time, or a mountain climber may wish to use a radio device in order to receive constant information regarding weather changes, and thus to adjust his climbing route and timing. The mountain climber may further wish to stay in contact with other climbers, therefore, he would probably wish to have an earphone and microphone attached to his helmet in order to be able to speak to other climbers, as well as to hear from other climbers or simply to capture his moves and progress on video, e.g., via video camera.

Nowadays, there is not enough space on the mounting devices typically drilled into a helmet, in order to enable a user to simultaneously attach a plurality of helmet accessories. The present invention provides mounting units or sections that provide a plurality of possibilities of locations and connecting means at which to attach Various accessories onto a single helmet.

Reference is now made to FIG. 1A, which schematically illustrates a helmet assembly comprising a helmet and a first mounting unit, and a second mounting unit, in accordance with an embodiment of the present invention. Helmet 100 may be any kind of helmet used by military forces, civilians (e.g., athletes) or other non-civilians for any kind of activity. According to FIG. 1A, helmet 100 may have attached thereon a first mounting unit 101. The first mounting unit 101 may be attached onto helmet 100 such that one end of first mounting unit 101 reaches or approximately reaches the edge of helmet 100, while the opposite end of the first mounting unit 101 reaches or approximately reaches an opposite edge of helmet 100. The first mounting unit 101 passes along the external convex surface of helmet 100. In some embodiments, the first mounting unit 101 may be aligned along helmet 100 such to begin at the front end 180 of helmet 100 (e.g., at the end of helmet 100 that would be located above the face of the person or user who is to wear helmet 100) and reach the back end 182 of helmet 100 (e.g., at the end of helmet 100 that would be located above the back of the head of the person or user who is to wear helmet 100).

According to some embodiments, a second mounting unit 102 may be positioned on top of first mounting unit 101, such that second mounting unit 102 is positioned across first mounting unit 101. The second mounting unit 102 may be firmly attached onto first mounting unit 101 in order to ensure the first mounting unit 101 and the second mounting unit 102 are tightly attached onto helmet 100 and would not be easily separated neither from one another nor from helmet 100. Furthermore, the first mounting unit 101 and the second mounting unit 102 provide extra rigidity and strength to helmet 100 once attached onto helmet 100.

In some embodiments, the second mounting unit 102 may be aligned along the convex surface of helmet 100 such to begin at a first side portion 184 of helmet 100 and reach a second opposite side portion of helmet 100 located across the first side portion 184, where second mounting unit 102 began its passage along the external surface of helmet 100. The first side portion 184 and the second side portion located opposite the first side portion 184 may be located along the lower edge of the helmet and substantially adjacent to an ear of the user when wearing the helmet.

In some embodiments, first mounting unit 101 and second mounting unit 102 may have a shape that conforms to the shape of the helmet they are located on, such to create a good fit between the helmet, e.g., helmet 100 and each of the first mounting unit 101 and the second mounting unit 102. In addition, the size and length of first mounting unit 101 may conform to the size of the helmet it is located on, such that the ends of first mounting unit 101 may reach or substantially reach the edges of the helmet it is located on, e.g., helmet 100, for the purpose of enabling good attachment of first mounting unit 101 and its respective fastenable connectors, e.g., clips 104 and 105 (FIG. 1B). For example, a first end of first mounting unit 101, e.g., front end 190 may reach or substantially reach the edge of front end 180 of helmet 100. The second end of first mounting unit 1014 e.g., the back end (not shown) may reach or substantially reach the edge of back end 182 of helmet 100. In some embodiments, the size and length of second mounting unit 102 may conform to the size of the helmet it is located on, such that the ends of second mounting unit 102 may reach or substantially reach the edges of the helmet it is located on, e.g., helmet 100, for the purpose of enabling good attachment of second mounting unit 102 and its respective fastenable connectors, e.g., clips 106 and 107 (FIG. 1B). For example, first end 194 of second mounting unit 102 may reach or substantially reach the edge of first side portion 184 of helmet 100. Similarly, the second end of second mounting unit 102 (not shown) may reach or substantially reach the edge of its respective side portion of helmet 100, which is typically located opposite first side portion 184. Accordingly, it may be clear that any mounting unit may have a size and shape that conforms to the size and shape of the helmet it is intended to be located on.

In some embodiments, first mounting unit 101 and second mounting unit 102 may be located perpendicularly or substantially perpendicularly to one another, such to create a 90° angle $\alpha$ or a substantially 90 degrees angle $\alpha$ between each other. In other embodiments, the angle $\alpha$ between the first mounting unit 101 and the second mounting unit 102 may be any angle in the range of 0° to 180°. Typically, a 90° angle between the first mounting unit 101 and the second mounting unit 102 may provide the ultimate strength to helmet 100 if and when compression forces might be applied onto helmet 100 on either of the first mounting unit 101 or second mounting unit 102 By creating a 90 degrees angle between the first mounting unit 101 and the second mounting unit 102 and by positioning at least one of the first mounting unit 101 and the second mounting unit 102 at the axis from which compression forces may be applied onto helmet 100, helmet 100 acquires great strength and stability against such applied forces. For example, if external compression forces are to be applied onto helmet 100 in a direction that is towards the front end 180 and towards the back end 182 of helmet 100, the first mounting unit 101 may be located along the front-to-back ends of helmet 100, while and the second mounting unit 102 may be located along the sides of helmet 100, e.g., on top the location of the ears of the helmet user, which are located perpendicularly or substantially perpendicularly to the front-to-back ends, in order to provide greater stability to first mounting unit 101 against the externally applied forces. In case forces may be applied onto helmet 100 from a direction different from front-to-back of helmet 100, as long as at least one of the first mounting unit 101 and the second mounting unit 102 are located at the same direction from which the forces are applied onto helmet 100, and as long as first mounting unit 101 is located perpendicularly or substantially perpendicularly to second mounting unit 102, helmet 100 may improve its stability such to avoid its collapse due to externally applied compression forces.

Reference is now made to FIG. 1B, which schematically illustrates an exploded view of a helmet assembly, in accordance with an embodiment of the present invention. According to FIG. 1B, helmet 100 may comprise a first mounting unit 101 positioned on top of helmet 100, and a second mounting unit 102 located above the first mounting unit 101. In some embodiments, the first mounting unit 101 and the second mounting unit 102 may be attached to helmet 100 via at least one fastenable connector. For example, first mounting unit 101 and second mounting unit 102 may be attached to helmet 100 via clips 104, 105, 106 and 107. In some embodiments, each of the ends of first mounting unit 101 and second mounting unit 102 may be connected to the circumference of helmet 100 via one of clips 104, 105, 106 and 107. For example, one end of first mounting unit 101 (e.g., an end located at the front end 180 of helmet 100, whereby the front end 180 of helmet 100 may be the end that is to be located adjacent to, e.g., above the face of the wearer or user of helmet 100) may be attached to helmet 100 via clip 104, while the opposite end of first mounting unit 101 (e.g., an end located at the back end 182 of helmet 100, whereby the back end 182 is the end of helmet 100 that is to be located adjacent to, e.g., above the back of the wearer or user of helmet 100) may be connected to helmet 100 via clip 105. One end of second mounting unit 102 (e.g., an end located on a first side portion 184 of helmet 100, for example, the first side portion 184 of helmet 100 may be located adjacent to the helmet user's left ear) may be attached to helmet 100 via clip 106, while the opposite end of second mounting unit 102 (e.g., an end located on a second side portion opposite the first side portion of helmet 100, for example, located adjacent to the right ear of the helmet user) may be connected to helmet 100 via clip 107. In some embodiments, fastenable connectors, e.g., clips 104, 105, 106 and 107 may ensure tight attachment of first mounting unit 101 and second mounting unit 102 to helmet 100, while avoiding the need to use fastening means that penetrate through the helmet. Thereby, non-penetrating fastenable connectors, e.g., clips 104, 105, 106 and 107 overcome the problem of weakening the helmet, which may occur when a hole is created through the helmet, e.g., by a drill. In some embodiments, in order to secure the fastenable connectors, e.g., clips 104, 105, 106 and 107 to helmet 100 such to ensure safe attachment of first mounting unit 101 and second mounting unit 102 to helmet 100, the fastenable connectors, e.g., clips 104, 105, 106 and 107 may be attached to first mounting unit 101 and to second mounting unit 102 via fastening means, e.g., screws 109. Screws 109 may be configured to be screwed only into first and second mounting units 101 and 102, respectively, without penetrating through helmet 100. Each of clips 104 and 105 may be attached to the first mounting unit 101 via screw 109, which may be screwed into a corresponding nut 108 that may be pre-fitted into and pre-fixed to the first mounting unit 101, from its internal side. Once each of the two screws 109 is fastened through the external side of first mounting unit 101 against corresponding nuts 108, clips 104 and 105 may be attached to each of the two ends of first mounting unit 101. Similarly, each of clips 106 and 107 may be attached to second mounting unit 102 via screws 109. Each of the two screws 109 may be screwed into a corresponding nut 108 that may be pre-fitted into and pre-fixed to the second mounting unit 102, from its internal side. Nuts 108 may be used to support fastening of each of screws 109 from the external side of second mounting unit 102 through nuts 108, to each of the two ends of second mounting unit 102.

In order to assemble the helmet assembly for attaching helmet accessories to helmet 100, a first mounting unit 101 may be positioned over and attached to helmet 100 via non-penetrating fastenable connectors, e.g., clips 104 and 105. In some embodiments, screws 109 may be screwed into their corresponding nuts 108 present within the internal side of first mounting unit 101, in order to strengthen the attachment of first mounting unit 101 to helmet 100 via clips 104 and 105. Following attachment of the first mounting unit 101 to helmet 100, the second mounting unit 102 may be positioned on lop of first mounting unit 101 and may be attached to helmet 100 via non-penetrating fastenable connectors, e.g., clips 106 and 107. In some embodiments, in order to strengthen the attachment of second mounting unit 102 to helmet 100, screws 109 may be screwed into second mounting unit 102 through their corresponding nuts 108.

Reference is now made to FIG. 1C, which schematically illustrates a first mounting unit, in accordance with an embodiment of the invention. First mounting unit 101 may comprise at least one rail, grip or connector configured for connecting at least one helmet accessory to the first mounting unit 101. For example, first mounting unit 101 may comprise at least one of rails 121, and 126, or any other rails that may be positioned as part of first mounting unit 101. Rail 121 or 126 may be configured to enable connection of a helmet accessory (e.g., a camera, an illumination source, a microphone, batteries or battery pack, etc.) to helmet 100 via the rails, either directly or using an adaptor between the rails and the helmet accessory. In some embodiments, instead of or in addition to at least one rail, first mounting unit 101 may comprise at least one connector, e.g., connector 127, which may be configured to enable connection of a helmet accessory, e.g., a night vision goggle, as illustrated the figure. In some embodiments, instead of any of a rail or a connector or in addition to at least one of a rail or a connector, first mounting unit 101 may comprise grip 160, which may be configured to enable attachment of a helmet accessory of helmet accessory adaptor (e.g., a gripper) to grip 160.

In some embodiments, the rails on the first mounting unit 101, e.g., rails 121 may comprise a beveled edge 122. The beveled edge 122 may enable an easy and smooth insertion of helmet accessories onto rail 121. Furthermore, rails of the first mounting unit 101, e.g., rail 121, may comprise a rail conveyer 123, which may be configured to grip and hold the helmet accessory or helmet accessory adaptor, and thus prevent removal of the helmet accessory or helmet accessory adaptor off the rail, in a direction that is vertical with respect to the sliding motion of a helmet accessory or helmet accessory adaptor along the rails. In some embodiments, the rails may provide stabilization for and may prevent movement of a helmet accessory or helmet accessory adaptor in any direction except for the sliding direction of the helmet accessory or helmet accessory adaptor along each of the rails.

In some embodiments, the rails of first mounting unit 101 may be configured to comprise at least one hole, e.g., at least one of holes 133, onto which a helmet accessory or helmet accessory adaptor may be connected. The number of holes along each rail may be changeable and may be predetermined according to the helmet accessory or helmet accessory adaptor that is to be connected to the first mounting unit 101, In some embodiments, each or some of holes 133 may comprise two different sides; a first side 124 that comprises a break that locks the helmet assembly or helmet assembly adaptor within hole 133, and a second side 125 that has a curved end, which is lower than the surface of the rail. The curved lower end is configured to enable easy exit of the helmet accessory or the helmet accessory adaptor out of hole 133, and thus but of rail 121.

In some embodiments, connectors of first mounting unit 101, e.g., connector 127, may comprise gripper 128A and gripper 128B that may hold the helmet accessory or helmet accessory adaptor in place, and may prevent the helmet accessory (or helmet accessory adaptor) to easily detach from the connectors, e.g., connector 127, along a direction that is vertical with respect to the sliding motion of a helmet accessory or helmet accessory adaptor along the connectors.

In some embodiments, gripper 128A and gripper 128B may comprise an indentation (bottom view of gripper 128A and upper view of gripper 128B), which a suitable helmet accessory or suitable helmet accessory adaptor that comprise a respective protrusion, may be inserted into and secured within.

In some embodiments, as mentioned with respect to FIG. 1B, in order to strengthen the connection between the first mounting unit 101 to the helmet via fastenable connectors that do not penetrate through the helmet, e.g., clips, the fastenable connectors may be screwed or otherwise fastened to the first mounting unit 101. The area at which the fastenable connector is connected to the first mounting unit 101 is area 130. Hole 131 may be a hole through which a screw or any other fastening means may be inserted in order to fasten the fastenable connector, e.g., a clip to first mounting unit 101, thus tightly fastening or attaching first mounting unit 101 to the helmet. In some embodiments, a screw or other fastening means may be inserted through hole 131 from the external side of first mounting unit 101, while a corresponding securing nut may be located at the internal side of first mounting unit 101, at nut-hole 132. In some embodiments, the corresponding nut may be located at and attached to a pre-assigned indent on the internal side of first mounting unit 101, which may be of the same shape as that of the nut (see indentation 150A, FIG. 1F that is in the shape of a hexagon such to fit a hexagon shape of a corresponding securing nut, any other shape may be implemented). The nut may be reinforced and fixed into its indent, such that the corresponding screw may be safely screwed through hole 131 while being stabilized by the fixed nut. The internal side of first mounting unit 101 is further illustrated in FIG. 1D, while FIG. 1E illustrates a side-view of the first mounting unit 101. The curve of first mounting unit 101 is configured to conform to the curve of the helmet it is intended to be attached to. In other embodiments, fastenable connectors need not be attached to the mounting units via penetrating fastening means, but may rather be attached to the mounting units via glue or other non-penetrating fastening means. In which case, hole 131 would not be present in first mounting unit 101.

In some embodiments, the first mounting unit 101 may be located along the helmet such that one end of first mounting unit 101 is located above the section of the helmet that is to be worn above the face of the helmet wearer, while the opposite end of first mounting unit 101 may be located above the section of the helmet that is to be worn above the back of the head of the helmet wearer.

In some embodiments, first mounting unit 101 may comprise a section 129 that is configured to fit to a corresponding area along second mounting unit 102. In some embodiments, second mounting unit 102 may fit onto first mounting unit 101 before both mounting units are attached onto the helmet, though in other embodiments, first mounting unit 101 is attached to the helmet (possibly further secured to helmet 100 via fastenable connectors) and only then second mounting unit 102 is attached onto helmet 100 via its attachment to first mounting unit 101 (and possibly further secured to helmet 100 via fastenable connectors). In some embodiments, section 129 may be lowered as compared to the surface of first mounting unit 101, in order to provide space for the second mounting unit 102 to fit into section 129.

In some embodiments, only one mounting unit, either first mounting unit 101 or second mounting unit 102 may comprise at least one rail, grip or connector configured for connecting at least one helmet accessory or helmet accessory adaptor to the respective first or second mounting unit. However, although one of the mounting units may not comprise any rails, grips or connectors, this one mounting unit is an important part of the helmet mounting assembly since it provides stability to the mounting unit that does comprise at least one rail, grip or connector, and thus provides stability to the entire helmet mounting assembly with respect to the helmet due to the two mounting units being located one across the other. Reference is now made to FIG. 1F, which schematically illustrates a second mounting unit, in accordance with an embodiment of the invention. Second mounting unit 102 may comprise at least one rail, grip or connector configured for connecting at least one helmet accessory to the second mounting unit 102. For example, second mounting unit 102 may comprise rail 141 or 151, and in addition to or instead of the rails, second mounting unit 102 may comprise at least one connector, e.g., connector 146.

In some embodiments, rails, e.g., rail 151 may comprise at least one hole, e.g., at least one of holes 152, which may be configured to enable connection of a helmet accessory or a helmet accessory adaptor to the second mounting unit 102 via the holes 152. The number of holes along each rail may be changeable and may be predetermined according to the helmet accessory or helmet accessory adaptor that is to be connected to the second mounting unit 102. In some embodiments, the holes of the rails may comprise two different sides, as described with respect to FIG. 1C. A first side 144 may comprise a break that locks the helmet assembly or helmet assembly adaptor within the hole, e.g., hole 152, and a second side 145 that may have a curved end, which is lower than the surface of the rail. The curved lower end is configured to enable easy exit of the helmet accessory or the helmet accessory adaptor out of hole 152. In some embodiments, other numbers of breaks and/or other numbers of curved edges may be implemented in order to provide a complex mechanism that may prevent easy exit of a helmet accessory or helmet accessory adaptor out of the rail's hole 152, and thus off mounting unit 102.

In some embodiments, the rails, e.g., rail 141 may comprise a beveled edge 143 that is configured to enable a smooth insertion of the helmet accessory or helmet accessory adaptor onto the rail, e.g., rail 141.

In some embodiments, in order to strengthen the connection between the second mounting unit 102 to the helmet via fastenable connectors that do not penetrate through the helmet, e.g., clips, the fastenable connectors may be screwed or otherwise fastened to the second mounting unit 102. The area at which the fastenable connector is connected to the second mounting unit 102 is area 148. Hole 149 may be a hole through which a screw or any other fastening means may be inserted in order to fasten the fastenable connector, e.g., a clip to second mounting unit 102, thus tightly fastening or attaching second mounting unit 102 to the helmet. In some embodiments, a screw or other fastening means may be inserted through hole 149 from the external side of second mounting unit 102, white a corresponding securing nut may be located at the internal side of second mounting unit 102, at nut-hole 150 that may comprise indentation 150A designed to fit to the shape of the securing nut. For example, indentation 150A may be in the shape of a hexagon if the shape of the securing nut is of a hexagon. It should be clear that any other shape may be implemented per the securing nut and thus to indentation 150A.

In some embodiments, the corresponding securing nut may be located at and attached to a pre-assigned indent 150A on the internal side of second mounting unit 102, which may be of the same shape as that of the nut. The securing nut may be reinforced and affixed into its indent, such that the corresponding screw may be safely screwed through hole 149 while being stabilized by the fixed nut.

In some embodiments, the rails of the second mounting unit 102, e.g., rail 151, may comprise a rail conveyer 142, which may be configured to grip and hold the helmet accessory or helmet accessory adaptor that is connected to the rail, and thus prevent removal of the helmet accessory or helmet accessory adaptor off the rail, in a direction that is vertical with respect to the sliding motion of a helmet accessory or helmet accessory adaptor along the rails.

In some embodiments, the grips, e.g., grip 146 may comprise holes in order to provide additional connection points for certain helmet accessories or helmet accessories' adaptors. For example, the holes in grip 146 may be configured to enable connection of a headphone locking mechanism to second mounting unit 102, via grip 146. In some embodiments, grips such as grip 146, may replace the need for certain helmet accessory adaptors, since some helmet accessories are manufactured comprising grippers that may grip directly onto a grip. Nowadays, since mounting units do not comprise grips, there is a need to add to such helmet accessories an adaptor that is inserted, for example, within a rail or onto a connector, and which has the shape of a grip such that the helmet accessory that has a gripper may be connected to the mounting unit via such a grip shaped adaptor. Therefore, grips such as grip 146 may enable direct attachment of helmet accessories comprising grippers onto a grip that is an integral part of the mounting unit, as in the case of grip 146.

In order to attach second mounting unit 102 onto first mounting unit 101 such that second mounting unit 102 is positioned across first mounting unit 101, second mounting unit 102 may comprise section or area 147 that is designed to fit a corresponding section or area 129 located in first mounting unit 101 (FIG. 1G). Thus, second mounting unit 102 may be fitted onto first mounting unit 101. In some embodiments, section 147 of second mounting unit 102 may have a shape that is configured to exactly fit onto corresponding section 129 of first mounting unit 101. Section 147 may comprise a projection that is of the size and shape of the corresponding indent of section 129 of first mounting unit 101, such that the protrusion of section 147 is placed directly on top the indent of first mounting unit 129. Typically, second mounting unit 102 is fitted onto first mounting unit 101 without section 147 being higher than the surface of the rest of second mounting unit 102 neither it being higher compared to the surface of first mounting unit 101, thus second mounting unit 102 and first mounting unit 101 may create a continuous assembly that appears as one whole part, and not as two separate units. According to some embodiments, the second mounting unit 102 is first fitted onto the first mounting unit 101 such that second mounting unit 102 is positioned across first mounting unit 101, and then the assembly of both first and second mounting units is attached to the helmet. However, in other embodiments, the first mounting unit 101 may first be attached to the helmet and only then the second mounting unit 102 is fitted onto and attached to the first mounting unit 101 and to the helmet.

In some embodiments, section 147 may comprise a rail, e.g., rail 151, and the holes of rail 151, e.g., holes 152 may be configured to interconnect with the holes in corresponding section 129 (FIG. 1C) in order to provide a more secure attachment between first mounting unit 101 and second mounting unit 102. In other embodiments, section 147 need not comprise a rail, and thus there may be space on section or area 147 for other features, e.g., for adding a cosmetic feature, for example, a company's logo.

In some embodiments, second mounting unit 102 may be oriented along the helmet such that one end of second mounting unit 102 is located above a section of the helmet that is to be located above the ear of the helmet Wearer or user, whereas the opposite end of the second mounting unit 102 may be located above a section of the helmet that is to be located above the opposite ear of the helmet Wearer. For example, the first end of second mounting unit 102 may be located above the right ear of the helmet wearer or user, while the opposite end of the second mounting unit 102 may be located above the left ear of the helmet wearer, or vice versa. In other embodiments, second mounting unit 102 may be located at different orientations along the helmet, so as long as the second mounting unit 102 is positioned across the first mounting unit 101.

Reference is now made to FIG. 1G, which schematically illustrates a second mounting unit, in accordance with another embodiment of the invention. In some embodiments, second mounting unit 102 may have different configurations and different order of elements attached thereto, with respect to the configuration as illustrated in FIG. 1F. FIG. 1G therefore illustrates an additional example of a second mounting unit 102*a* that has a different configuration compared to that illustrated in FIG. 1F. For example, second mounting unit 102*a* may not comprise any rail at the top of second mounting unit 102*a*, in the location where rail 151 is illustrated in FIG. 1F. Furthermore, second mounting unit 102*a* may comprise three rails 141 instead of two rails 141 as illustrated in FIG. 1F, and second mounting unit 102*a* may comprise three grips instead of two grips on mounting unit 102, as illustrated in FIG. 1F. Any other number of rails, any other location of any of the rails, and any location and number of connectors or grips may be implemented as part of any of the first or second mounting units.

In some embodiments, second mounting unit 102*a* may comprise at least one grip, e.g., grip 161, which may be configured to be gripped by helmet accessories that comprise a gripper, thus such helmet accessories may be directly attached onto second mounting unit 102*a*, while avoiding the need for an adaptor to be placed between the helmet accessory and the mounting unit 102*a*. In some embodiments, the dimensions of the at least one grip may be predesigned according to either off-the-shelf helmet accessories that comprise grippers or to a specifically designated helmet accessory. In some embodiments, the dimensions of any grip that second mounting unit 102 comprises, may differ from the dimensions of any other grip that second mounting unit 102*a* comprises.

In some embodiments, grips, such as grips 161 and 161A may be configured to overcome the need for an excess of helmet accessory adaptors, as with current cameras that may be configured to attach onto a helmet via several connectors, instead of only one connector, according to the present invention. For example, in order to attach a camera (e.g. a sport or a GoPro™ camera manufactured by GoPro Inc.) onto a helmet, e.g., helmet 100 (FIG. 1A), the camera may be connected to a gripper 162 that may be connected to an adaptor 163, which may be inserted within a connector or onto a rail that are an integral part of a mounting unit, e.g., mounting unit 102*a*, in order to attach the camera to mounting unit 102*a*. Adaptor 163 may be configured to comprise two different ends; a first end, which is the end that is external to and which protrudes out of mounting unit 102*a*, may have the shape of a grip, and a second end, which is the end located opposite the first end, may be configured to being inserted into connecting means of mounting unit 102*a*.

According to the present invention, mounting unit 102*a* may comprise various types of connectors and/or grips that may enable either direct attachment of helmet accessories onto a helmet via mounting unit 102*a*, or enable attachment of helmet accessories via a single adaptor or connector attached to mounting unit 102*a*. For example, grip 161 and grips 161A may each be configured to have attached thereon different kinds of grippers. The sizes and shapes (e.g., the widths and lengths) of grip 161 and of grip 161A may be adjusted such to enable connection of various types of off-the-shelf grippers. For example, grip 161A may be configured to have attached thereon a gripper such as gripper 162 that may be connected to a camera, such that a camera may be attached onto mounting unit 102*a* via a single connected, in this example, gripper 162.

In some embodiments, grip 161 may comprise holes or indents 146. Holes or indents 146 may provide additional safety and stability for attachment of a gripper onto grip 161, if and when a corresponding gripper comprises corresponding protrusions such to be inserted into holes 146, thus preventing easy detachment of a gripper from grip 161.

In some embodiments, in order to provide additional stability to the connection between a gripper and grip 161A, grip 161A may comprise protrusions 164 and respective indents 165 located in between protrusions 164. A corresponding gripper, e.g., gripper 162 that may be configured to grip and be attached onto grip 161A may comprise protrusions corresponding to indents 165, which may to be inserted into indents 165. In addition, such a gripper may comprise indents corresponding to protrusions 164, whereby the indents may be configured to accept protrusions 164 into them. Such a suitable gripper that may attach to grip 161A, may further comprise a catcher of some kind that may be configured to prevent movement of the gripper along protrusions 164 and thus maintain its position along grip 161A.

FIG. 1H schematically illustrates a grip configured to have attached thereon a camera gripper, in accordance with an embodiment of the invention. Camera grip 170 may be configured to be gripped by a designated off-the-shelf (or tailor-made) camera gripper. Typically, currently manufactured camera grippers include several protrusions having indents in between two adjacent protrusions. Thus, grip 170 may comprise corresponding protrusions 172 and indents 174 such that the camera gripper's protrusions would be placed in between indents 174, protrusions 172 of grip 170 would be inserted in between the indents of the camera gripper. That is, the camera gripper's protrusions may be located between protrusions 172 of grip 170, and vice versa. In addition, camera grippers typically include a screw that may be screwed through all protrusions—those of the camera gripper and those of grip 170, i.e., protrusions 172, which are located adjacent to the protrusions of the camera gripper. The screw passing through all protrusions may ensure tight and secure attachment of the camera gripper to grip 170. In order to enable such a securing screw to pass through the protrusions of both the gripper and grip 170, all protrusions may comprise a hole, e.g., hole 176 of protrusions 172. In some embodiments, the screw may be further secured with a corresponding nut.

The number of protrusions 172 of grip 170 may be predetermined in accordance with the number of indents appearing in off-the-shelf or tailor-made camera grippers. Accordingly, the number of indents 174 may be predetermined in accordance with the number of protrusions appearing in off-the-shelf or tailor-made camera grippers.

A mounting Unit, e.g., first mounting unit 101 and/or second mounting unit 102 may comprise a camera grip, such as grip 170.

FIG. 1I schematically illustrates a bottom view of the second mounting unit of FIG. 1F, in accordance with an embodiment of the invention. Holes 152 that are part of rail 151 may be noticed in FIG. 1I. And FIG. 1J schematically illustrates a side-view of the second mounting unit of FIG. 1F, in accordance with an embodiment of the invention. The curve of second mounting unit 102 is configured to conform to the curve of the helmet it is intended to be attached to.

According to some embodiments, first mounting unit 101 and second mounting unit 102 may be made of any one of thermoplastic polymers, thermoset polymers, and elastomers, or any combination thereof.

According to some embodiments, first mounting unit 101 and second mounting unit 102 may be made of any one of the following materials: Nylon, Polyamide (PA, Nylon 6/6, Nylon 6, PA-12), Carbon Fiber, Polyetheretherketone (PEEK), Polyetheretherketone (PEEK), Polyetherketoneketone (PEKK), co-polyester, Polyoxymethylene (POM), Polyethylenimine (PEI), Polycarbonate, Acrylonitrile butadiene styrene (ABS), Polylactic acid (PLA), Poly(methyl methacrylate) (PMMA), PEI (Ultem®), Santoprene®, Polypropylene (PP), Polyurethane (PUR), Poly-Vinyl-Chloride (PVC), Polystyrene (PS), Polyphenylene Sulfide (PPS), Polycarbonate (PC), Polyethylene (PE), PBT (polybutylene terephthalate), PPSU (Radel®), Epoxy, graphite, PETG, Polyethylene Teraphthalate (PET), Polysulphone (PSU), PBT (Valox®), PARA (IXEF®), PAI (Torlon®), Polyethersulphone (PES), PET-P (Ertalyte®), ASA (acrylonitrile styrene acrylate), Polyimides, Urethane elastomere (TPE-U), mica, PPE, UP, PS, PBT, SMA, Wollastonite, or any combination thereof. In other embodiments, other polymers and/or any other combinations may be used.

Reference is now made to FIG. 2A, which schematically illustrates an assembly of a helmet and a helmet mounting unit, in accordance with an embodiment of the present invention. According to FIG. 2A, a helmet mounting unit 201 may be attached onto helmet 200 such to create a helmet assembly 210. In some embodiments, helmet mounting unit 201 may comprise a first mounting section 211 and a second mounting section 212 that may be positioned one across the other and over the external convex surface of helmet 200. In some embodiments, mounting unit 201 may comprise a first mounting section 211 and a second mounting section 212, which may be connected to one another such to create one complete whole mounting unit 201. In some embodiments, mounting unit 201 that comprises the first and second mounting sections is created as one item, e.g., by injection into a single mold or by digital printing of the entire mounting unit 201 at once, or by any other manufacturing methods that are configured for producing a single product.

In some embodiments, first mounting section 211 may be aligned along the convex surface of helmet 200 such that a first end of first mounting section 211 may be located at the front end 280 of helmet 200, e.g., at the end of helmet 200 that would be located above the face of a person or user when wearing helmet 200, while a second end of first mounting section 211 may reach and be located at the back end 282 of helmet 200, e.g., at the end of helmet 200 that would be located above the back of the head of the user, when wearing helmet 200.

In some embodiments, second mounting section 212 may be aligned along the convex surface of helmet 200 such that a first end of second mounting section 212 may be located at a first side portion 284 of helmet 200, e.g., adjacent to an ear of a user when wearing helmet 200, while a second end of second mounting section 212 may be located at a second side portion of helmet 200 (not shown), opposite the first side portion 284, e.g., adjacent to the opposite ear of the user when wearing the helmet.

In some embodiments, first mounting section 211 and second mounting section 212 may have a shape that conforms to the shape of the helmet they are located on, such to create a good fit between the helmet, e.g., helmet 200 and each of the first mounting section 211 and the second mounting section 212. In addition, the size and length of first mounting section 211 may conform to the size of the helmet it is located on, such that the ends of first mounting section 211 may reach or substantially reach the edges of the helmet it is located on, e.g., helmet 200, for the purpose of enabling good attachment of first mounting section 211 and its respective fastenable connectors, e.g., clips 205 and 206 (FIG. 2B). For example, a first end of first mounting section 211, e.g., front end 290 may reach or substantially reach the edge of front end 280 of helmet 200. The second end of first mounting section 211, e.g., the back end (not shown) may reach or substantially reach the edge of back end 282 of helmet 200. In some embodiments, the size and length of second mounting section 212 may conform to the size of the helmet it is located on, such that the ends of second mounting section 212 may reach or substantially reach the edges of the helmet it is located on, e.g., helmet 200, for the purpose of enabling good attachment of second mounting section 212 and its respective fastenable connectors, e.g., clips 203 and 204 (FIG. 2B). For example, first end 294 of second mounting section 212 may reach or substantially reach the edge of first side portion 284 of helmet 200. Similarly, the second end of second mounting section 212 (not shown) may reach or substantially reach the edge of its respective side portion of helmet 100, which is typically located opposite first side portion 284. Accordingly, it may be clear that any mounting section that is part of a mounting unit may have a size and shape that conforms to the size and shape of the helmet it is intended to be located on.

In some embodiments, first mounting section 211 and second mounting unit 212 may be located perpendicularly or substantially perpendicularly to one another, such to create an angle β of 90° or substantially 90° between each other. In other embodiments, the angle β between the first mounting section 211 and the second mounting section 212 may be any angle in the range of 0° to 180°. Typically, a 90° angle between the first mounting section 211 and the second mounting section 212 may provide improved strength to helmet 200 in case the majority of compression forces applied onto helmet 200 are in the front-to-back direction or side-to-side direction (e.g., sides that are perpendicular to the front-to-back direction), since by creating a 90 degrees angle between the first mounting section 211 and the second mounting section 212, helmet 200 is strengthened along the two perpendicular axes of helmet 200 that external forces may be applied from. For example, the first mounting section 211 may be located along the front-to-back ends while and the second mounting section 212 may be located along the sides of helmet 200, which are perpendicular to the front-to-back ends. Such an arrangement of the first mounting section 211 being located perpendicularly with respect to the second mounting section 212 provides improved outside-inside compression resistance to helmet 200, since this arrangement may provide suitable opposing forces to external forces applied from directions parallel to the location of the mounting sections along helmet 200.

In some embodiments, each of first mounting section 211 and second mounting section 212 may comprise at least one rail, grip or connector configured for connecting at least one helmet accessory to the first or second mounting sections. A plurality of helmet accessories may be connected to mounting unit 201, via rails, grips or connectors located on first mounting section 211 and second mounting section 212. Thus, contrary to current helmet assemblies that are restricted to carrying predetermined helmet accessories at predetermined locations along the helmet, mounting unit 201 may be configured to carry substantially any helmet accessory at various locations along mounting unit 201.

In other embodiments, only one of first mounting section 211 and second mounting section 212 may comprise at least one rail, grip or connector configured for connecting at least one helmet accessory or at least one helmet accessory adaptor to the respective mounting section. For example, the first mounting section 211 may comprise at least one rail, grip or connector, while second mounting section 212 does not comprise any rails, grips or connectors (or vice versa). Although second mounting section 212 does not comprise any connecting means, it is required to be part of the helmet mounting assembly 210, in order to provide stability to the first mounting section 211 and thus to provide stability to helmet mounting assembly 210 with respect to helmet 200.

In some embodiments, at least one of first mounting section 211 and second mounting section 212 may comprise at least one rail, grip or connector configured for connecting at least one helmet accessory or helmet accessory adaptor to its respective mounting section.

Reference is now made to FIG. 2B, which schematically illustrates a helmet mounting assembly, in accordance with an embodiment of the present invention. Helmet mounting unit 201 may comprise a first mounting section 211 and a second mounting section 212, which may be positioned one across the other. In order to avoid use of fastenable connectors that penetrate the helmet, while attaching mounting unit 201 to helmet 200, and thus to prevent presence of weak areas along helmet 200, and thus to avoid possible damage to the helmet and its stability, mounting unit 201 may be attached to helmet 200 via non-penetrating fastenable means, e.g., clips. In some embodiments, mounting unit 201 may be connected to helmet 200 via at least one clip. In other embodiments, mounting unit 201 may be attached to helmet 200 using four clips, whereby each of the four clips may be located at and configured to attach one of the four ends of mounting unit 201. For example, clips 203, 204, 205 and 206 may be configured to attach mounting unit 201 to helmet 200. Clips 203 and 204 may be configured to attach the ends of mounting unit 201 that correspond to the ends of first mounting section 211, while clips 205 and 206 are configured to attach the ends of mounting unit 201 that correspond to the ends of second mounting section 212.

According to some embodiments, the non-penetrating fastenable connectors that are configured to connect the mounting unit 201 to helmet 200, may be positioned over mounting unit 201 on one side and over helmet 200 on the opposite internal side of helmet 200, such to fasten mounting unit 201 to helmet 200. In some embodiments, the fastenable connectors, e.g. clips may be further fastened onto mounting unit 201 in order to provide a secure connection between mounting unit 201 and helmet 200. For example, clips 203, 204, 205 and 206 may be further connected to mounting unit 201 via screws, e.g., screws 208 and corresponding nuts, e.g., nuts 207. For example, clip 203 may be fastened to one end of first mounting section 211 of mounting unit 201 via screw 208, which may be screwed against corresponding nut 207, which may be pre-positioned and fixed within the internal side of first mounting section 211. Similarly, clip 204 may be fastened to first mounting section 211 via corresponding screw 208 and nut 207, while clips 205 and 206 may be fastened to second mounting section 212 via corresponding screws 208 and nuts 207. Once mounting unit 201 is attached to helmet 200, a complete helmet assembly 210 is created, which is configured to enable connection to various helmet accessories.

Reference is now made to FIG. 2C, which schematically illustrates a mounting unit comprising a first mounting section and a second mounting section, in accordance with an embodiment of the present invention. According to embodiments of the invention, mounting unit 201 may comprise a first mounting section 211 and a second mounting section 212, which may be coupled to one another such that first mounting section 211 and second mounting section 212 are inseparable. In some embodiments, first mounting section 211 may comprise at least one rail, grip or connector configured for connecting at least one helmet accessory to the mounting unit 201. Similarly, second mounting section 212 may comprise at least one rail, grip or connector configured for connecting at least one helmet accessory or at least one helmet accessory adaptor to the mounting unit 201. However, in some embodiments, only one of first mounting section 211 and second mounting section 212 may comprise at least one rail, grip or connector configured for connecting at least one helmet accessory or at least one helmet accessory adaptor to the mounting unit 201, while the other mounting section need not comprise any rails, grips or connectors but is required in order to provide stability to the mounting unit 201 with respect to helmet 200.

For example, first mounting unit 211 may comprise rails, such as rails 221 and 227. Rail 221 may be configured for connecting a camera while rail 227 may be configured for connecting batteries for night vision goggles, though any other helmet accessories (or helmet accessories' adaptor) may be connected to either of rails 221 and 227. First mounting section may further comprise connectors, such as connector 228. For example, connector 228 may be configures for connecting a night Vision goggle device or a night vision goggle adaptor, though any other helmet accessory may be connected via connector 228.

Second mounting section 212 may also comprise rails and grips, such as rails 232 and 234, and grip 236A and 236B. Various helmet accessories or helmet accessories' adaptors may be connected to either of the rails and grips.

Possible helmet accessories that may be connected to mounting unit 201 via first or second mounting sections 211 and 212, respectively, may be: night vision goggles, a battery(ies), a battery pack, an illumination source (e.g., a white light flashlight, or a tactical flashlight) a headphone or noise cancellation headphone, gas mask, camera, a face protector shield, a face goggle, a radio, radio microphone, antenna, GPS, ear protection shield, mobile phone connector, etc.

In some embodiments, the rails of mounting unit 201 may comprise a beveled edge in order to enable ease of insertion of a helmet accessory or helmet accessory adaptor into the rail. For example, rail 221 comprises beveled edge 222.

According to some embodiments, rails may comprise a rail conveyer in order to prevent movement of a helmet accessory or helmet accessory adaptor in a direction that is vertical to the direction of sliding of a helmet accessory or of a helmet accessory adaptor along the rail. For example, rail 234 may comprise rail conveyer 223.

According to some embodiments, rails may comprise at least one hole configured for connecting a helmet accessory or helmet accessory adaptor to mounting unit 201. In some embodiments, each or some of the holes, e.g., hole 238 may comprise two different sides; the first side of a hole, e.g., side 224 may comprise an indent that is adapted to placing and locking a helmet accessory or helmet accessory adaptor within rail 232, while another side 225 of hole 238 may comprise a beveled and lowered edge compared to the surface of the mounting unit 201, in order to enable smooth exit of an adaptor for helmet accessories.

In some embodiments, grips may comprise holes in order to provide additional connecting means to helmet accessories that may comprise respective protrusions that would be inserted into the holes of the grip. For example, grip 236A may comprise holes 226, which may be configured for connecting a headphone locking mechanism.

In some embodiments, first mounting section 211 may comprise grip 261, which may be configured to have attached thereon a gripper, e.g., gripper 262. Gripper 262 may either be part of a helmet accessory adaptor or may be an integral part of a helmet accessory, such to attach the helmet accessory directly onto the mounting unit 201, without the need for an interconnection via an adaptor. Since various helmet accessories are manufactured with one end in the shape of a gripper, e.g., gripper 262, grip 261 may enable direct attachment of a helmet accessory to the mounting unit 201.

As illustrated in FIG. 2C, second mounting section 212 may comprise a rail located between two grips, e.g., rail 232 may be positioned in between grips 236A and 236B. Some helmet accessory adaptors, e.g., adaptor 263, may be configured to be placed along rail 232 while being secured on both of the adaptor's sides by the two opposing grips. For example, grip 236A may prevent movement of adaptor 263 towards the upper side of mounting unit 201, while grip 236B may prevent movement of adaptor 263 towards the bottom side of mounting unit 201, while the holes 238 in rail 232 may prevent adaptor 263 to slide off rail 232 in the direction opposite the direction of application or insertion of adaptor 263 onto rail 232.

In some embodiments, each rail, connector or grip may have any dimension that may be predesigned according to a specific helmet accessory or helmet accessory adaptor that is to be attached onto the respective connecting means, whether it is a rail, grip or connector. Any grip, connector or rail may have dimensions that may be different from the dimensions of any other connecting means of the same or of a different mounting section. That is, the shape and dimensions of any rail, grip or connector may be independent to the shape and dimensions of any other connecting means.

In some embodiments, in order to better fasten the mounting unit 201 to helmet 200, the fastenable connectors may be fastened to mounting unit 201 via fastening mean, such as crews, bolts, rivets, and other fastening means that penetrate through fastenable connectors and through the mounting unit 201, though not through helmet 200. For example, section 230 of mounting unit 201 may be an area of connection between mounting unit 201 and the fastenable connector, e.g., a clip. Section 230 may comprise a hole through which a fastening mean, e.g., a screw (for example screw 208, FIG. 2B) may be inserted through the external side of the clip and through the external side of mounting unit 201 such to affix the clip to mounting unit 201. In some embodiments, a corresponding nut may be located at and fixed to the internal side of mounting unit 201, e.g., at hole 231. The nut, e.g., nut 207 (FIG. 2B) may be pre-positioned within the internal side of mounting unit 201, within a hole or indent that has the same shape as the nut. Screws 208 may be configured to be screwed only into mounting unit 201, without penetrating through helmet 200. In some embodiments, the shape of the indent into which the nut is affixed may be of the same shape as that of the nut. For example, the indent in hole 231 may have the shape of a hexagon, since the shape of the nut, e.g., nut 207 is of a hexagon as well. In other embodiments, the nut, e.g., nut 207 may have any other shape, and thus the corresponding indent in hole 231 may have the same shape as that of the nut, in order to provide a good fit for the nut.

FIG. 2D schematically illustrates a bottom view of the mounting unit, in accordance with an embodiment of the invention. For example, holes 238 of rail 232 may be apparent, as well as all other holes of the other rails of mounting unit 201.

According to some embodiments, mounting unit 201 may be made of any one of: thermoplastic polymers, thermoset polymers, elastomers, or any combination thereof.

According to some embodiments, mounting unit 201 may be made of any one of the following materials: Nylon, Polyamide (PA, Nylon 6/6, Nylon 6, PA-12), Carbon Fiber, Polyetheretherketone (PEEK), Polyetheretherketone (PEEK), Polyetherketoneketone (PEKK), co-polyester, Polyoxymethylene (POM), Polyethylenimine (PEI), Polycarbonate, Acrylonitrile butadiene styrene (ABS), Polylactic acid (PLA), Poly(methyl methacrylate) (PMMA), PEI (Ultem®), Santoprene®, Polypropylene (PP), Polyurethane (PUR), Poly-Vinyl-Chloride (PVC), Polystyrene (PS), Polyphenylene Sulfide (PPS), Polycarbonate (PC), Polyethylene (PE), PBT (polybutylene terephthalate), PPSU (Radel®), Epoxy, graphite, PETG, Polyethylene Teraphthalate (PET), Polysulphone (PSU), PBT (Valox®), PARA (IXEF®), PAI (Torlon®), Polyethersulphone (PES), PET-P (Ertalyte®), ASA (acrylonitrile styrene acrylate), Polyimides, Urethane elastomere (TPE-U), mica, PPE, UP, PS, PBT, SMA, Wollastonite, or any combination thereof. In other embodiments, other polymers and/or any other combinations may be used.

Reference is now made to FIG. 3, which schematically illustrates a helmet mounting assembly, in accordance with an embodiment of the present invention. In some embodiments, instead of painting onto a helmet with certain colors or patterns, and/or instead of applying the helmet with a flame-retard ant material, and or applying other protecting materials, the helmet may be reconstructed such to comprise a helmet shell 302 and a helmet cover 301, which when attached together create a helmet assembly 320. Helmet shell 302 may comprise the hard materials that the helmet is made of and which provide the helmet's strength. In some embodiments, the helmet shell 302 may have attached chin straps that are configured to stabilize and position the helmet on the head of a user. The helmet cover 301 may be a substantially thin material in the exact shape of the helmet shell 302, and which is configured to fit the helmet shell 302 substantially precisely. The helmet cover 301 may comprise a color or pattern of choice, as well as protecting materials that may be more easily applied onto the helmet cover 301 than onto an entire helmet assembly. In some embodiments, helmet cover 301 may further comprise a mounting unit 310, which may be manufactured as one item with cover 301. If manufactured as one item, the helmet cover 301 along with the mounting unit 310 provides great stability for holding the mounting unit 310 while avoiding the need for fastening means that penetrate through the helmet shell 302.

According to some embodiments, mounting unit 310 (and thus, first mounting section 311 and second mounting section 312) may be made of any one of thermoplastic polymers, thermoset polymers, and elastomers, or any combination thereof.

According to some embodiments, mounting unit 310 (and thus, first mounting section 311 and second mounting section 312) may be made of any one of the following materials: Nylon, Polyamide (PA, Nylon 6/6, Nylon 6, PA-12), Carbon Fiber, Polyetheretherketone (PEEK), Polyetheretherketone (PEEK), Polyetherketoneketone (PEKK), co-polyester, Polyoxymethylene (POM), Polyethylenimine (PEI), Polycarbonate, Acrylonitrile butadiene styrene (ABS), Polylactic acid (PLA), Poly(methyl methacrylate) (PMMA), PEI (Ultem®), Santoprene®, Polypropylene (PP), Polyurethane (PUR), Poly-Vinyl-Chloride (PVC), Polystyrene (PS), Polyphenylene Sulfide (PPS), Polycarbonate (PC), Polyethylene (PE), PBT (polybutylene terephthalate), PPSU (Radel®), Epoxy, graphite, PETG, Polyethylene Teraphthalate (PET), Polysulphone (PSU), PBT (Valox®), PARA (IXEF®), PAI (Torlon®), Polyethersulphone (PES), PET-P (Ertalyte®), ASA (acrylonitrile styrene acrylate)-Polyimides, Urethane elastomere (TPE-U), mica, PPE, UP, PS, PBT, SMA, Wollastonite, or any combination thereof. In other embodiments, other polymers and/or any other combinations may be used. Mounting unit 310, which may be an integral part of helmet cover 301, may comprise two sections—a first mounting section 311 and a second mounting section 312, which may be positioned one across the other.

In some embodiments, first mounting section 311 may be positioned along the convex surface of helmet cover 301 such that a first end of first mounting section 311 may be positioned at the front end of helmet cover 301, e.g., above the face of user when wearing helmet assembly 320, while a second end of first mounting section 311 that is located opposite the first end of first mounting section 311, may be positioned at the back end of helmet cover 301, e.g., above the back of a user when wearing the helmet assembly 320.

In some embodiments, second mounting section 312 may be positioned along the convex surface of helmet cover 301 such that a first end of second mounting section 312 may be positioned at a first side portion of helmet cover 301, the first side portion located along the lower edge of helmet cover 301 and substantially adjacent to a first ear of the user when wearing helmet assembly 320, while the second opposite end of second mounting section 312 may be positioned at a second side portion of helmet cover 301 opposite the first side portion, the second side portion located along the lower edge of helmet cover 301 and substantially adjacent to the second ear of the user when wearing helmet assembly 320.

In some embodiments, first mounting section 311 and second mounting section 312 may have a shape that conforms to the shape of the helmet cover they are located on, such to create a good fit between the helmet cover, e.g., helmet cover 301 and each of the first mounting section 311 and the second mounting section 312. In addition, the size and length of first mounting section 311 and the size and length of second mounting section 312 may conform to the size of the helmet cover (and of the helmet shell) it is located on, such that the ends of first mounting section 311 and the ends of second mounting section 312 may reach or substantially reach the corresponding edges of the helmet cover and the respective helmet shell that the first and second mounting sections are located on, e.g., helmet cover 301 and respective helmet shell 302. This is for the purpose of enabling good attachment between first mounting section 311 and its respective fastenable connectors, e.g., clips 303 and 304, and between second mounting section 312 and its respective fastenable connectors, e.g., clips 305 and 306.

In some embodiments, the angle σ between the first mounting section 311 and the second mounting section 312 may be any angle between 0 to 180 degrees. In some embodiments, the angle θ may be of 90 degrees, such that first mounting section 311 is positioned perpendicularly to second mounting section 312. In some embodiments, the angle θ is approximately 90 degrees, such/that the second mounting section 312 is positioned substantially perpendicularly to the first mounting section 311.

In some embodiments, helmet cover 301 may be attached onto helmet shell 302 via attachment means that may penetrate through the helmet shell 302, e.g., bolts, rivets, screws, and so on. In other embodiments, since drilling a hole through the helmet or helmet shell 302 might cause the helmet shell 302 to be more exposed to damage e.g., to the possibility of breaking, at least around the areas of the drilled holes, helmet cover 301 that comprises or that is coupled with the mounting unit 310, typically as an integral part of helmet cover 301, may be attached onto helmet shell 302 via fastenable connectors that avoid penetration through the helmet shell 302. For example, fastenable connectors that do not penetrate through the helmet shell 302 may be clips. In some embodiments, at least one clip is required in order to fasten the helmet cover 301 to helmet shell 302. In other embodiments, four clips are required in order to provide a stable attachment of the helmet cover 301 to helmet shell 302. For example, clips 303, 304, 305, and 306 may attach each of the four ends of mounting unit 310, which are already a part of cover 301, to helmet shell 302.

In some embodiments, clip 303 may be used to attach helmet cover 301 to helmet shell 302 by connecting one end of first mounting section 311 to helmet shell 302. For example, clip 303 may be used to connect between an end of first mounting section 311 that may be located above the face of the wearer of helmet assembly 320. Clip 304 may be used to attach the helmet cover 301 to helmet shell 302 via the back end of first mounting section 312, which may be located above the back of the wearer of helmet assembly 320. Clips 305 and 306 may be used to attach the helmet cover 301 to helmet shell 302 via the second mounting section 312. Clips 305 and 306 may be located on opposite sides of second mounting section 312. For example, clip 305 may be located above the left ear of the wearer or user of helmet assembly 320, while clip 306 may be located above the right ear of the user of helmet assembly 320, or vice versa. Other locations of clips 305 and 306 may be implemented, according to the location of the second mounting section 312 along the external convex surface of helmet cover 301.

In some embodiments, in order to ensure the fastenable connectors, e.g., the clips, are tightly and securely connected to helmet cover 301 and to helmet shell 302, the clips may be fastened to helmet cover 301 via fastening means. For example, clips 303, 304, 305 and 306 may be fastened to helmet cover 301 via screws and nuts, e.g., screws 308 and nuts 307. The nuts, e.g., nuts 307 may be pre-attached to the internal side of helmet cover 301 such that screws 308 may be tightly screwed against the nuts, from the external side of helmet cover 301. Screws 308 may be configured to be screwed only into first and second mounting sections 311 and 312, respectively, without penetrating through helmet shell 302.

In some embodiments, the fastening means may include other means, such as bolts, rivets, glue, and any other fastening means that may penetrate through the helmet cover 301 and through the mounting unit 310.

In some embodiments, at least one of first mounting section 311 and second mounting section 312 may comprise at least one rail, grip or connector configured for connecting at least one helmet accessory or helmet accessory adaptor to the respective first mounting section 311 or second mounting section 312. Although in some cases one of the first and second mounting section 311, and 312, respectively, does not comprise any means for connecting helmet accessories or helmet accessory adaptors, it is an essential part of helmet mounting unit 310, since it provides stability to helmet cover 310 and thus to the entire mounting unit 310 with respect to helmet assembly 320.

Reference is now made to FIG. 4, which schematically illustrates an assembly of a helmet mounting unit and a helmet, in accordance with another embodiment of the present invention. In some embodiments, helmet 401 may have attached a first mounting unit 411 and a second mounting unit 412, which may be located one across the other. Once attached, the helmet 401 and the first mounting unit 411 and the second mounting unit 412 may comprise a helmet assembly 420.

The difference between the helmet assembly 420 and the helmet assembly 110 of FIG. 1B, is that helmet 401 comprises ear protection 410. Neither helmet assembly 110 nor helmet 100 (FIG. 1B) comprise a portion that covers the ears of the user of helmet assembly 110. However, helmet 401 comprises an additional section that is configured to cover the ears of the helmet wearer, and thus to provide protection to the ears of the wearer of helmet assembly 420. All other components of helmet assembly 420, as well as the location of first mounting unit 411 and second mounting unit 412 along helmet 401 may be similar to those of helmet assembly 110, However, the shape, size and lengths of first mounting unit 411 and second mounting unit 412 should be adjusted per the size and shape of helmet 401, which comprises ear protection 410. For example, second mounting unit 412 should be long enough (typically longer than mounting units that are to be located on a helmet that does not include ear protection sections) such that the ends of second mounting unit 412 may reach or substantially reach the edges of ear protection 410, which may be an integral part of helmet 401, for the purpose of enabling good attachment between second mounting unit 412 and its respective fastenable connectors, e.g., clips 405 and 406. Specifically, the attachment between helmet 401 and the first mounting unit 411 and the second mounting unit 412 may be achieved using fastenable connectors that avoid penetration into helmet 401. For example, the fastenable connectors may be clips. First mounting unit 411 and second mounting unit 412 may be attached to helmet 401 via at least one clip, though in other embodiments, four clips may be used to attach the first and second mounting units 411, and 412, respectively, to the helmet 401. For example, clips 403, 404, 405 and 406 may be configured to attach between first and second mounting units 411 and 412, respectively, and helmet 401. In some embodiments, the second mounting unit 412 may be attached to first mounting unit 411 and only then both mounting units are attached to helmet 401 via clips. However, in other embodiments, the first mounting unit 411 is first attached to helmet 401 via clips, e.g., clips 403 and 404, and then second mounting unit 412 is attached to helmet 401 via clips, e.g., clips 405 and 406.

In some embodiments, the fasteable connectors, e.g., the clips may be configured to fit onto both the helmet 401 and onto the ends of first mounting unit 411 and second mounting unit 412. However, in other embodiments, the fastenable connectors, e.g., the clips may be further secured to the first and second mounting units 411 and 412, respectively, such to ensure tight and safe attachment between helmet 401 and first mounting unit 411 and second mounting unit 412. The fastenable connectors may be secured to first and second mounting connectors via fastening means, e.g., fastening means that may penetrate through the first mounting unit 411 and the second mounting unit 412. For example, clips 403, 404, 405 and 406 may be fixedly attached to first mounting unit 411 and to second mounting unit 412 via screws and nuts, e.g., screws 408 and corresponding nuts 407. As described above in detail, nuts, e.g., nuts 407 may be pre-positioned and fixed to an internal side of each of the ends of the first and second mounting units 411 and 412, respectively, while the screws, e.g., screws 408 may be screwed into the external side of the first mounting unit 411 and the second mounting unit 412, and through the pre-positioned nuts, e.g., nuts 407. Screws 408 may be configured to be screwed only into first and second mounting units 411 and 412, respectively, without penetrating through helmet 401.

In some embodiments, the second mounting unit 412 may be attached to the first mounting unit 411 and then the two mounting units are attached onto the helmet 401 via fastenable connecters (and the fastenable connectors may further be secured to the fastening units via fastening means). However, in other embodiments, the first mounting unit 411 may be attached to the helmet 401 via fastenable connectors, and then the second mounting unit 412 may be attached onto the first mounting unit to the helmet 401, via fastenable connectors e.g., clips. In some embodiments, the fastenable connectors may further be secured to the fastening means after the fastenable connectors are positioned in place such to create attachment between the first and second mounting units 411, and 412, and helmet 401. The fastenable connectors may be secured to first mounting unit 411 and second mounting unit 412 via fastening means, e.g. via screws and corresponding nuts.

According to some embodiment, first mounting unit 411 and/or second mounting unit 412 may be made of any one of thermoplastic polymers, thermoset polymers, and elastomers, or any combination thereof.

According to some embodiment, first mounting unit 411 and/or second mounting unit 412 may be made of any one of the following materials: Nylon, Polyamide (PA, Nylon 6/6, Nylon 6, PA-12), Carbon Fiber, Polyetheretherketone (PEEK), Polyetheretherketone (PEEK), Polyetherketoneketone (PEKK), co-polyester, Polyoxymethylene (POM), Polyethylenimine (PEI), Polycarbonate, Acrylonitrile butadiene styrene (ABS), Polylactic acid (PLA), Poly(methyl methacrylate) (PMMA), PEI (Ultem®), Santoprene®, Polypropylene (PP), Polyurethane (PUR), Poly-Vinyl-Chloride (PVC), Polystyrene (PS), Polyphenylene Sulfide (PPS), Polycarbonate (PC), Polyethylene (PE), PBT (polybutylene terephthalate), PPSU (Radel®), Epoxy, graphite, PETG, Polyethylene Teraphthalate (PET), Polysulphone (PSU), PBT (Valox®), PARA (IXEF®), PAI (Torlon®), Polyethersulphone (PES), PET-P (Ertalyte®), ASA (acrylonitrile styrene acrylate), Polyimides, Urethane elastomere (TPE-U), mica, PPE, UP, PS, PBT, SMA, Wollastonite, or any combination thereof. In other embodiments, other polymers and/or any other combinations may be used.

Reference is now made to. FIGS. 5A-5B, which schematically illustrate a front-side-view and a back-side view, respectively, of helmet mounting units attached onto a helmet via fastening means that penetrate through the helmet, in accordance with embodiments of the present invention. Although, as explained above, it is more beneficial to avoid penetration through the helmet, in order to avoid presence of weak areas along the helmet, in some embodiments, the mounting unit(s) may be attached to the helmet via penetrating means, e.g. screws, bolts, rivets, or any other fastening means that penetrate through the helmet. For example, helmet 501 may have attached a first mounting unit 511 and a second mounting unit 512. The first mounting unit 511 and the second mounting unit 512 may be attached onto helmet 501 via fastening means that penetrate through helmet 501. For example, first mounting unit 511 may be attached to helmet 501 via penetrating fastening mean 503 (FIG. 5A) and via penetrating fastening mean 504 (FIG. 5B). In some embodiment, fastening mean 503 that may penetrate through helmet 501 may be located at the front end of first mounting unit 511, which may be the end of first mounting unit 511 that is to be located above the face of the user when wearing helmet assembly 520, whereas fastening mean 504 that may penetrate through helmet 501 may be located at the back end of first mounting unit 511, which may be the end of first mounting unit 511 that is to be located above the back of the user when wearing helmet assembly 520.

Second mounting unit 512 may be attached to helmet 501 via penetrating fastening means 505 and via an additional penetrating fastening means located opposite fastening means 505 (not shown). In some embodiment, fastening mean 505 that may penetrate through helmet 501 may be located at a first end of second mounting unit 512, which may be the end of second mounting unit 512 that is to be located above a first side portion of the user of helmet assembly 520, e.g., adjacent to (and above) the user's left ear, whereas the additional fastening mean (not shown) that may penetrate through helmet 501 may be located at a second opposite end of second mounting unit 512, which may be the end of second mounting unit 512 that is to be located above a second side portion of the user of helmet assembly 520, e.g., adjacent to (and above) the user's right ear.

According to some embodiment, first mounting unit 511 and/or second mounting unit 512 may be made of any one of thermoplastic polymers, thermoset polymers, and elastomers, or any combination thereof.

According to some embodiment, first mounting unit 511 and/or second mounting unit 512 may be made of any one of the following materials: Nylon, Polyamide (PA, Nylon 6/6, Nylon 6, PA-12), Carbon Fiber, Polyetheretherketone 1 (PEEK), Polyetheretherketone (PEEK), Polyetherketoneketone (PEKK), co-polyester, Polyoxymethylene (POM), Polyethylenimine (PEI), Polycarbonate, Acrylonitrile butadiene styrene (ABS), Polylactic acid (PLA), Poly(methyl methacrylate) (PMMA), PEI (Ultem®), Santoprene®, Polypropylene (PP), Polyurethane (PUR), Poly-Vinyl-Chloride (PVC), Polystyrene (PS), Polyphenylene Sulfide (PPS), Polycarbonate (PC), Polyethylene (PE), PBT (polybutylene terephthalate), PPSU (Radel®), Epoxy, graphite, PETG, Polyethylene Teraphthalate (PET), Polysulphone (PSU), PBT (Valox®), PARA (IXEF®), PAI (Torlon®), Polyethersulphone (PES), PET-P (Ertalyte®), ASA (acrylonitrile styrene acrylate), Polyimides, Urethane elastomere (TPE-U), mica, PPE, UP, PS, PBT, SMA, Wollastonite, or any combination thereof. In other embodiments, other polymers and/or any other combinations may be used. Reference is now made to FIG. 6A-6B, which schematically illustrate back-side-views of helmet mounting units with different types of rails, in accordance with embodiments of the present invention. According to some embodiments, helmet mounting units may differ from one another by the number of rails, and/or the number of connectors, and/or the number of grippers that they comprise, by the location of each of the rails, and/or connectors, and/or the grippers along the mounting unit, and by the type of rails and connectors that each mounting unit comprises. According to FIG. 6A, a helmet assembly may comprise a helmet mounting unit 620 that is attached onto helmet 601. The mounting unit 620 may comprise a first mounting section or unit 611 and a second mounting section or unit 612. The first mounting unit 611 and the second mounting unit 612 that are positioned one across the other, may compose one integral unit, or they may be attached and fitted one over the other without initially being coupled to one another. According to FIG. 6B, a helmet 601 may have attached a mounting unit 630. Mounting unit 630 may comprise a first mounting section 621 and a second mounting section 622, which may be positioned one across the other. According to some embodiments, the first mounting unit or section 621 and the second mounting unit or section 622 may compose one integral unit, or second mounting unit 622 may be a separate unit from first mounting unit 621 and may be fitted and attached to first mounting unit 621, in order to create helmet mounting unit 630. The main difference between helmet mounting unit or assembly 620 to helmet mounting unit or assembly 630 is the number of holes that appear in the rails of each mounting unit. For example, the number of holes in the rails of second mounting unit 612 may be three holes 615, whereas the number of holes in the rails of second mounting unit 622 may be four holes 616, and further while the number of holes in the rails of first mounting unit 611 and of first mounting unit 621 may be two holes. Any other number of holes along the different rails may be implemented.

Any mounting unit may comprise rails of a certain width and thus of a certain number of holes, independently from its respective mounting unit of the same mounting assembly. In addition, in some embodiments, some of the rails may comprise a number of holes (and thus be of a certain width) which is different than the number of holes of other rails of the same mounting unit.

The number of holes, e.g., holes 615 or holes 616 may enable selection of where to locate a helmet accessory that is to be attached onto a rail. That is, the more holes a rail comprises, the more options there are to select a location of where to connect a helmet accessory. For example, a user of a helmet assembly may decide whether he would like to locate and attach a helmet accessory closer to the front end of the helmet, e.g., closer to the user's face, or father away from the user's face and towards the back of the user's head. The user may further select whether to place a helmet accessory towards the center of the helmet or whether towards either of the side portions of the helmet (e.g., adjacent the helmet user's ears). In the helmet mounting assembly 630, since the rails of second mounting unit or section 622 comprises four holes, as compared to only three holes in the rails of second mounting unit 612 of mounting assembly 620, a user may have more options on possible locations for helmet accessories in mounting assembly 630 compared to mounting assembly 620.

Furthermore, in some cases, helmet accessories might have different widths, and thus might require rails of different widths in order to properly and securely connect such accessories. Therefore, different helmets may comprise rails of different widths (and thus different numbers of holes) in order to accommodate various types and widths of helmet accessories or helmet accessory adaptors.

According to some embodiment, first mounting unit 611 and/or second mounting unit 612 may be made of any one of thermoplastic polymers, thermoset polymers, and elastomers, or any combination thereof.

According to some embodiment, first mounting unit 611 and/or second mounting unit 612 may be made of any one of the following materials: Nylon, Polyamide (PA, Nylon 6/6, Nylon 6, PA-12), Carbon Fiber, Polyetheretherketone (PEEK), Polyetheretherketone (PEEK), Polyetherketoneketone (PEKK), co-polyester, Polyoxymethylene (POM), Polyethylenimine (PEI), Polycarbonate, Acrylonitrile butadiene styrene (ABS), Polylactic acid (PLA), Poly(methyl methacrylate) (PMMA), PEI (Ultem®), Santoprene®, Polypropylene (PP), Polyurethane (PUR), Poly-Vinyl-Chloride (PVC), Polystyrene (PS), Polyphenylene Sulfide (PPS), Polycarbonate (PC), Polyethylene (PE), PBT (polybutylene terephthalate), PPSU (Radel®), Epoxy, graphite, PETG, Polyethylene Teraphthalate (PET), Polysulphone (PSU), PBT (Valox®), PARA (IXEF®), PAI (Torlon®), Polyethersulphone (PES), PET-P (Ertalyte®), ASA (acrylonitrile styrene acrylate), Polyimides, Urethane elastomere (TPE-U), mica, PPE, UP, PS, PBT, SMA, Wollastonite, or any combination thereof. In other embodiments, other polymers and/or any other combinations may be used.

Reference is now made to FIGS. 7A-7D, which schematically illustrate a helmet mounting assembly 700 comprising chin straps attached to fastenable connectors of the assembly, in accordance with an embodiment of the present invention. FIG. 7A schematically illustrates helmet 701 that has attached a first mounting unit 711 and a second mounting unit (not shown). According to some embodiment, first mounting unit 711 and/or the second mounting unit 712 (FIG. 7C), which may be positioned across the first mounting unit 711, may be made of any one of: thermoplastic polymers, thermoset polymers and elastomers, or any combination thereof. In some embodiments, first mounting unit 711 and second mounting unit 712 may be made of any one of the following materials: Nylon, Polyamide (PA, Nylon 6/6, Nylon 6, PA-12), Carbon Fiber, Polyetheretherketone (PEEK), Polyetheretherketone (PEEK), Polyetherketoneketone (PEKK), co-polyester, Polyoxymethylene (POM), Polyethylenimine (PEI), Polycarbonate, Acrylonitrile butadiene styrene (ABS), Polylactic acid (PLA), Poly(methyl methacrylate) (PMMA), PEI (Ultem®), Santoprene®, Polypropylene (PP), Polyurethane (PUR), Poly-Vinyl-Chloride (PVC), Polystyrene (PS), Polyphenylene Sulfide (PPS), Polycarbonate (PC), Polyethylene (PE), PBT (polybutylene terephthalate), PPSU (Radel®), Epoxy, graphite, PETG, Polyethylene Teraphthalate (PET), Polysulphone (PSU), PBT (Valox®), PARA (IXEF®), PAI (Torlon®), Polyethersulphone (PES), PET-P (Ertalyte®), ASA (acrylonitrile styrene acrylate), Polyimides, Urethane elastomere (TPE-U), mica, PPE, UP, PS, PBT, SMA, Wollastonite, or any combination thereof. In other embodiments, other polymers and/or any other combinations may be used.

First mounting unit 711 may be positioned across the second mounting unit (not shown). The first and second mounting units may be attached to helmet 701 via fastenable connectors that do not penetrate through helmet 701, e.g., clips 703, 704, 705 and 706. In other embodiments, other numbers of clips may be implemented. In some embodiments, clips 703 and 704 may be configured to attach first mounting unit 711 to helmet 701. In some embodiments, clip 703 may attach first mounting unit 711 to helmet 701 at the front end of first mounting unit 711, where a face of a user of helmet 701 is to be placed when wearing helmet 701. In some embodiments, clip 704 may attach the first mounting unit 711 to helmet 701 at the back end of first mounting unit 711, where the back of a user of helmet 701 is to be positioned, or vice versa.

As illustrated in FIG. 7A and in FIG. 7B, fastenable connector, e.g., clip 704 may comprise an extension 714, which may be of the same contour as the edge of helmet 701 where extension 714 is located, e.g., contour of extension 714 may be similar to the contour of the internal side of the edge of the back end of helmet 701. In some embodiments, extension 714 may cover the entire internal side of the edge of the back end of helmet 701. In some embodiments, extension 714 may be manufactured as one unit along with clip 704, though in other embodiments, extension 714 may be tightly connected to clip 704. Extension 714 may comprise at least one fastening means that may secure at least one strap to clip 704 via extension 714. For example, extension 714 may have attached two fastening means, 722 and 724, which may be in the form of bolts, screws, rivets, glue, or any more sophisticated connector, for connecting straps 732 and 734, respectively, to clip 704 via extension 714, without penetrating through helmet 701. Straps 732 and 734 may be chin straps configured to fasten helmet 701 over the chin of the helmet wearer or user, in some embodiments, straps 732 and 734 may be chin straps and/or liner straps, configured to attach a liner to the internal side of helmet 701.

In addition, fastenable connectors, e.g., clips 705 and 706 may be configured to attach a second mounting unit 712 to helmet 701. For example, clip 705 may be configured to attach the second mounting unit to helmet 701 on a first side portion of helmet 701 located along the lower edge of helmet 701 and substantially adjacent to an ear of the user when wearing helmet 701, while clip 706 may be configured to attach the second mounting unit to helmet 701 on the second opposite side portion of helmet 701 located along the lower edge of helmet 701 and substantially adjacent to an opposite ear of the user when wearing helmet 701. In other embodiments, clips 705 and 706 may attach the second mounting unit to helmet 701 at other locations with respect to the head of the helmet user.

In some embodiments, first mounting unit 711 and second mounting unit 712 may have a shape that conforms to the shape of the helmet they are located on, such to create a good fit between the helmet, e.g., helmet 701 and each of the first mounting unit 711 and the second mounting unit 712. In addition, the size and length of first mounting unit 711 and the size and length of second mounting unit 712 may conform to the size of the helmet it is located on, such that the ends of first mounting unit 711 and the ends of second mounting unit 712 may reach or substantially reach the corresponding edges of the helmet that the first and second mounting units are located on, e.g., helmet 701. This is for the purpose of enabling good attachment between first mounting unit 711 and its respective fastenable connectors, e.g., clips 703 and 704, and between second mounting unit 712 and its respective fastenable connectors, e.g., clips 705 and 706.

As illustrated in detail in FIGS. 7C-7D, clip 705 may comprise an extension 715, which may be of the same contour as that of the edge of helmet 701 where extension 715 is located, e.g., at the internal side of the edge of helmet 701 that is located above the left ear of the helmet user. In some embodiments, extension 715 may cover the entire internal side of the edge of helmet 701 that is located above the left ear of the helmet user. In some embodiments, extension 715 may be an integral part of clip 705, e.g., clip 705 and extension 715 may be manufactured as one item, though in other embodiments, extension 715 may be firmly attached to clip 705. Extension 715 may comprise at least one fastening means that may secure at least one chin strap to clip 705 via extension 715. For example, extension 715 may comprise fastening means, e.g., bolts, glue or screws 725 in order to connect chin strap 735 to clip 705 via extension 715, without penetrating through helmet 701. Chin strap 735 may be a strap configured to fasten helmet 701 over the chin of the helmet wearer or user. In some embodiments, chin strap 735 may comprise a liner strap configured to attach a liner to the internal side of helmet 701.

Similarly, clip 706 may comprise an extension (not shown) as the extension of clip 705. The extension of clip 706 may be of the same contour as that of the edge where the extension of clip 706 is located. The extension of clip 706 may be an integral part of clip 706, e.g., clip 706 and its extension may be manufactured as one item, though in other cases, the extension of clip 706 may be connected to clip 706, while not being an integral part of clip 706. The extension of clip 706 may comprise at least one fastening means that may secure at least one chin strap to clip 706 via its extension. For example, the extension of clip 706 may comprise fastening means, e.g., bolts, glue or screws 726, in order to connect chin strap 736 to clip 706 via its extension, without penetrating through helmet 701. Chin strap 736 may be a strap configured to fasten helmet 701 over the chin of the helmet wearer or user. In some embodiments, chin strap 736 may comprise a liner strap configured to attach a liner to the internal side of helmet 701.

According to FIGS. 7A-7D, the chin straps 732, 734, 735 and 736 are attached to helmet 701 via fastenable means that do not penetrate through helmet 701, e.g., via clips 703, 704, 705 and 706, respectively. The chin straps are attached to helmet 701 via clips, and although the chin straps are attached to the clips via means that penetrate through each clip, since the clips are attached to helmet 701 while avoiding penetration through helmet 701, the chin straps are attached such to avoid causing any damage to helmet 701, e.g., by drilling a hole/holes through helmet 701 and thus to create weak areas around such holes, which are more sensitive to damage.

In some embodiments, in addition to chin straps, a liner may also be attached to the inner upper side of helmet 701 via non-penetrating fastenable means, e.g., clips 703, 704, 705 and 706. In other embodiments, a liner may be attached to the upper inner side of helmet 701 via other non-penetrating means, e.g., glue.

Reference is now made to FIGS. 7E-7G, which schematically illustrate an upper-view, front-view and side-view, respectively, of a fastenable connector configured to attach a first mounting unit to a helmet and configured to comprise chin straps and/or a liner, in accordance with an embodiment of the present invention. Fastenable connector 704, which may be a clip or any other connector that does not penetrate through the helmet 701, may comprise an extension 714. Fastenable connector 704 may be configures to attach a first mounting unit, e.g., first mounting unit 711 (FIG. 7A) to helmet 701. As described above, extension 714 may be an integral part of fastenable connector 704, e.g., extension 714 and fastenable connector 704 may be manufactured as one item, although, in some embodiments, extension 714 and fastenable connector 704 may be firmly attached to one another, though may not be one product.

According to some embodiments, extension 714 may comprise at least one hole through which a chin strap may be connected to fastenable connector 704 and thus to helmet 701. For example, extension 714 may comprise holes 722*h* and 723*h*, which may be holes through which fastening means may be inserted in order to attach a chin strap to fastenable connector 704 via extension 714. The fastening means that may be used in order to attach a chin strap to extension 714 may be bolts, rivets, screws, etc. In other embodiments, extension 714 need no holes, and a chin strap or chin straps may be attached to extension 714 via glue, or other non-penetrating fastening means that do not penetrate through helmet 701.

In some embodiments, the curve of extension 714 may conform to the internal curve of the edge of helmet 701 above which extension 714 is attached. Extension 714 may be located at the back end of helmet 701, above the location of the back or neck of the wearer or user of helmet 701.

Reference is now made to FIGS. 7H-7J, which schematically illustrate an upper-view, front-view and side-view, respectively, of a fastenable connector configured to attach a second mounting unit to a helmet and configured to comprise chin straps and/or a liner, in accordance with an embodiment of the present invention. Fastenable connector 705, which may be a clip or any other connector that does not penetrate through the helmet 701, may comprise an extension 715. Fastenable connector 705 may be configures to attach a second mounting unit, e.g., a mounting unit located across mounting unit 711 (FIG. 7A) to helmet 701. As described above, extension 715 may be an integral part of fastenable connector 705, e.g., extension 715 and fastenable connector 705 may be manufactured as one item, although, in some embodiments, extension 715 and fastenable connector 705 may be firmly attached to one another, though may not be one product.

According to some embodiments, extension 715 may comprise at least one hole through which a chin strap and/or a liner may be connected to fastenable connector 705 and thus to helmet 701. For example, extension 715 may comprise hole 725*h*, which may be a hole through which fastening means may be inserted in order to attach a chin strap and/or a liner to fastenable connector 705 via extension 715. The fastening means that may be used in order to attach a chin strap and/or a liner to extension 715 may be bolts, rivets, screws, etc. in other embodiments, extension 715 need no holes, and a chin strap or straps and/or a liner may be attached to extension 715 via glue, or other non-penetrating fastening means that do not penetrate through helmet 701.

In some embodiments, the curve of extension 715 may conform to the internal curve of the edge of helmet 701, above which extension 715 is located. Extension 715 may be located at the internal side of a side portion of helmet 701, for example, above one of the ears of the wearer of helmet 701.

Similarly, helmet 701 may comprise a fastenable connector 706, which may be identical or substantially similar to fastenable connector 705. Thus, fastenable connector 706 may comprise an extension and holes as described with respect to fastenable connector 705.

Reference is now made to FIGS. 8A-8D, which schematically illustrate a helmet mounting assembly 800 comprising straps, e.g., chin straps attached to fastenable connectors of the assembly, in accordance with another embodiment of the present invention. As described with respect to FIGS. 7A-7D, helmet mounting assemblies 700 may comprise fastenable connects in order to securely attach the mounting units onto the helmet. In some cases, the fastenable connectors may comprise straps, e.g., chin straps that may be used for fastening the helmet onto the user's head, and over his chin. In some embodiments, the fastenable connectors may comprise a liner that is configured to act as a shock absorber. FIGS. 7A-7D illustrate one embodiment of fastenable connectors that comprise chin straps, while FIGS. 8A-8D illustrate another embodiment of fastenable connectors comprising chin straps. The difference between the fastenable connectors illustrated in FIGS. 7A-7D and the one illustrated by FIGS. 8A-8D is that the fastenable connectors in FIGS. 7A-7D comprise straps attached to three different fastenable connectors, while FIGS. 8A-8D illustrate straps attached to only two fastenable connectors (i.e., fastenable connectors 803 and 804, as will be detailed hereinbelow).

Helmet mounting assembly 800 may comprise two mounting unit 811 and 812 (FIGS. 8C-8D), which may be positioned one across the other. In some embodiments, first mounting unit 811 may be positioned substantially perpendicularly to second mounting unit 812. In some embodiments, first mounting unit 811 and second mounting unit 812 may form one integral part, e.g., these two mounting units may be manufactured as one item.

In some embodiments, first mounting unit 811 may be configured to be attached to helmet 801 via fastenable connectors, e.g., clips 803 and 804. In some embodiments, each of clips 803 and 804 may be connected to first mounting unit 811 at either of its ends. In some embodiments, first mounting unit 811 may be positioned along the convex surface of helmet 801 such that its first end and thus clip 803 may be located at the front end of helmet 801, e.g., adjacent to the location of the face of a user of helmet 801 when wearing helmet 801. The second and opposite end of first mounting unit 811 and thus clip 804 may be located opposite to clip 803 at the back end of helmet 801, e.g., above the back of the user when wearing helmet 801.

In some embodiments, second mounting unit 812 may be attached to helmet 801 via fastenable connectors, e.g., clips 805 and 806. Clip 805 may be configured to attach a first end of second mounting unit 812 to helmet 801, while clip 806 may be configured to attach a second end that is opposite the first end of second mounting unit 812. In some embodiments, second mounting unit 812 may be positioned along the convex surface of helmet 801 such that the first end of second mounting unit 812 may be located at one side portion of helmet 801, e.g., along the lower edge of helmet 801 and substantially adjacent an ear of a user when wearing helmet 801, while the opposite end of second mounting unit 812 may be located at an opposite side portion of helmet 801, e.g., along the lower edge of helmet 801 and substantially adjacent the opposite ear of a user or wearer of helmet 801.

In some embodiments, first mounting unit 811 and second mounting unit 812 may have a shape that conforms to the shape of the helmet they are located on, such to create a good fit between the helmet, e.g., helmet 801 and each of the first mounting unit 811 and the second mounting unit 812. In addition, the size and length of first mounting unit 811 and the size and length of second mounting unit 812 may conform to the size of the helmet it is located on, such that the ends of first mounting unit 811 and the ends of second mounting unit 812 may reach or substantially reach the corresponding edges of the helmet that the first and second mounting units are located on, e.g., helmet 801. This is for the purpose of enabling good attachment between first mounting unit 811 and its respective fastenable connectors, e.g., clips 803 and 804, and between second mounting unit 812 and its respective fastenable connectors, e.g., clips 805 and 806.

In some embodiments, the fastenable connectors that attach first mounting unit 811 to helmet 801 may comprise extensions configured to have attached thereon at least one chin strap. In some embodiments, fastenable connector (e.g., clip) 803 may comprise extension 813. Extension 813 may be an integral part of clip 803, e.g., extension 813 and clip 803 may be manufactured as one item. However, in other embodiments, extension 813 may be firmly attached to clip 803 such to form one unit. Extension 813 may have the same contour and the same curve as that of the internal side of the edge of helmet 801, above which extension 813 is located.

According to some embodiments, extension 813 may comprise at least one strap, e.g., straps 832 and 833, which may be connected to extension 813 at both ends or approximately at both ends of extension 813, via fastening means 822 and 823. Typically, straps 832 and 833 are symmetrically located along extension 813, e.g., such that the distance of each of the straps 832 and 833 from the middle of extension 813 and of the middle of clip 803 is identical. In other embodiments, the location of straps 832 and 833 with respect to extension 813 need not be symmetrical. Fastening means 822 and 823 may be any fastening means, e.g., screws, bolts, rivets, glue, etc. Straps 832 and 833 may be chin straps configured to fasten helmet 801 over the head of the helmet's user or wearer. In some embodiments, straps 832 and 833 may be chin straps which may include liner straps configured to attach a liner to the internal side of helmet 801.

Similarly, fastenable connector (e.g., clip) 804 may comprise extension 814. Extension 814 may be an integral part of clip 804, e.g., extension 814 and clip 804 may be manufactured as one item. However, in other embodiments, extension 814 may be firmly connected to clip 804 such to form one unit. Extension 814 may have the same contour and the same curve as that of the internal side of the edge of helmet 801, above which extension 814 is located.

According to some embodiments, extension 814 may comprise at least one chin strap, e.g., chin straps 834 and 835, which may be connected to extension 814 at both ends or approximately at both ends of extension 814, via fastening means 824 and 825. Fastening means 824 and 825 may be any fastening means, e.g., screws, bolts, rivets, glue, etc. Chin straps 834 and 835 may be straps configured to fasten helmet 801 over the head of the helmet's user or wearer. In some embodiments, the location of chin straps 834 and 835 with respect to extension 814 is symmetrical, e.g., that the distance of chin strap 834 from the middle of extension 814 (or from the middle of clip 804) is identical to the distance of chin strap 835 from the middle of extension 814 (or the middle of clip 804). In other embodiments, the location of chin straps 834 and 835 need not be symmetrical with respect to extension 814 and/or clip 804.

In some embodiments, according to FIGS. 8A-8D, the chin straps 832, 833, 834 and 835 are attached to helmet 801 via fastenable means that do not penetrate through helmet 801, e.g., via clips 803, 804, 805 and 806, respectively. The chin straps are attached to helmet 801 via clips, and although the chin straps are attached to the clips via means that penetrate through each clip, since the clips are attached to helmet 801 while avoiding penetration through helmet 801, the chin straps are attached such to avoid causing any damage to helmet 801, e.g., by drilling a hole/holes through helmet 801 and thus to create weak areas around such holes, which are more sensitive to damage.

In some embodiments, a liner, e.g., liner 840 (FIGS. 8A-8B) may be attached to the inner upper side of helmet 801 via non-penetrating fastenable means, e.g., clips 803, 804, 805 and 806. In other embodiments, a liner may be attached to the inner upper side of helmet 801 via other non-penetrating means, e.g., glue.

In order to fasten and secure helmet 801 over a head of a user, chin straps 832, 833, 834 and 835 may all be configured to be connected to one another over the chin of the helmet user. In other embodiments, straps 832, 833, 834 and 835 may be configured to be connected in pairs over the chin of the helmet user, e.g., chin straps 832 and 833 may be tied together over the chin of the user, while chin straps 834 and 835 may be separately tied to one another, over the chin of the user, thus securing helmet 801 to the head of the user.

According to some embodiments, first mounting unit 811 and/or second mounting unit 812 may be made of any of thermoplastic polymers, thermoset polymers and elastomers, or any combination thereof.

According to some embodiments, first mounting unit 811 and/or second mounting unit 812 may be made of any of the following materials: Nylon, Polyamide (PA, Nylon 6/6, Nylon 6, PA-12), Carbon Fiber, Polyetheretherketone (PEEK), Polyetheretherketone (PEEK), Polyetherketoneketone (PEKK), co-polyester, Polyoxymethylene (POM), Polyethylenimine (PEI), Polycarbonate, Acrylonitrile butadiene styrene (ABS), Polylactic acid (PLA), Poly(methyl methacrylate) (PMMA), PEI (Ultem®), Santoprene®, Polypropylene (PP), Polyurethane (PUR), Poly-Vinyl-Chloride (PVC), Polystyrene (PS), Polyphenylene Sulfide (PPS), Polycarbonate (PC), Polyethylene (PE), PBT (polybutylene terephthalate), PPSU (Radel®), Epoxy, graphite, PETG, Polyethylene Teraphthalate (PET), Polysulphone (PSU), PBT (Valox®), PARA (IXEF®), PAI (Torlon®), Polyethersulphone (PES), PET-P (Ertalyte®), ASA (acrylonitrile styrene acrylate), Polyimides, Urethane elastomere (TPE-U), mica, PPE, UP, PS, PBT, SMA, Wollastonite, or any combination thereof. In other embodiments, other polymers and/or any other combinations may be used.

Reference is now made to FIGS. 9A-9C, which schematically illustrate a top-view, front-side-view and bottom-side-view respectively, of a helmet assembly comprising straps, e.g., chin straps and/or liner attached to fastenable connectors of the assembly, in accordance with an embodiment of the present invention. Helmet assembly 900 may comprise fastenable connectors configured to comprise chin straps attached thereon, while not comprising mounting units. Instead of mounting units, the fastenable connectors, e.g., clips 903, 904, 905 and 906 may be connected to helmet 901 via first and second belts or bands 911 and 912, respectively, which may be stretched over the outer side of helmet 901. First belt 911 may typically be positioned across and second belt 912. For example, bands 911 and 912 may be positioned along helmet 901 such band 911 meets band 912 at approximately the center 902 of helmet 901. Belts 911 and 912 may be made of elastic or non-elastic material such to properly attach the fastenable connectors with the chin straps to helmet 901, by acquiring the external convex shape of helmet 901.

In some embodiments, bands 911 and 912 may either be flexible or rigid to some extent. Bands or belts 911 and 912 may be made of textile type material, or polymeric material, e.g., thermoplastic polymers, thermoset polymers, and elastomers, or any combination thereof.

In some embodiments, one end of band 911 may be connected to fastenable connector (e.g., clip) 903, while the other end of band 911 may be connected to fastenable connector (e.g., clip) 906. Thus, fastenable connector 903 may be located across fastenable connector 906. In some embodiments, one end of band 912 may be connected to fastenable connector (e.g., clip) 904, while the other end of band 912 may be connected to fastenable connector (e.g., clip) 905. Thus, in some embodiments, fastenable connector 904 may be located across fastenable connector 905, while fastenable connector 903 and fastenable connector 904 may be located at the front end 980 of helmet 901 (the front end of helmet 901 may be adjacent to the face of the user when wearing helmet 901), and fastenable connector 905 along with fastenable connector 906 may be located at the back end 982 of helmet 901 (the back end of helmet 901 may be adjacent to the back of the user when wearing helmet 901). According to some embodiments, first belt 911 may be located across second belt 912. According to some embodiments, the angle between first band 911 and second hand 912 may be any angle between 0 degrees to 180 degrees.

The purpose of fastenable connectors 903, 904, 905 and 906 is to attach chin straps to helmet 901 without penetrating through helmet 901, e.g., by drilling holes through helmet 901 in order to accomplish such attachment. Thus, the strength of helmet 901 would not be compromised or weakened. As illustrated in FIG. 9B, fastenable connector 905 may be connected to fastenable connector 906 via a common extension 916. Extension 916 as well as fastenable connectors 905 and 906 may be manufactured as one unit, though in other embodiments, extension 916 and fastenable connectors 905 and 906 may be firmly coupled to one another while not being one integral component. In some embodiments, on each of the two farthest ends of extension 916 (though any other location is possible, whether or not symmetrically located with respect to the middle of extension 916), a chin strap may be attached to extension 916. For example, chin strap 935 may be connected to extension 916 via fastening means 925, and chin strap 936 may be attached to extensions 16 via fastening means 926. Fastening means 926 and 925 may be any one of screws, bolts, nails, rivets, glue, or any combination thereof. Extension 916 may have a contour and curve that is configured to match the contour and curve of the internal side of the edge of helmet 901, above which extension 916 is to be located.

As illustrated in FIG. 9C, fastenable connector 903 and fastenable connector 904 may be connected to a mutual extension 914. Extension 914 may comprise a curve and contour that is to conform with the curve and contour of the edge of helmet 901, where extension 914 is to be located. Extension 914 as well as fastenable connectors 903 and 904 may form one integral item, e.g., extension 914, fastenable connector 903 and fastenable connector 904 may be manufactured as a single item, though in other cases, the extension 914, fastenable connector 903 and fastenable connector 904 may be firmly attached to one another without being one component.

In some embodiments, a chin strap 933 may be attached to extension 914 via fastening means 923, and a chin strap 934 may be attached to extension 914 via fastening means 924. The location of chin straps 933 and 934 may be symmetrical with respect to the middle of extension 914. However, in other embodiments, the location of chin strap 933 need not be symmetrical to the location of chin strap 934. In some embodiments, chin straps 933 and 934 may be located on the farthest of substantially farthest ends of extension 914, though any other location is possible. The fastening means that may securely attach chin straps 933 and 934 to extension 914 may be any one of screws, bolts, nails, rivets, glue, or any combination thereof.

In some embodiments, a liner, e.g., liner 940 (FIG. 9C) may be attached to the inner upper side of helmet 901 via non-penetrating fastenable means, e.g., clips 903, 904, 905 and 906. The liner, e.g., liner 940 may act as a shock absorber thus protecting the helmet wearer. In other embodiments, a liner, e.g., liner 940, may be attached to the inner upper side of helmet 901 via other non-penetrating means, e.g., glue.

According to some embodiments, helmet assembly 900 may be connected to any of the mounting unit(s) disclosed hereinabove, e.g., first and second mounting units 101 and 102, mounting unit 201, first and second mounting unit 311 and 312, first and second mounting units 411 and 412, first and second mounting units 511 and 512, first and second mounting units 611 and 612, mounting unit 711, or first and second mounting units 811 and 812.

FIGS. 9D-9E schematically illustrate a front-view and side-view of a fastenable connector configured to attach chin straps and/or liner to a helmet, in accordance with an embodiment of the present invention. As illustrated in FIGS. 9D-9E, fastenable connector 903 and fastenable connector 904 may be connected to one another via a common extension unit 914. The shape of extension unit 914 may conform to the shape of the inner side of helmet 901, such that extension unit 914 has the same curve as the curve of the internal side of helmet 901. Accordingly, the fastenable connectors connected to extension unit 914 may have a curved shape such to conform to the curved shape of the external and internal sides of helmet 901, where such fastenable connectors would be attached to helmet 901.

In some embodiments, fastenable connector 903 may comprise a hole 943, and fastenable connector 904 may comprise a hole 944. Hole 943 may be configured to accept a connecting means (e.g., a screw, bolt or rivet) for connecting belt or band 911 to fastenable connector 903, while hole 944 may be configured to accept a connecting means for connecting band 912 to fastenable connector 904.

In some embodiments, extension unit 914 may comprise holes 923*s* and 924*s*, which may be configured to accept fastening means 923 and 924, respectively, in order to attach chin straps and/or liner to helmet 901 via extension unit 914. That is, chin strap 933 may be fastened to extension unit 914 via fastening means 923 inserted through hole 923*s*, and chin strap 934 may be fastened to extension unit 914 via fastening means 924 inserted through hole 924*s*. Thus, although chin straps 933 and 934 are fastened to extension unit 914 via fastening means that penetrate through extension unit 914 (i.e., via holes 923*s*, 924*s*), chin straps 933 and 934 do not penetrate through helmet 901, since extension unit 914 is attached to helmet 901 in a non-penetrating manner, therefore avoiding creation of weak areas along helmet 901 that might cause helmet 901 to be more exposed to damage (if helmet 901 was penetrated through). In some embodiments, a liner, e.g., liner 940 (FIG. 9C) may be attached to helmet 901 while not penetrating through helmet 901, e.g., via fastenable connectors 903 and 904. In some embodiments, a liner may be fastened to extension unit 914 (and thus to helmet 901) using fastening means that may be configured to pass through holes 923*s* and 924*s*. In other embodiments, a liner may be attached to the internal side of helmet 901 via means that do not involve fastenable connector 903 nor fastenable connector 904, e.g., by using glue.

It should be clear that the fastenable connectors 903 and 904 being connected to an extension unit 914 as illustrated by FIGS. 9D-9E may apply to fastenable connector 905 and to fastenable connector 906, both of which may be connected to an extension unit that is similar to extension unit 914. All other features described above with respect to fastenable connectors 903 and 904 and per extension unit 914 may further apply to fastenable connectors 905 and 906.

Reference is now made to FIGS. 10A-10C, which schematically illustrate upper-side view, side view, and back view, respectively, of a fastenable connector configured to attach a mounting unit (or section) to a helmet, in accordance with an embodiment of the present invention. Fastenable connector 1010 may be configured to be positioned at the front side of a helmet, for example, at a side that is to be located above a face of a helmet user, and/or at the back side of a helmet, for example, at a side that is to be located above a back of a helmet user. In some embodiments, fastenable connector 1010 may be located at a front and/or back side of a helmet cover (e.g., helmet cover 301, FIG. 3).

Fastenable connector 1010 may be configured to attach to a helmet at least one mounting unit comprising at least one rail, grip or connector configured for connecting at least one helmet accessory to the at least one mounting unit. Fastenable connector 1010 may be configured to attach to a helmet at least one mounting unit, while avoiding penetration through the helmet.

In some embodiments, fastenable connector 1010 may be configured to attach the edge of at least one mounting unit with the edge of a helmet.

In some embodiments, fastenable connector 1010 may comprise an extension to which at least one chin strap (configured to be tied around the chin of a helmet user, and thus to fasten the helmet onto the user's head) and/or liner (configured to serve as a shock absorber) may be attached. For example, extension 714 of fastenable connector 704 (FIG. 7E) or extension 914 of fastenable connector 903 and 904 (FIG. 9E).

In some embodiments, fastenable connector 1010 may be attached onto a helmet via at least one belt stretched over the outer side of the helmet, as illustrated, for example, by FIG. 9A. In some embodiments, the at least one belt comprises a first belt and a second belt, whereby the first belt may be located across the second belt. In some embodiments, the first belt may be positioned across the second belt at an angle between 0° and 180°. In some embodiments, the at least one belt may be made of a material selected from: thermoplastic polymer, thermoset polymer, textile, elastomer, or any combination thereof.

In some embodiments, fastenable connector 1010 may be a clip.

As illustrated in FIG. 10A, fastenable connector 1010 may comprise a hole 1012 through which a screw may be inserted in order to attach at least one mounting unit to fastenable connector 1010, and then by positioning fastenable connector 1010 onto the edge of a helmet, the at least one of a mounting unit may be connected to the helmet in a non-penetrating manner. The screw to be inserted through hole 1012 may be, for example, either of screws 109 (FIG. 1B), 208 (FIG. 2B), 308 (FIG. 3), or 408 (FIG. 4), or any other screw. Fastenable connector 1010 may comprise a curved end 1014, which may conform to the curve of the edge of a helmet where fastenable connector 1010 may be positioned.

As illustrated in FIG. 10B, fastenable connector 1010 may comprise a space 1016 located between end 1010A and end 1010B of fastenable connector 1010. The edge of a helmet may be inserted into space 1016 such to be located between the two ends of fastenable connector 1010; end 1010A and end 1010B.

In some embodiments, fastenable connector 1010 may further comprise a protrusion 1018 that may be configured to create a substantially common surface with at least one mounting unit, which may be attached to fastenable connector 1010 via fastening means, e.g., a screw that is inserted through hole 1012. That is, since fastenable connector 1010 is to first be attached to at least one mounting unit, and since the at least one mounting unit comprises a certain width, in order for the configuration of fastenable connector 1010 coupled with the at least one mounting unit to be tightly attached onto a helmet with no redundant space, once the at least one mounting unit is coupled with fastenable connector 1010, they should create one substantially common surface.

According to FIG. 10C, the edge 1013 of end 1010B may be of a straight or substantially straight shape, as may the edge of end 1010A be. In other embodiments, either of ends 1010A and 1010B may either have a curved shape or a substantially straight shape, as long as the shape of these ends conforms to the shape of the edge of the helmet onto which fastenable connector 1010 is attached.

Reference is now made to FIGS. 10D-10F, which schematically illustrate upper-side view, side view, and back view, respectively, of a fastenable connector configured to attach a mounting unit (or section) to a helmet, in accordance with another embodiment of the present invention. Fastenable connector 1020 may be configured to be positioned at one or more of the side portions of a helmet, for example, at a side that is to be located above one of the ears of a helmet user, though other locations are possible. In some embodiments, fastenable connector 1020 may be located at a side portion of a helmet cover (e.g., helmet cover 301, FIG. 3).

Fastenable connector 1020 may be configured to attach to a helmet at least one mounting unit comprising at least one rail, grip or connector configured for connecting at least one helmet accessory to the at least one mounting unit. Fastenable connector 1020 may be configured to attach at least one mounting unit, while avoiding penetration through the helmet.

In some embodiments, fastenable connector 1020 may be configured to attach the edge of at least one mounting unit with the edge of a helmet.

In some embodiments, fastenable connector 1020 may comprise an extension to which at least one chin strap and/or liner may be attached. For example, extension 714 of fastenable connector 704 (FIG. 7E) or extension 914 of fastenable connector 903 and 904 (FIG. 9E).

In some embodiments, fastenable connector 1020 may be attached onto a helmet via at least one belt stretched over the outer side of the helmet, as illustrated, for example, by FIG. 9A. In some embodiments, the at least one belt comprises a first belt and a second belt, whereby the first belt may be located across the second belt. In some embodiments, the first belt may be positioned across the second belt at an angle between 0° and 180°. In some embodiments, the at least one belt may be made of a material selected from; thermoplastic polymer, thermoset polymer, textile, elastomer, or any combination thereof.

In some embodiments, fastenable connector 1020 may be a clip.

As illustrated in FIG. 10D, fastenable connector 1020 may comprise a hole 1022 through which a screw may be inserted in order to attach a mounting unit to fastenable connector, and then by positioning fastenable connector 1020 onto the edge of a helmet, the mounting unit may be connected to the helmet on a non-penetrating manner. The screw to be inserted through hole 1022 may be, for example, either of screws 109 (FIG. 1B), 208 (FIG. 2B), 308 (FIG. 3), or 408 (FIG. 4), or any other screw. Fastenable connector 1020 may comprise a curved end 1024, which may conform to the curve of the edge of a helmet where fastenable connector 1020 may be positioned.

As illustrated in FIG. 10E, fastenable connector 1020 may comprise a space 1026 located between end 1020A and end 1020B of fastenable connector 1020. The edge of a helmet may be inserted into space 1026 such to be located between the two ends of fastenable connector 1020; end 1020A and end 1020B.

In some embodiments, fastenable connector 1020 may further comprise a protrusion 1028 that may be configured to create a substantially common surface with at least one mounting unit, which may be attached to fastenable connector 1020 via fastening means, e.g., a screw that is inserted through hole 1022. That is, since fastenable connector 1020 is to first be attached to at least one mounting unit, and since the at least one mounting unit comprises a certain width, in order for the configuration of fastenable connector 1020 coupled with the at least one mounting unit to be tightly attached onto a helmet with no redundant space, once the at least one mounting unit is coupled with fastenable connector 1020, they should create one substantially common surface.

According to FIG. 10F, end 1020A may be of a straight or substantially straight shape, while the edge 1023 of end 1020B may have a curved shape. The extent of curve 1023 of end 1020B may correspond with the curve of the edge of the helmet onto which fastenable connector 1020 may be attached. In other embodiments, either of ends 1020A and 1020B may either have a curved shape or a substantially straight shape, as long as the shape of these ends conforms to the shape of the edge of the helmet onto which fastenable connector 1020 is attached.

Reference is now made to FIGS. 10G-10I, which schematically illustrate upper-side view, side view, and back view, respectively, of a fastenable connector configured to attach at least one a mounting unit (or section) to a helmet, in accordance with yet another embodiment of the present invention. Fastenable connector 1030 may be configured to be positioned at one or more of the side portions of a helmet, for example, at a side that is to be located above one of the ears of a helmet user, though other locations are possible. In some embodiments, fastenable connector 1030 may be located at a side portion of a helmet cover (e.g., helmet cover 301, FIG. 3).

According to some embodiments, fastenable connector 1020 may be positioned at one side portion of a helmet (or helmet cover), while fastenable connector 1030 may be positioned at another, possibly opposite side portion of the same helmet.

Fastenable connector 1030 may be configured to attach to a helmet at least one mounting unit comprising at least one rail, grip or connector configured for connecting at least one helmet accessory to the at least one mounting unit. Fastenable connector 1030 may be configured to attach one or more mounting units (or sections), while avoiding penetration through the helmet.

In some embodiments, fastenable connector 1030 may be configured to attach the edge of at least one mounting unit with the edge of a helmet.

In some embodiments, fastenable connector 1030 may comprise an extension to which at least one chin strap and/or liner may be attached. For example, extension 714 of fastenable connector 704 (FIG. 7E) or extension 914 of fastenable connector 903 and 904 (FIG. 9E).

In some embodiments, fastenable connector 1030 may be attached onto a helmet via at least one belt stretched over the outer side of the helmet, as illustrated, for example, by FIG. 9A. In some embodiments, the at least one belt comprises a first belt and a second belt, whereby the first belt may be located across the second belt. In some embodiments, the first belt may be positioned across the second belt at an angle between 0° and 180°. In some embodiments, the at least one belt may be made of a material selected from: thermoplastic polymer, thermoset polymer, textile, elastomer, or any combination thereof.

In some embodiments, fastenable connector 1030 may be a clip.

As illustrated in FIG. 10G, fastenable connector 1030 may comprise a hole 1032 through which a screw may be inserted in order to attach at least one mounting unit to fastenable connector 1030, and then by positioning fastenable connector 1030 onto the edge of a helmet, the at least one of a mounting unit may be connected to the helmet in a non-penetrating manner. The screw to be inserted through hole 1032 may be, for example, either or screws 109 (FIG. 1B), 208 (FIG. 2B), 308 (FIG. 3), or 408 (FIG. 4), or any other screw. Fastenable connector 1030 may comprise a curved end 1034, which may conform to the curve of the edge of a helmet where fastenable connector 1030 may be positioned and attached.

As illustrated in FIG. 10H, fastenable connector 1030 may comprise a space 1036 located between end 1030A and end 1030B of fastenable connector 1030. The edge of a helmet may be inserted into space 1036 such to be located between the two ends of fastenable connector 1030; end 1030A and end 1030B.

In some embodiments, fastenable connector 1030 may further comprise a protrusion 1038 that may be configured to create a substantially common surface with at least one mounting unit, which may be attached to fastenable connector 1030 via fastening means, e.g., a screw that is inserted through hole 1032. That is, since fastenable connector 1030 is to first be attached to at least one a mounting unit, and since the at least one mounting unit comprises a certain width, in order for the configuration of fastenable connector 1030 coupled with the at least one mounting unit to be tightly attached onto a helmet with no redundant space, once the at least one mounting unit is coupled with fastenable connector 1030, they should create one substantially common surface.

According to FIG. 10I, edge 1033 of end 1030B may have a substantially straight shape, as may the edge of end 1030A have. In some embodiments, either or both of the edges of ends 1030A or 1030B may have a curved shape, such to conform to the shape of the edge of the helmet onto which fastenable connector 1030 may be attached. In other embodiments, either of ends 1030A and 1030B may either have a curved shape or a substantially straight shape, as long as the shape conforms to the shape of the edge of the helmet onto which fastenable connector 1030 is attached.

Reference is now made to FIG. 11, which schematically illustrates a helmet comprising a mounting assembly having attached thereon exemplary helmet accessories, in accordance with One embodiment of the present invention. According to some embodiments, helmet 1100 may comprise a helmet mounting assembly comprising a first mounting section 1101 and a second mounting section 1102, which may be positioned one across the other in order to provide, a stable structure with respect to possibly applied external compression forces. First and second mounting sections 1101 and 1102 may be coupled to one another such to conform one integral unit, or may be separate components attached such to create a full mounting assembly.

In some embodiments, first mounting section 1101 may have attached thereon night vision goggles 1106, which may be connected to first mounting section 1101 via connector 1116, and a battery pack 1106 that may be attached onto first mounting section 1101 via a respective connector.

In some embodiments, second mounting section 1102 may have attached thereon headphones 1107 that may be connected to second mounting section 1102 via adaptor 1117, which may be positioned onto a rail (not shown) that is located between two grips, e.g., grip 1127 and grip 1137. Second mounting section 1102 may further comprise a camera 1104 that may be connected to second mounting section 1102 via gripper 1114, which may be gripping a corresponding grip 1124 that may be an integral part of second mouthing section 1102. Second mounting section 1102 may further comprise a flashlight 1103 that may be attached onto second mounting section 1102 via a rail (not shown).

Other helmet accessories and helmet accessory adaptors may be attached onto first mounting section 1101 and second mounting section 1102, as illustrated by FIG. 12.

Reference is now made to FIG. 12, which schematically illustrates a helmet comprising a helmet mounting assembly having attached thereon exemplary helmet accessories, in accordance with another embodiment of the present invention. According to some embodiments, helmet 1200 may comprise a helmet mounting assembly comprising a first mounting section 1201 and a second mounting section 1202, which may be positioned one across the other in order to provide a stable structure with respect-to possibly applied external compression forces. First and second mounting sections 1201 and 1202 may be coupled to one another such to conform one integral unit, or may be separate components attached such to create a full mounting assembly.

In some embodiments, first mounting section 12101 may have attached thereon a camera 1204 that may be connected to second mounting section 1202 via gripper 1214, which may be gripping a corresponding grip 1224 that may be an integral part of second mouthing section 1202. In some embodiments, second mounting section 1202 may have attached thereon flashlight 1203 that may be attached to second mounting section 1202 via a corresponding rail (not shown). In addition, second mounting section 1202 may have attached thereon a gas mask 1210 that may comprise straps 1209 that may be connected to second mounting section 1202 via adaptor 1208, which may be positioned onto a rail (not shown) that is located between two grips, e.g., grip 1218 and grip 1228.

Reference is now made to FIG. 13, which schematically illustrates a helmet assembly comprising a helmet, a first mounting unit, and a second mounting unit, in accordance with an embodiment of the present invention. Helmet 1300 may be any kind of helmet used by military forces, civilians (e.g., athletes) or other non-civilians for any kind of activity. In some embodiments, helmet 1300 may have a round shape in order to conform to the shape of a head of a wearer of helmet 1300. In some embodiments, helmet 1300 be configured to cover the ears of the helmet wearer in order to protect them from being harmed. Thus, according to some embodiments, helmet 1300 may comprise ear protection sections 1320, on both opposite sides of helmet 1300 where the ears of the helmet wearer would be located, once the helmet wearer places helmet 1300 over his head and ears.

According to FIG. 13, helmet 1300 may have attached thereon a first mounting unit 1301. The first mounting unit 1301 may be attached onto helmet 1300 such that one end of first mounting unit 1301 reaches or approximately reaches one edge of helmet 1300, while the opposite end of the first mounting unit 1301 reaches or approximately reaches an opposite edge of helmet 1300. The first mounting unit 1301 may passe along the external convex surface of helmet 1300. In some embodiments, the first mounting unit 1301 may be aligned along helmet 1300 such to begin at the front end 1380 of helmet 1300 (e.g., at the end of helmet 1300 that would be located above the face of the person or user who is to wear helmet 1300) and reach the back end 1382 of helmet 1300 (e.g., at the end of helmet 1300 that would be located above the back of the head of the person or user who is to wear helmet 1300).

According to some embodiments, a second mounting unit 1302 may be positioned on top of first mounting unit 1301, such that second mounting unit 1302 is positioned across first mounting unit 1301. The second mounting unit 1302 may be firmly attached onto first mounting unit 1301 in order to ensure the first mounting unit 1301 and the second mounting unit 1302 are tightly attached onto helmet 1300 and would not be easily separated neither from one another nor from helmet 1300. Furthermore, the first mounting unit 1301 and the second mounting unit 1302 may provide extra rigidity and strength to helmet 1300 once attached onto helmet 1300.

In some embodiments, the second mounting unit 1302 may be aligned along the convex surface of helmet 1300 such to begin at a first side portion 1384 of helmet 1300 and reach a second opposite side portion of helmet 1300 located across first side portion 1384. The first side portion 1384 and the second side portion located opposite the first side portion 1384 may be located substantially adjacent to an ear of the user when wearing the helmet. That is, each of first side portion 1384 and the second side portion located opposite the first side portion 1384, may be located adjacent one of the two ear protection sections 1320.

In some embodiments, first mounting unit 1301 and second mounting unit 1302 may have a shape that conforms to the shape of the helmet they are located on, such to create a good fit between the helmet, e.g., helmet 1300 and each of the first mounting unit 1301 and the second mounting unit 1302. In addition, the size and length of first mounting unit 1301 may conform to the size of the helmet it is located on, such that the ends of first mounting unit 1301 may reach or substantially reach the edges of the helmet it is located on, e.g., helmet 1300, for the purpose of enabling good attachment of first mounting unit 1301 and its respective fastenable connectors, e.g., clips 1304 and 1305 (FIG. 13A). For example, a first end of first mounting unit 1301, e.g., front end 1390 may reach or substantially reach the edge of front end 1380 of helmet 1300. The second end of first mounting unit 1301, e.g., the back end (not shown) may reach or substantially reach the edge of back end 1382 Of helmet 1300. In some embodiments, the size and length of second mounting unit 1302 may conform to the size of the helmet it is located on, such that the ends of second mounting unit 1302 may reach or substantially reach the edges of the helmet it is located on, e.g., helmet 1300, for the purpose of enabling good attachment of second mounting unit 1302 and its respective fastenable connectors, e.g., clips 1306 and 1307 (FIG. 13A). For example, first end 1394 of second mounting unit 1302 may reach or substantially reach the edge of first side portion 1384 of helmet 1300. Similarly, the second end of second mounting unit 1302 (not shown) may reach or substantially reach the edge of its respective side portion of helmet 1300, which is typically located opposite first side portion 1384. Accordingly, it may be clear that any mounting unit may have a size and shape that conforms to the size and shape of the helmet it is intended to be located on.

In some embodiments, first mounting unit 1301 and second mounting unit 1302 may be located perpendicularly or substantially perpendicularly to one another, such to create a 90° angle $\epsilon$ or a substantially 90 degrees angle $\epsilon$ between each other. In other embodiments, the angle $\epsilon$ between the first mounting unit 1301 and the second mounting unit 1302 may be any angle in the range of 0° to 180°. Typically, a 90° angle between the first mounting unit 1301 and the second mounting unit 1302 may provide the ultimate strength to helmet 1300 if and when compression forces might be applied onto helmet 1300 on either of the first mounting unit 1301 or second mounting unit 1302. By creating a 90 degrees angle between the first mounting unit 1301 and the second mounting unit 1302 and by positioning at least one of the first mounting unit 1301 and the second mounting unit 1302 at the axis from which compression forces may be applied onto helmet 1300, helmet 1300 acquires great strength and stability against such applied forces. For example, if external compression forces are to be applied onto helmet 1300 in a direction that is towards the front end 1380 and towards the back end 1382 of helmet 1300, the first mounting unit 1301 may be located along the front-to-back ends of helmet 1300, while and the second mounting unit 1302 may be located along the sides of helmet 1300, e.g., on top the location of the ears of the helmet user, which are located perpendicularly or substantially perpendicularly to the front-to-back ends, in order to provide greater stability to first mounting unit 1301 against the externally applied forces. In case forces may be applied onto helmet 1300 from a direction different from front-to-back of helmet 1300, as long as at least one of the first mounting unit 1301 and the second mounting unit 1302 are located at the same direction from which the forces are applied onto helmet 1300, and as long as first mounting unit 1301 is located perpendicularly or substantially perpendicularly to second mounting unit 1302, helmet 1300 may improve its stability such to avoid its collapse due to externally applied compression forces.

Reference is now made to FIG. 13A, which schematically illustrates an exploded view of a helmet assembly, in accordance with an embodiment of the present invention. According to FIG. 13A, helmet 1300 may comprise a first mounting unit 1301 to be positioned on top of helmet 1300, and a second mounting unit 1302 to be located above the first mounting unit 1301. In some embodiments, the first mounting unit 1301 and the second mounting unit 1302 may be attached to helmet 1300 via at least one fastenable connector. For example, first mounting unit 1301 and second mounting unit 1302 may be attached to helmet 1300 via clips 1304, 1305, 1306 and 1307. In some embodiments, each of the ends of first mounting unit 1301 and second mounting unit 1302 may be connected to the circumference of helmet 1300 via one of clips 1304, 1305, 1306 and 1307. For example, one end of first mounting unit 1301 (e.g., an end located at the front end 1380 of helmet 1300, whereby the front end 1380 of helmet 1300 may be the end that is to be located adjacent to, e.g., above the face of the wearer or user of helmet 1300) may be attached to helmet 1300 via clip 1304, while the opposite end of first mounting unit 1301 (e.g., an end located at the back end 1382 of helmet 1300, whereby the back end 1382 is the end of helmet 1300 that is to be located adjacent to, e.g., above the back of the wearer or user of helmet 1300) may be connected to helmet 1300 via clip 1305. One end of second mounting unit 1302 (e.g., an end located on a first side portion 1384 of helmet 1300, for example, the first side portion 1384 of helmet 1300 may be located adjacent to the helmet user's right ear) may be attached to helmet 1300 via clip 1307, while the opposite end of second mounting unit 1302 (e.g., an end located on a second side portion opposite the first side portion of helmet 1300, for example, located adjacent to the left ear of the helmet user) may be connected to helmet 1300 via clip 1306.

In some embodiments, fastenable connectors, e.g., clips 1304, 1305, 1306 and 1307 may ensure tight attachment of first mounting unit 1301 and second mounting unit 1302 to helmet 1300, while avoiding the need to use fastening means that penetrate through the helmet. Thereby, non-penetrating fastenable connectors, e.g., clips 1304, 1305, 1306 and 1307 overcome the problem of weakening the helmet, which may occur when a hole is created through the helmet, e.g., by a drill.

In some embodiments, in order to secure the fastenable connectors, e.g., clips 1305, 1306 and 1307 to helmet 1300 such to ensure safe attachment of first mounting unit 1301 and second mounting unit 1302 to helmet 1300, the fastenable connectors, e.g., clips 1305, 1306 and 1307 may be attached to first mounting unit 1301 and to second mounting unit 1302 via fastening means, e.g., screws 1309. Screws 1309 may be configured to be screwed only into first and second mounting units 1301 and 1302, respectively, without penetrating through helmet 1300.

In some embodiments, the distance between the front edge 1390 of the first mounting unit 1301 and the front edge 1380 of helmet 1300 may be too short to allow the necessary surface for using screws; therefore front clip 1304 may be designed accordingly and may be securely attached to first mounting unit 1301 without any screws. According to some embodiments, the front edge 1390 of first mounting unit 1301 may comprise protrusions through which clip 1304 may be connected onto first mounting unit 1301, thereby attaching it to the front edge 1380 of helmet 1300. In some embodiments, front edge 1390 may comprise two protrusions 1318 on one side of edge 1390 and two additional protrusions 1318 on the opposite side of front edge 1390 of first mounting unit 1301. In some embodiments, protrusions 1318 may comprise a first upper protrusion 1318A, which may be located on the upper portion of either side of edge 1390 while being located adjacent to the end of edge 1390 that is more distant from helmet 1300 (once first mounting unit 1301 is to be placed onto helmet 1300), whereas a second lower protrusion 1318B may be located on the lower portion of either side of edge 1390 while being located adjacent to the end of edge 1390 that is closest to helmet 1300 (once first mounting unit 1301 is to be placed onto helmet 1300). Clip 1304 may comprise indents corresponding to upper and lower protrusions 1318A and 1318B, respectively. Specifically, clip 1304 may comprise upper indent 1319A, which may accommodate upper protrusion 1318A, as illustrated by arrow 1318C. Upper indent 1319A may attach onto upper protrusion 1318A such that protrusion 1318A may prevent clip 1304 from moving forward, e.g., farther away from helmet 1300. Clip 1304 may further comprise lower indent 1319B, which may accommodate lower protrusion 1318B, as illustrated by arrow 1318D. Lower indent 1319B may attach onto lower protrusion 131BB such that protrusion 1318B may prevent clip 1304 from moving backwards, e.g., towards helmet 1300.

Back clip 1305 may be attached to the first mounting unit 1301 via screw 1309, which may be screwed into a corresponding nut 1308 that may be pre-fitted into and pre-fixed to the first mounting unit 1301, from its internal side. In some embodiments, clip 1305 may be secured to first mounting unit 1301 via two screws 1309. Once each of the two screws 1309 is fastened through the external side of first mounting unit 1301 against corresponding nuts 1308, clip 1305 may be attached to the edge of first mounting unit 1301, which is located opposite to edge 1390. In other embodiments, a different number of screws 1309 may be implemented in order to secure clip 1305 to first mounting unit 1301.

Similarly, each of clips 1306 and 1307 may be attached to second mounting unit 1302 via screws 1309. In some embodiments, each of clips 1306 and 1307 may be secured to second mounting unit 1301 via two screws 1309. Each of the two screws 1309 may be screwed into a corresponding nut 1308 that may be pre-fitted into and pre-fixed to the second mounting unit 1302, from its internal side. Once each of the two screws 1309 is fastened through the external side of each of the edges of second mounting unit 1301, (i.e., edges 1384 and the edge opposite 1384), against corresponding nuts 1308, clip 1307 may be attached to edge 1384 of second mounting unit 1302, while clip 1307 may be attached to the edge opposite edge 1384 of second mounting unit 1302. In other embodiments, a different number of screws 1309 may be implemented in order to secure clips 1307 and 1306 to second mounting unit 1301.

In order to assemble the helmet assembly for attaching helmet accessories to helmet 1300, fastenable connector, e.g. clip 1304 may be fastened to the front edge 1390 of first mounting unit 1301 and may be positioned to grip the front edge 1380 of helmet 1300. That is, first mounting unit 1301 may be positioned over and attached to helmet 1300 via a non-penetrating fastenable connector, e.g., clip 1304.

In some embodiments, fastenable connector, e.g., clip 1305 may be fastened to the back edge of first mounting unit 1301 and may be positioned to grip the back edge 1382 of helmet 1300. In some embodiments, screws 1309 may be screwed into their corresponding nuts 1308, which may be pre-positioned within the internal side of first mounting unit 1301, in order to strengthen the attachment of first mounting unit 1301 to helmet 1300 via clip 1305. Following attachment of the first mounting unit 1301 to helmet 1300, the second mounting unit 1302 may be positioned on top of first mounting unit 1301 and may be attached to helmet 1300 via non-penetrating fastenable connectors, e.g., clips 1306 and 1307. In some embodiments, in order to strengthen the attachment of second mounting unit 1302 to helmet 1300, screws 1309 may be screwed into second mounting unit 1302 through their corresponding pre-positioned nuts 1308.

In some embodiments, as mentioned with respect to FIG. 13A, in order to strengthen the connection between the first mounting unit 1301 to the helmet 1300 via fastenable connectors that do not penetrate through the helmet, the fastenable connectors, e.g., clips, may be screwed or otherwise fastened to the first mounting unit 1301, though without penetration through helmet 1300. Holes 1303 may be holes through which a screw or any other fastening means may be inserted in order to fasten the fastenable connector, e.g., a clip to first mounting unit 1301, thus tightly fastening or attaching first mounting unit 1301 to the helmet 1300. In some embodiments, a screw or other fastening means may be inserted through hole 1303 from the external side of first mounting unit 1301, while a corresponding securing nut may be located at the internal side of first mounting unit 1301. In some embodiments, the corresponding nut may be located at and attached to a pre-assigned indent 1303A on the internal side of first mounting unit 1301, which may be of the same shape as that of the nut, in the example illustrated by FIG. 13A, indentation 1303A is in the shape of a hexagon such to fit a hexagon shape of a corresponding securing nut 1308, though any other shape may be implemented to indentation 1303A and to nut 1308, as long as their shapes correspond to one another. The nut 1308 may be reinforced and fixed into its respective indent 1303A, such that the corresponding screw 1309 may be safely screwed through hole 1303 while being stabilized by the fixed nut 1308. The curve of first mounting unit 1301 is configured to conform to the curve of the helmet it is intended to be attached to.

Similarly, in order to strengthen the connection between second mounting unit 1302 to helmet 1300 via fastenable connectors that do not penetrate through the helmet, the fastenable connectors, e.g., clips, 1306 and 1307 may be screwed or otherwise fastened to the second mounting unit 1301, though without penetration through helmet 1300. Nuts 1308 and screws 1309 may be implemented with respect to clips 1306 and 1307, similarly as they do with respect to clip 1305.

In other embodiments, fastenable connectors need not be attached to the mounting units via penetrating fastening means, but may rather be attached to the mounting units via glue or other non-penetrating fastening means. In which case, holes 1303 would not be present in neither first mounting unit 1301 nor second mounting unit 1302.

FIG. 13B schematically illustrates the helmet assembly 1310 as assembled onto helmet 1300. That is, FIG. 13B illustrates the positioning of first mounting unit 1301 and second mounting unit 1302 on helmet 1300. Reference is now made to FIG. 13C, which schematically illustrates a first mounting unit, in accordance with an embodiment of the invention. First mounting unit 1301 may comprise at least one rail, grip, at least one connector and at least one buckle mount configured for connecting at least one helmet accessory to the first mounting unit 1301. In other embodiments, first mounting unit 1301 may comprise at least one connector, with no additional adaptors, such as rails or grips. For example, first mounting unit 1301 may comprise at least one rail 1321, or any other rail that may be positioned as part of first mounting unit 1301. Rail 1321 may be configured to enable connection of a helmet accessory (e.g., a camera, an illumination source, a microphone, batteries or battery pack, etc.) to helmet 1300 via the rail, either directly or using an adaptor between the two sides of the rail and the helmet accessory. In some embodiments, instead of or in addition to at least one rail, first mounting unit 1301 may comprise at least one connector, e.g., connector 1327, which may be configured to enable connection of a helmet accessory, e.g., a night vision goggle, as illustrated in boxes 1327A-1327B of FIG. 13C. In some embodiments, the rails on the first mounting unit 1301, e.g., rail 1321 may comprise a beveled edge 1323. The beveled edge 1323 may enable an easy and smooth insertion of helmet accessories onto rail 1321.

In some embodiments, the rails of first mounting unit 1301 may be configured to comprise at least one hole, e.g., at least one of holes 1324, onto which a helmet accessory or helmet accessory adaptor may be connected. The number of holes along each rail may be changeable and may be predetermined according to the helmet accessory or helmet accessory adaptor that is to be connected to the first mounting unit 1301. In some embodiments, each or some of holes 1324 may comprise a break that locks the helmet assembly or helmet assembly adaptor within hole 1324. In other embodiments, hole 1324 does not comprise a break but rather has straight edges, which may enable quick insertion of a helmet accessory into rail 1321 as well as a quick release of a helmet accessory out of rail 1321.

In some embodiments, connectors of first mounting unit 1301, e.g., connector 1327, may comprise gripper 1328A and gripper 1328B that may hold the helmet accessory or helmet accessory adaptor in place, and may prevent the helmet accessory (or helmet accessory adaptor) to easily detach from the connectors, e.g., connector 1327, along a direction that is vertical with respect to the sliding motion of a helmet accessory or helmet accessory adaptor along the connectors 1328A and 1328B.

In some embodiments, gripper 1328A may comprise an indentation 1328A1 (see bottom view of gripper 1328A) and gripper 1328B may comprise an indentation 1328B1 (see upper view of gripper 1328B), which a suitable helmet accessory or suitable helmet accessory adaptor that comprise a respective protrusion, may be inserted into and secured within.

In some embodiments, first mounting unit 1301 may comprise a section 1329 that is configured to fit to a corresponding area along second mounting unit 1302. In some embodiments, second mounting unit 1302 may fit onto first mounting unit 1301 before both mounting units are attached onto the helmet, though in other embodiments, first mounting unit 1301 is attached to the helmet 1300 (possibly further secured to helmet 1300 via fastenable connectors) and only then second mounting unit 1302 is attached onto helmet 1300 via its respective attachment to first mounting unit 1301 (and possibly further secured to helmet 1300 via fastenable connectors). In some embodiments, section 1329 may be lowered as compared to the surface of first mounting unit 1301, in order to provide space for the second mounting unit 1302 to fit into section 1329.

In some embodiments section 1329 may also include at least one screw hole, which may be used to insert a screw through first mounting unit 1301 and second mounting unit 1302 and thus provide a more solid and strong attachment of the two parts. In the example illustrated in FIG. 13C, section 1329 comprises five holes, though any other number may be implemented. In some embodiments, the screw holes of section 1329 may be used to attach accessories to helmet 1300 via screws.

In some embodiments, first mounting unit 1301 may further comprise at least one buckle mount 1334, which may be configured for connecting at least one helmet accessory to first mounting unit 1301. First mounting unit 1301 may comprise more than one buckle mount, such as buckle mount 1334. In some embodiments, first mounting unit 1301 may comprise one buckle mount located along the front end of first mounting unit 1301, and one or more buckle mounts located towards the back end of first mounting unit 1301.

In some embodiments, only one mounting unit, either first mounting unit 1301 or second mounting unit 1302 may comprise at least one rail, grip or connector configured for connecting at least one helmet accessory or helmet accessory adaptor to the respective first or second mounting unit. However, although one of the mounting units may not comprise any rails, grips or connectors, this one mounting unit is an important part of the helmet mounting assembly since it provides stability to the mounting unit that does comprise at least one rail, grip or connector, and thus provides stability to the entire helmet mounting assembly with respect to the helmet due to the two mounting units being located one across the other.

Reference is now made to FIG. 13D, which schematically illustrates a back-side view of the first mounting unit, in accordance with an embodiment of the invention. First mounting unit 1301 may comprise at least one hole 1340, to which a helmet accessory or helmet accessory adaptor may be connected. Each of holes 1340 may enable connection of a helmet accessory or adaptor by using a single screw. In some embodiments, the hole 1340 may enable a screw to be inserted into it from the outer side of first mounting unit 1301 as illustrated in boxes 1340A, 1340A1 and 1340A2. In other embodiments, the hole 1340 may enable a screw to be inserted into it from the inner side of first mounting unit 1301, as illustrated in boxes 134B, 1340B1 and 1340B2.

In some embodiments, a screw inserted into hole 1340 from the inner side of first mounting unit 1301, may be used in order to enable various helmet accessories or helmet accessory adaptors to be attached onto fist mounting unit 1301 by being screwed onto the protruding screw inserted via hole 1340. Since some accessories may not be able to attach onto first mounting unit 1301 via rails (e.g., rail 1321, FIG. 13C) or via connectors that are an integral part of first mounting unit, such accessories may be connected to helmet 1300 via first mounting unit 1301 by being screwed onto the protruding screw, illustrated in box 1340B2. Typically, on the other side of the protruding screw, may be a corresponding nut securing the screw to hole 1340.

In some embodiments, a screw inserted into hole 1340 from the outer side of first mounting unit 13010, may be used to attach weight onto the rail (e.g., rail 1321) in order to stabilize a heavy accessory that may be connected onto first mounting unit 1301 opposite the rail. Adding weight for balancing weight of existing helmet accessories is important in order to enable a better weight spread on the head of the helmet wearer. In other cases such screw may be used to screw a helmet accessory or helmet adaptor onto first mounting unit 1301, while the only protruding section of the screw being located at the external-outer side of first mounting unit 1301 is the head of the screw, while the long part of the screw is located at the inner side of first mounting unit 1301, thereby avoiding a helmet wearer from getting hurt by a protruding screw.

According to some embodiments, first mounting unit 1301 may comprise on its back end a vertical gripper 1335, also called picatinny rail 1335; Picatinny rail 1335 may be configured to overcome the need for an excess of helmet accessory adaptors and enable direct attachment onto first mounting unit 1301 of helmet accessories such as tactical light markers (e.g., infra-red (IR) markers), battery packs to power the night vision goggle, which is typically located at the front end of first mounting unit 1301, and counter weights (for properly balancing weight along first mounting unit 1301 and preventing helmet 1300 from tilting towards the face of the helmet wearer once an accessory is attached onto first mounting unit 1301 above the face of the helmet wearer). Picatinny rail 1335 may comprise protrusions 1335A and respective indents 1335B located in between protrusions 1335A. A corresponding external gripper, which may be part of a helmet accessory of some kind, may comprise protrusions corresponding to indents 1335B, which may to be inserted into indents 1335B. In addition, such a gripper may comprise indents corresponding to protrusions 1335A, whereby the indents may be configured to accept protrusions 1335A into them as illustrated in box 1336. Such a suitable corresponding gripper that may attach onto picatinny rail 1335, may further comprise a catcher of some kind that may be configured to prevent movement of the corresponding gripper along protrusions 1335A and thus maintain its position along picatinny rail 1335.

In some embodiments, picatinny rail 1335 may be configured to carry a counter weight, as illustrated in box 1336A, such to prevent the helmet 1300 from tilting towards the face of a helmet wearer, and to better balance the weight spread along helmet 1300.

Reference is now made to FIG. 13E, which schematically illustrates a front-side view of the first mounting unit 1301, in accordance With an embodiment of the invention, the first mounting unit 1301 may comprise a buckle mount 1334 configured to overcome the need for an excess of helmet accessory adaptors and allow the direct attachment of accessories such as GoPro™ cameras or other corresponding accessories. Buckle mount 1334 may be located adjacent to the front end of first mounting unit 1301, e.g., buckle mount 1334A configured to aim cameras to the front side of the helmet wearer, and/or may be located adjacent to the hack end of first mounting unit 1301, e.g., buckle mount 1334B, which is configured to aim and direct cameras to the back side of the helmet wearer.

The buckle mount 1334 may comprise cornered edges allowing the insertion of off-shelf camera and other helmet accessories' adaptors. For example, helmet accessory adaptor 1343 may comprise a base 1343A may be configured to fit the buckle mount 1334, and may comprise semi flexible plastic levers 1345 which may be pinched and squeezed towards one another when the adaptor 1343 is slid through the corner edges of buckle mount 1334. When the levers 1345 emerge out of the other end of the cornered edges, levers 1345 expand back to their original shape prior to being inserted into buckle mount 1334, thereby keeping the adaptor 1343 firmly secured within the buckle mount 1334. The adaptor 1343 may be used to mount small cameras as shown in 1334D, e.g., GoPro™ cameras.

In some embodiments, connector 1327 (FIG. 13C) may comprise indents 1383 to accommodate certain off the shelf night vision goggle adaptors, which may comprise corresponding rubber protrusions in similar size and locations as indents 1383. Indents 1383 may not have any effect in case of connecting an adaptor which may not have any rubber protrusions. The shape of indents 1383 may be of a hexagon, though any other shape, e.g., square, round, etc., may be implemented.

As illustrated in box 1346, a night vision goggle may be positioned and attached at the front end of first mounting unit 1301 via connector 1327 (FIG. 13C), while a counter weight may be positioned at the back end of first mounting, unit 1301 onto picatinny rail 1335 (FIG. 13D). In addition, one or more cameras may be mounted onto buckle mounts 1334.

Reference is now made to FIG. 13F, which schematically illustrates variants of an external plate before and after assembly onto the first mounting unit, in accordance with embodiments of the invention. In some embodiments, first mounting unit 1301 may have an alternative variant 1301A. First mounting unit 1301A may be similar in every aspect to first mounting unit 1301 accept for connector 1327. Instead of connector 1327 as described in FIGS. 13C and 13E first mounting unit 1301A may comprise connector 1385. In some embodiments, connector 1385 may not comprise grippers equivalent to upper gripper 1328A and lower gripper 1328B (see connector 1327, FIG. 13C). In some embodiments, connector 1385 may comprise screw holes, e.g., four screw holes 1377, which may enable the attachment of external plate 1385A onto connector 1385. External plate 1385A may be made of a material such as Aluminum alloys, Coper alloys, Titanium alloys, Zinc alloys, Steal, Iron, Plastic, or any combination thereof. According to some embodiments, Plastic may include ABS, Acrylic, Delrin 2700, Epoxy, EPDM, Nylon 101, Nylon 6/10, PA, PA type 6, PBT, PC, PC high Viscosity, PE, PE high Density, PE low/medium Density, PF, PB, PBTP, PEI, Polyester Resin, Polyether Polyol, PEEK, PET, PMMA, POM, PP Copolymer, PPE, PPS, PP Homopolymer, PTFE, PUR, PVAL, PVB, and SMA or any combination thereof.

External plate 1385A may comprise external upper gripper 1372 and external lower gripper 1370 similar in function to upper gripper 1328A and lower gripper 1328B of connector 1327, respectively. In some embodiments connector 1385 alongside with the attached external plate 1385A may serve the same functions as connector 1327 in a way that the external grippers 1370 and 1372 may hold a helmet accessory or helmet accessory adaptor in place, and may prevent a helmet accessory (or helmet accessory adaptor) to easily detach from the connectors, e.g., connector 1385, along a direction that is vertical with respect to the sliding motion of a helmet accessory or helmet accessory adaptor along connector 1385.

In some embodiments, external grippers such as grippers, 1370 and 1372, which may be part of external plate 1385A, may be constructed from a stronger and more durable material compared to polymer grippers 1327A and 1328B, which may be advantageous when applying heavy duty accessories onto connector 1385 via external plate 1385A.

In some embodiments externa plate 1385A may comprise hexagon shaped indents 1388 to accommodate certain off the shelf night vision goggle adaptors, which may comprise corresponding rubber protrusions in similar size and locations as the 1388 indents. The 1388 indents will not have any effect in case of connecting an adaptor which has no rubber protrusions.

In some embodiments, variants of external plate 1385A may be created in various angles $\alpha$3, in order to achieve optimal angles corresponding with different kinds of adaptors and night vision goggles. For example, according to the illustrations in box 1391, external plate 1385A may be of the same width throughout its entire length, thus angle $\alpha$3 would be of 90 degrees with respect to a helmet wearer face. However, in other variants, external plate 1385A may have a thicker width at its upper end, which may cause the external plate 1385A to be tilted towards the face of the helmet's user only at its upper end. Furthermore, other variants of external plate 1385A may have a thicker width at its bottom end, which may cause the external plate 1385A to be tilted towards the face of the helmet's user only at its bottom end, each of these variants, which comprise a changing amount of material added either to the upper end of bottom end of the external plate 1385A, may enable adjustment of the external plate 1385A to different types of helmet accessories and helmet accessory adaptors. That is the thickness, size and shape of the mounting unit is constant, whereas the external plate 1385A may be interchangeable according to the required helmet accessories and/or helmet accessory adaptors that are to be attached to the mounting units.

In some embodiments, external plate 1385A may be attached to connector 1385 via screws, e.g., screws 1386B, 1386C, 1386D and 1386E. Screws 1386B, 1386C, 1386D and 1386E may be screwed from the inner side of connector

1385 and through external plate 1385A. In some embodiments, external plate 1385A may comprise holes comprising a thread, which may keep the screws intact (external plate 1386A), with no need for a screwing nut to secure the screw in place, as the thread itself would suffice for such intact positioning of the screw. In some embodiments external plate 1385A may not comprise holes comprising a thread. In this case, screws 1386B, 1386C, 1386D and 1386E may be secured from the external side of external plate 1385A via nuts 1387B, 1387C, 1387D and 1387E, respectively, as shown in box 1386F.

Reference is now made to FIG. 13G, which schematically illustrates an optional safe release feature corresponding to an external plate, in accordance with an embodiment of the invention.

In some embodiments, an external plate, e.g., external plate 1385A (FIG. 13F) may comprise a safe release feature. In some embodiments, external plate 1385A may comprise safety latch 1360. Safety latch 1360 may be interchangeable between two positions; (a) the first position may ensure firm attachment of a helmet accessory directly or via a helmet accessory adaptor to a helmet, e.g., helmet 1300, via external plate 1385A, and (b) the second position may enable safe and quick release of the attached helmet accessory (directly of via a helmet accessory adaptor) from the helmet, e.g., helmet 1300, in case of an emergency. In some cases, the helmet may be forcefully hit from beneath the helmet's wearer's face, e.g., when the helmet wearer jumps into water, the water may apply such force onto the face and helmet of the wearer from underneath the wearer's face and upwards. Such a strong force may be extremely hazardous, specifically if the helmet is equipped with a relatively large helmet accessory that may be forcefully pushed by such upward force. This may cause damage to the head of the helmet wearer and may pose risk of neck and head injuries. That is, on one hand the helmet accessory should be tightly attached onto the helmet, such that it doesn't easily disconnect from the helmet, since the helmet accessory's functions are required for by the helmet user. However, in cases of an emergency, as described hereinabove, the helmet user should have the ability to safely and quickly detach the helmet accessory off the helmet, such to avoid any injury to the helmet user. Accordingly, safety latch 1360 provides a user to switch between a firm attachment between the helmet accessory (or helmet adaptor) and the helmet (via external plate 1385A), and a releasable attachment between the helmet accessory (or helmet adaptor) and the helmet.

According to some embodiments, in order to provide a firm attachment between a helmet accessory (directly or via a helmet accessory adaptor) and the helmet, safety latch 1360 may be positioned along the middle of the bottom gripper 1370 (the gripper that is closer to the helmet wearers face) of external plate 1385A (box 1388). Once safety latch 1360 is located at the middle of gripper 1370, the width of safety latch 1360 together with the width of gripper 1370, e.g., width X1 (box 1388*a*), may provide a large enough surface overlapping with a helmet accessory that may be positioned within gripper 1370. For example, a surface of 2 mm long is considered sufficient to provide a helmet accessory's grip to be firmly held up against. For example, the width of gripper 1370 may be 1 mm, and the width of safety latch 1360 may be 2 mm, though safety latch 1360 typically comprises a tunnel passing in the middle so as to enable it to slide over gripper 1370. Thus, the width of each side of safety latch 1360, from the middle tunnel to the edge of each side of safety latch 1360, may be of 0.5 mm. That is, once safety latch 1360 is slid to the middle of gripper 1370, the total width of safety latch 1360 and gripper 1370 would be 2 mm. In other embodiments, other widths may be implemented.

According to some embodiments, in order to provide a releasable attachment between a helmet accessory (directly or via a helmet accessory adaptor) and the helmet, safety latch 1360 may be positioned on a non-middle position along gripper 1370, e.g., on one of the sides along gripper 1370 (box 1387). When safety latch 1360 no longer provides the additional surface to gripper 1370, the total surface between gripper 1370 and a helmet accessory (or helmet accessory adaptor) that is positioned within gripper 1370, e.g., width X2 (box 1387*a*), may be smaller compared to the "firm attachment position", e.g., 1 mm. A lesser surface onto which the grip of the helmet accessory (or the helmet accessory adaptor) may rest against, may be equivalent to a weaker connection between the helmet accessory (with or without a helmet accessory adaptor), which may enable a safe and quick release or detachment of the helmet accessory from the external plate and thus from the helmet. Since the helmet accessory (or the helmet accessory adaptor) rests against a small surface of gripper 1370, a slight force applied onto the helmet accessory from underneath it, is typically enough for detaching the helmet accessory (or the helmet accessory adaptor) from the helmet onto which is was releasably attached. A helmet user may determine when to change to the location of safety latch 1360 according to the type of attachment required between the helmet accessory (with or without a helmet accessory adaptor) and the helmet, e.g., hen a firm attachment is required or when a releasable attachment is required (e.g., in scenarios where force may be applied underneath an attached helmet accessory).

Reference is now made to FIG. 13H, which schematically illustrates a bottom view of the first mounting unit, in accordance with an embodiment of the invention.

In some embodiments, the first mounting unit 1301 may have internal supporting ribs to provide strength to the unit's structure and allow for thin material to be used in order to reduce weight. That is, in some embodiments, first mounting unit 1301 may be produced to have a thin profile strengthened by ribs, which may be located on the inner side of first mounting unit 1301.

Reference is now made to FIG. 13I, which schematically illustrates a side view of the first mounting unit, in accordance with an embodiment of the invention.

In some embodiments, the first mounting unit 1301 may comprise an internal "zig-zag" edge pattern 1330 to allow more flexibility of the mounting unit for easier placement on helmet 1300. Such a "zig-zag" pattern along the internal side of first mounting unit 1301 may enable using less material for producing the first mounting unit 1301, and in addition, may provide flexibility per any section along first mounting unit 1301, as well as a total flexibility of the entire first mounting unit 1301. Typically, helmets do not have a perfectly convex shape, due to manufacturing limitations. That is, there is a lot of variance between different types of helmets, and even within the same type of helmets. Thus, it is sometimes required to stretch the first mounting unit closer to the external shape of the helmet, such to provide a tight attachment between the first mounting unit 1301 and helmet 1300. Such a flexible mounting unit may be acquired by the reoccurring lacking of material (1332) along the first mounting unit, which creates the "zig-zag" shaped pattern.

Reference is now made to FIG. 13J, which schematically illustrates a second mounting unit 1302*j* in accordance with an embodiment of the invention. Second mounting unit 1302 may comprise at least one rail, grip or connector configured for connecting at least one helmet accessory to the second mounting unit 1302. For example, second mounting unit 1302 may comprise rail 1341, and in addition to or instead of the rails, second mounting unit 1302 may comprise one or more grips, e.g., grip 1361A.

In some embodiments, rail 1341 will be similar to rail 1321 of the first mounting unit (FIG. 13C). Similarly, rail 1341 may comprise at least one hole 1344, which may be configured to enable connection of a helmet accessory or a helmet accessory adaptor to the second mounting unit 1302 via holes 1344.

In some embodiments, the rails, e.g., rail 1341 may comprise a beveled edge 1342 that is configured to enable a smooth insertion of the helmet accessory or helmet accessory adaptor onto the rail, e.g., rail 1341.

In some embodiments rail 1341 may comprise at least one hole 1340 through which a helmet accessory or helmet accessory adaptor may be connected. Each hole 1340 may enable connection of a helmet accessory or helmet accessory adaptor via a single screw. In some embodiments, the hole 1340 may enable the screw to be inserted either from the inner side of second mounting unit 1302 (as explained in detail with respect to boxes 1340A, 1340A1 and 1340A2, FIG. 13D) or from the external side of second mounting unit 1302 (as explained in detail with respect to boxes 1340B, 1340B1 and 1340B2, FIG. 13D).

In some embodiments, grips, such as grip 1361A may be configured to overcome the need for an excess of helmet accessory adaptors, as with current flashlights or other grippers that may be configured to attach onto a helmet via several connectors, instead of only one connector, as disclosed in the present invention In some embodiments, in order to provide additional stability to the connection between a gripper and grip 1361A, grip 1361A may comprise protrusions 1364 as well as respective indents 1365 located in between protrusions 1364. A corresponding gripper, which may be configured to grip and attach onto grip 1361A, may comprise protrusions corresponding to indents 1365 of grip 1365A, which may to be inserted into indents 1365. In addition, such a corresponding gripper may comprise indents corresponding to protrusions 1364 of grip 1365A, whereby the indents may be configured to accept protrusions 1364 into them. Such a suitable gripper that may attach onto grip 1361A, may further comprise a catcher of some kind that may be configured to prevent movement of the corresponding gripper along protrusions 1364 and thus maintain its position along grip 1361A.

In some embodiments, in order to strengthen the connection between the second mounting unit 1302 to the helmet via fastenable connectors that do not penetrate through the helmet, e.g., clips, the fastenable connectors may be screwed or otherwise fastened to the second mounting unit 1302. The area at which one fastenable connector may be connected to second mounting unit 1302 may be area 1348. Hole or holes 1349 may be holes through which a screw or any other fastening means may be inserted in order to fasten the fastenable connector, e.g., a clip, to second mounting unit 1302, thus tightly fastening or attaching second mounting unit 1302 to the helmet. In some embodiments, a screw or other fastening means may be inserted through hole 1349 from the external side of second mounting unit 1302, while a corresponding securing nut may be located at the internal side of second mounting unit 1302 and screwed onto the screw in order to secure the screw within hole 1349. In some embodiments, nut-hole 1350A may comprise an indentation 1351, which may be configured to fit the shape of the securing nut. For example, indentation 1351 of nut-hole 1350A may be in the shape of a hexagon if the shape of the securing nut is of a hexagon. It should be clear that any other shape may be implemented per the securing nut and thus to indentation 1351 of nut hole 1350A.

The securing nut may be reinforced and affixed into its indent 1351 via at least one rib 1351A, such that the corresponding screw may be safely screwed through holes 1349 while being stabilized by the fixed nut. At least one rib 1351A may be located on opposite sides of indentations 1351 in order to force the securing nut to be pushed against such ribs, thereby affixing the securing nut within its indentation 1351, and enabling an easy assembly of the second mounting unit 1302 onto helmet 1300, since there is no need to hold the securing nut in its position while screwing its corresponding screw therethrough.

In order to attach second mounting unit 1302 onto first mounting unit 1301 such that second mounting unit 1302 is positioned across first mounting unit 1301, second mounting unit 1302 may comprise section or area 1347, which is designed to fit the corresponding section or area 1329 located in first mounting unit 1301 (FIG. 13C). Thus, second mounting unit 1302 may be fitted onto first mounting unit 1301. In some embodiments, section 1347 of second mounting unit 1302 may have a shape that is configured to exactly fit onto corresponding section 1329 of first mounting unit 1301. Section 1347 may comprise a projection that is of the size and shape of the corresponding indent of section 1329 of first mounting unit 1301, such that the projection of section 1347 is placed directly on top of the indent of section 1329 of first mounting unit 1301. Typically, second mounting unit 1302 is fitted onto first mounting unit 1301 without section 1347 being higher than the surface of the rest of second mounting unit 1302 neither it being higher compared to the surface of first mounting unit 1301, thus second mounting unit 1302 and first mounting unit 1301 may create a continuous assembly that appears as one whole part, and not as two separate units. Typically, the first mounting unit 1301 may first be attached to the helmet, e.g., helmet 1300 and only then the second mounting unit 1302 is fitted onto and attached to the first mounting unit 1301 and to the helmet.

In some embodiments, section 1347 may comprise one or more holes that may be configured to interconnect with the holes in corresponding section 1329 (FIG. 13C). In some embodiments, some or all of the corresponding holes of each of the mounting units may be screwed together via a screw from the inner side of the mounting units, and a corresponding securing nut located at the outer side of the mounting units, in order to provide a more secure attachment between first mounting unit 1301 and second mounting unit 1302. In other embodiments, section 1347 may provide space on section or area 1347 for other features, e.g., for adding a cosmetic feature, for example, a company's logo or other accessories such as a camouflage fabric, etc.

In some embodiments, second mounting unit 1302 may be oriented along the helmet such that one end of second mounting unit 1302 is located above a section of the helmet that is to be located above the ear of the helmet wearer or user, whereas the opposite end of the second mounting unit 1302 may be located above a section of the helmet that is to be located above the opposite ear of the helmet wearer. For example, the first end of second mounting unit 1302 may be located above the right ear of the helmet wearer or user, while the opposite end of the second mounting unit 1302 may be located above the left ear of the helmet wearer, or vice versa. In other embodiments, second mounting unit

1302 may be located at different orientations along the helmet, so as long as the second mounting unit 1302 is positioned across the first mounting unit 1301.

Reference is now made to FIG. 13K, which schematically illustrates a bottom view of second mounting unit 1302, in accordance with another embodiment of the invention. In some embodiments, second mounting unit 1302 may comprise internal supporting ribs to provide strength to the unit's structure and allow for the use of thin layer of the material in order to reduce weight. That is, in some embodiments, second mounting unit 1302 may be produced to have a thin profile strengthened by ribs, which may be located on the inner side of second mounting unit 1302.

Reference is now made to FIG. 13L, which schematically illustrates a side view of second mounting unit 1302, in accordance with an embodiment of the invention.

In some embodiments, second mounting unit 1302 may comprise an internal "zig-zag" edge pattern 1330, similar to the pattern present on first mounting unit 1301 (FIG. 13I) to allow more flexibility of the mounting unit for easier placement on helmet 1300).

Such a "zig-zag" pattern along the internal side of second mounting unit 1302 may enable using less material for producing the second mounting unit 1302, and in addition, may provide flexibility per any section along first mounting unit 1301, as well as a total flexibility of the entire second mounting unit 1302. Typically, helmets do not have a perfectly convex shape, due to manufacturing limitations. That is, there is a lot of variance between different types of helmets, and even within the same type of helmets. Thus, it is sometimes required to stretch the first mounting unit closer to the external shape of the helmet, such to provide a tight attachment between the second mounting unit 1302 and helmet 1300. Such a flexible mounting unit may be acquired by the reoccurring lacking of material (1332) along the first mounting unit, which creates the "zig-zag" shaped pattern.

Reference is now made to FIG. 13M, which schematically illustrates the fastenable connectors, e.g. clips, of the first and second mounting system, in accordance with embodiments of the invention.

In some embodiments, first mounting unit 1301 may comprise aback clip 131030 (to be located adjacent a user's back, and which is equivalent to clip 1305 in FIG. 13A) and a front clip 131010 (to be located adjacent a user's face, and which is equivalent to clip 1304 in FIG. 13A), which may allow the attachment of the first mounting unit 1301 to the helmet 1300 without drilling holes through the helmet. In some embodiments, second mounting unit 1302 may comprise similar left and right clips 131020 (each to be located adjacent to one of the user's ears, and which is equivalent to clips 1306 and 1307 in FIG. 13A), which may allow the attachment of second mounting unit 1302 to the helmet 1300 without drilling holes through the helmet. Each of clips 131030, 131010, and 131020 may comprise supporting ribs 131040 in order to provide for a more solid structure when using a thin layer of material.

In some embodiments, front clip 131010 and back clip 131030 may comprise additional rubber shims 131043A, which may match and fit into the indent surface of the clip, e.g., indent 131043. Similarly, in some embodiments, right and left clips 131020 may comprise additional rubber shims 131041A, which may match and fit into the indent surface 131041 of clips 131020. Rubber shims for each clip may be of different heights and intended to allow adjusting the same mounting system to various helmet heights. In some embodiments, rubber shims 131041A may comprise one or more protrusions 131041B allowing them to snuggly fit into shim holes 131041 of the clips, as illustrated by line 131042. Similarly, rubber shims 131043A may comprise one or more protrusions 131043B allowing them to snuggly fit into shim holes of clip 131030, as illustrated by line 131044.

Reference is now made to FIG. 14, which schematically illustrates a helmet comprising a helmet mounting assembly having attached thereon exemplary helmet accessories, in accordance with another embodiment of the present invention. According to some embodiments, helmet 1400 may comprise a helmet mounting assembly comprising a first mounting section 1401 and a second mounting section 1402, which may be positioned one across the other in order to provide a stable structure with respect to possibly applied external compression forces. First mounting section 1401 and second mounting sections 1402 may be separate components attached such to create a full mounting assembly.

In some embodiments, first mounting section 1401 may have attached thereon cameras 141204, which may be connected to plate buckles 141206 via off-the-shelf connector 141206A.

In some embodiments, second mounting section 1402 may have attached thereon flashlight 141203 that may be attached to second mounting section 1402 via a grip similar to grip 141207.

In some embodiments, first mounting section 1401 may have attached thereon night vision goggles 141106 that may be attached to connector 141116 via off-the-shelf adaptor 141106A.

In some embodiments, first mounting section 1401 may have attached thereon tactical light marker 141105A, e.g., an IR (infra-red) marker that may be attached to grip 141105.

In some embodiments, first mounting section 1401 and/or mounting section 1402 may have attached thereon counterweight bars 141105B placed onto rails similar to rails 141105C via a single screw.

Any other number and/or combination of helmet accessories and helmet accessory adaptors may be attached onto either of any first or second mounting sections 1401 and 1402, respectively. The type of connecting means that any first mounting section and/or any second mounting section may comprise, may be pre-determined according to the type of helmet accessories or helmet accessory adaptors that are to be positioned onto the mounting sections. The mounting sections may further comprise extra connecting means, e.g., rails, grips and connector, in addition to connecting means assigned for predetermined accessories to be attached onto the mounting sections, such to enable versatility of possible additional accessories that may be attached onto a helmet comprising such mounting sections.

Any other number and/or combination of helmet accessories and helmet accessory adaptors may be attached onto either of any first or second mounting sections (e.g., first and second mounting sections 101 and 102, 211 and 212, 311 and 312, 411 and 412, 511 and 512, 611 and 612, 711 and 712, 811 and 812, 1101 and 1102, 1201 and 1202, 1301 and 1302, and 1401 and 1402). The type of connecting means that any first mounting section and/or any second mounting section may comprise, may be pre-determined according to the type of helmet accessories or helmet accessory adaptors that are to be positioned onto the mounting sections. The mounting sections may further comprise extra connecting means, e.g., rails, grips and connector, in addition to connecting means assigned for predetermined accessories to be attached onto the mounting sections, such to enable versatility of possible additional accessories that may be attached onto a helmet comprising such mounting sections.

Reference is now made to FIGS. 15A-15B, which schematically illustrate a top-view and side view of a first mounting unit, respectively, in accordance with an embodiment of the present invention. FIGS. 15A-15B schematically illustrate a first mounting unit 15101, which may be configured for connecting at least one helmet accessory adaptor. In some embodiments, the first mounting unit 15101 may have various types and shapes of holes, which may be configured to enable attachment of helmet accessory adaptors onto which helmet accessories may be connected. That is, first mounting unit 15101 may be configured to accept and have attached thereon substantially any type of helmet accessory adaptor, and thus substantially any helmet accessory.

Reference is now made to FIGS. 16A-16B, which schematically illustrate a top-view and side view of a second mounting unit, respectively, in accordance with an embodiment of the present invention. FIGS. 16A-16B schematically illustrate a first mounting unit 15102, which may be configured for connecting at least one helmet accessory adaptor. In some embodiments, the second mounting unit 15102 may have various types and shapes of holes, which may be configured to enable attachment of helmet accessory adaptors onto which helmet accessories may be connected. That is, second mounting unit 15102 may be configured to accept and have attached thereon substantially any type of helmet accessory adaptor, and thus substantially any helmet accessory.

Reference is now made to FIG. 17A, which schematically illustrates frontal and side views of a helmet 1700 including a first front-to-back mounting unit 1701 in accordance with some embodiments of the present invention. First mounting unit 1701 is similar in shape, size, features and installation method to first mounting units 1301 and 1401 as explained in the present description. Accordingly, front-to-back mounting unit may be attached to helmet 1700 by front and back clipping elements 1704*a* and 1704*b*, respectively, which may be similar to clips 1304 and 1305 described in detail herein above. Front-to-back mounting unit 1701 includes a bottom side 1710, i.e. the side intended to face helmet 1700 when unit 1701 is installed on helmet 1700, and a top side 1711, i.e. the side intended to face away from helmet 1700 when unit 1701 is installed on helmet 1700. As described herein, usually top side 1711 is configured to mount and/or connect with various kinds of equipment.

In some embodiments, a usage of a front-to-back mounting unit as a stand-alone is desired, without a second, side-to-side mounting unit, for example as described above. This may be desired, for example, to reduce weight of the assembly and/or when the mounting features of the side-to-side mounting unit aren't required. However, as discussed in detail above, the front-to-back mounting unit alone without the side-to-side mounting unit may not be as stable and firm as having the two mounting units located across and supporting each other, for example as explained in more detail with reference to FIG. 14.

In order to reduce the ability of front-to-back mounting unit 1701 to slide and/or rotate sidewards on top of helmet 1700, some embodiments of the present invention provide friction pads that increase the friction between helmets 1700 and unit 1701, as described in more detail herein below.

Reference in now made to FIG. 17B, which schematically illustrates a bottom view of front-to-back mounting unit 1701, with and without attached friction pads 1703, and various views of an exemplary pad 1703, according to some embodiments of the present invention.

In some embodiments, front-to-back mounting unit 1701 may have elastic friction pads 1703, which may be attached to bottom side 1710 of front-to-back mounting unit 1701.

Elastic pads 1703 may be made of and/or include, for example, any elastomer such as, for example, thermoplastic elastomers (TPE), Resilin and/or Elastin proteins, Polysulfide rubber and/or Elastolefin (elastic fiber used in fabric production).

For example, elastic pads 1703 may be made of and/or include, for example, any one or combination of Nitrile, Hydrogenated Nitrile, EthylenerPropylene, Fluorocarbon, Chloroprene, Silicone, Fluorosilicone, Polyacrylate, Ethylene Acrylic, Styrene-butadiene, Polyurethane, natural rubber, and/or any other rubber material and/or elastomer compound.

Front-to-back mounting unit 1701 may include on bottom side 1710 a plurality of ribs 1715 and/or pits 1717, by which pads 1703 may be connected to mounting unit 1701. In some embodiments, elastic friction pads 1703 may include at least two protrusions 1714 with at least one groove 1713 between them.

Protrusions 1714 may be designed in size and shape to fit snuggly in grooves 1716 between ribs 1715 of mounting unit 1701. For example, a width A of groove 1713 is substantially equal to a width of rib 1715. Thus, ribs 1715 may keep pads 1703 firmly attached to mounting unit 1701.

Reference in now made to FIG. 17C, which schematically illustrates installation of front-to-back mounting unit 1701 on top of helmet 1700, according to some embodiments of the present invention. In some embodiments, pads 1703 may provide high friction by being forcefully pressed onto the surface of helmet 1700. The pressing force may be provided by clipping elements 1704*a* and 1704*b*, which may pull mounting unit 1701 onto helmet 1700, thus squeezing pads 1703 between mounting unit 1701 and helmet 1700.

Therefore, by attaching elastic friction pads 1703 to the bottom side 1710 of front-to-back mounting unit 1701, more friction is created between the mounting unit 1701 and the helmet 1700 surface. In some embodiments, when assembling front-to-back mounting unit 1701 on helmet 1700, elastic pads 1703 are pressed onto the surface of helmet 1700 to make a firm and/or full contact with the helmet surface as shown in FIG. 17C. Since pads 1703 are made of a material with higher friction coefficient than mounting unit 1701, they provide significantly higher resistance to external shear forces if applied on front-to-back mounting unit 1701. This increases the attachment stability of front-to-back mounting unit 1701 to helmet 1700, thus allowing stable and safe use of front-to-back mounting unit 1701, also when using it without a side-to-side unit for support.

In various embodiments of the present invention, elastic friction pads 1703 may have various lengths and shapes. For example, pad or pads 1703 may be relatively short and cover only a portion of the length of bottom side 1710, as shown in FIGS. 17B and 17C. In some other embodiments, pad or pads 1703 may cover most or all of the length of bottom side 1710. The height of pad 1703 may be between about 0.01 and 100 millimeter. In some embodiments, a pad 1703 may have a varying height along its length and/or width. In addition to providing friction, elastic pads 1703 of different shapes, heights and/or lengths may provide adaptation of mounting unit 1701 to different shapes and sizes of helmet 1700. Additionally, pads 1703 of different shapes may fit different mounting units 1701.

In some embodiments, elastic adjustment pads 1703 can be used to adjust mounting unit 1701 to various helmet's shapes and/or sizes. A mismatch between the shape and/or size of mounting unit 1701 and the surface curve of the helmet might create undesirable gaps between mounting unit 1701 and the helmet's surface. Elastic pads 1703 can be designed to fill those gaps and provide a continuous contact area between mounting unit 1701 and the helmet.

Reference in now made to FIG. 17D, which schematically illustrates half-full length elastic friction pads 1703*a* attached to front-to-back mounting unit 1701, in accordance with some embodiments of the present invention. Half-full length elastic friction pads 1703*a* are an exemplary embodiment of friction pads 1703 described herein. In some embodiments, front-to-back mounting unit 1701 may include half-full length friction pads 1703*a*, each having a length of almost half the length of the bottom side 1710 from back to front. For example, when attached to bottom side 1710, pads 1703*a* leave uncovered about 0.5-10 centimeters in the middle and/or edges of bottom side 1710.

In some embodiments, elastic pads 1703*a* may include protrusions which may be designed in size and shape to fit snuggly between and/or in ribs and/or pits on bottom side 1710 of mounting unit 1701, keeping the pads in their location firmly attached to mounting unit 1701, as shown in more detail, for example, in FIGS. 17B and 17E.

In some embodiments pads 1703*a* may not include protrusions and in some embodiments the pads may be attached to the bottom side 1710 of mounting unit 1701 via adhesive or glue material.

For example, when assembling front-to-back mounting unit 1701 on helmet 1700, elastic pads 1703*a* are pressed onto the surface of helmet 1700 to make a firm and/or full contact with the helmet surface as shown in FIG. 17D. Additionally, for example, by using half-full length friction pads 1703*a*, mounting unit 1701 may be adapted to a helmet 1700 of a smaller size. For example, pads 1703*a* of a certain height may be selected according to the size of a certain helmet 1700, on which mounting unit 1701 is intended to be attached. Therefore, by attaching elastic friction pads 1703*a* to the bottom side 1710 of front-to-back mounting unit 1701, more friction is created between the mounting unit and the helmet surface, and also mounting unit 1710 may be adapted to a certain size and/or shape of helmet 1700. For example, a mounting unit 1701 designed for a large size helmets can be adapted to fit a medium size helmet by using elastic adjustment pads 1703*a*.

Reference in now made to FIG. 17E, which schematically illustrates a front-to-back mounting unit 1701, with and without attached half-full length elastic friction pads 1703*b*, and a perspective view of pads 1703*b*, according to some embodiments of the present invention. Half-full length elastic friction pads 1703*b* are another exemplary embodiment of friction pads 1703 described herein.

Front-to-back mounting unit 1701 may include on bottom side 1710 a plurality of ribs 1715 and/or pits 1717, by which pads 1703*b* may be connected to mounting unit 1701. In some embodiments, elastic friction pads 1703*b* may include various longitudinal protrusions 1714, transverse protrusions 1718, round protrusions 1719, and/or any other suitable protrusions, designed in size and shape to fit snuggly into grooves 1716 between ribs 1715 and into pits 1717. Thus, ribs 1715 and pits 1717 may keep pads 1703*b* firmly attached to mounting unit 1701.

In some embodiments pads 1703*b* may not include protrusions and in some embodiments the pads may be attached to mounting unit 1701 by adhesive or glue material, as described in detail below.

It will be appreciated that front-to-back mounting unit 1701 may include along its length several different elastic friction pads 1703, possibly with different sizes, heights and/or shapes, to accommodate to the specific mounting unit 1701 and to a specific helmet 1700, to which the mounting unit is intended to be attached.

Further stability and/or mounting facilities may be provided by adding a second, side-to-side, mounting unit, placed across front-to-back mounting unit 1701, as described in more detail herein.

Reference is now made to FIG. 17F, which schematically illustrates a helmet mounting assembly 1750, including a front-to-back mounting unit 1701 and a partial side-to-side mounting unit 1702, in accordance with some embodiments of the present invention.

In some embodiments, a helmet mounting assembly 1750 may comprise a partial side-to-side mounting unit 1702 in addition to front-to-back mounting unit 1701. Partial side-to-side mounting unit 1702 may be attached on top and/or on bottom of front-to-back mounting unit 1701, for example, such that side-to-side mounting unit 1702 is crossed by front-to-back mounting unit 1701, for example in the middle of unit 1702. On each side of front-to-back mounting unit 1701, side-to-side mounting unit 1702 may have a length of a few centimeters, for example between about 1 and 15 centimeters, pressed onto the surface of helmet 1700. In some embodiments, helmet mounting assembly 1750 may have a larger partial side-to-side mounting unit 1702*a*, providing further mounting facilities and/or stability. On each side of front-to-back mounting unit 1701, side-to-side mounting unit 1702*a* may have a length of, for example, between about 5 and 30 centimeters, pressed onto the surface of helmet 1700.

Having a partial side-to-side unit 1702, which doesn't reach the side edges of helmet 1700, may have some advantages such as, for example, making side clip elements redundant and/or enabling different side-cuts of helmet 1700. Also, partial side-to-side unit 1702 may be attached to front-to-back unit 1700 easily and quickly, for example by at least one screw element as described in detail herein below.

In some embodiments, partial side-to-side mounting unit 1702 may be similar in features and shape to a middle section of the second mounting units 1302 and 1402 as described herein with reference to FIGS. 13A and 14. In some embodiments, it may comprise one or more connectors and rails equivalent in shape and function to 1361A and/or 1341, described herein with reference to FIG. 13J.

In some embodiments of the present invention, partial side-to-side mounting unit 1702 may include no connectors for connecting partial side-to-side mounting unit 1702 directly to helmet 1700. Partial side-to-side mounting unit 1702 may be directly attached to front-to-back mounting unit 1701, and attached to helmet 1700 only via unit 1701.

Side-to-side mounting unit 1702 and front-to-back mounting unit 1701 may include matching connection surfaces 1722 and 1721, respectively. For example, each of connection surfaces 1722 and 1721 may include at least one hole 1723 and 1724, respectively, in matching positions. When side-to-side mounting unit 1702 is positioned across front-to-back mounting unit 1701 with surfaces 1721 and 1722 one on top of the other, the holes 1723 and 1724 coincide with each other, for example enabling connection between the mounting units 1701 and 1702 by screws or bolts. In some embodiments, surfaces 1722 and 1721 may have matching shapes and/or cross sections that facilitate positioning of mounting unit 1702 across mounting unit 1701, and/or prevent horizontal motion of mounting unit 1702 relative to mounting unit 1701, when placed one on top of and across the other. For example, mounting unit 1702 may be positioned in a predetermined and/or required angle relative to mounting unit 1701, similarly to units 1301 and 1302 described in detail herein above. For example, mounting unit 1702 may be positioned perpendicularly to mounting unit 1701, as shown in FIG. 17F, although the invention is not limited in this respect.

For example, surface 1721 may comprise a projection of matching size and shape to a corresponding indent of surface 1722, such that the projection of surface 1721 fits the indent of surface 1722, when the projection of surface 1721 is placed directly on top of and across the indent of surface 1722. In some embodiments, when the projection of surface 1721 is fitted onto the indent of surface 1722, surface 1721 has the same height as adjacent portions of mounting unit 1701, thus mounting unit 1702 and mounting unit 1701 creating a continuous assembly that appears integral, and not as two separate units. In some embodiments, front-to-back mounting unit 1701 may be attached first to helmet 1700 and only then side-to-side mounting unit 1702 is fitted onto and attached directly to front-to-back mounting unit 1701 and indirectly to the helmet. Holes 1723 of mounting unit 1702 and holes 1724 of mounting unit 1701 may be configured to interconnect by at least one screw inserted in at least one pair of coinciding holes 1724 and 1723 from bottom side 1710, and a corresponding securing nut threaded on the screw from a top side 1709 of mounting unit 1702, for example on top of a hole 1724, wherein a bottom side 1708 of mounting unit 1702 faces helmet 1700. Thus, a more secured attachment may be provided between mounting units 1701 and 1702. In some embodiments, surface 1721 may include space for attachment of other features, for example a cosmetic feature such as a company's logo or any other suitable accessory such as, for example, a camouflage fabric.

Reference in now made to FIG. 17G, which schematically illustrates elastic friction pads 1705 attached to side-to-side mounting unit 1702 in accordance with some embodiments of the present invention.

In some embodiments, side-to-side mounting unit 1702 may include elastic friction or adjustment pads 1705 attached to bottom side 1708 of unit 1702. Friction pads 1705 may include/be made of similar materials, and have the same characteristics and functions, as pads 1703 described in detail above.

In some embodiments, elastic pads 1705 may include protrusions and/or grooves designed in size and shape to fit snuggly between corresponding ribs and/or pits on bottom side 1708 of mounting unit 1702, in a similar manner as described with reference to pads 1703 and mounting unit 1701 (see also FIGS. 13H and 13K), thus keeping pads 1705 firmly attached in their location on bottom side 1708 of mounting unit 1702.

In some embodiments pads 1705 may not include protrusions and in some embodiments the pads may be attached to mounting unit 1702 via adhesive or glue material.

Similarly to pads 1703, pads 1705 may provide high friction by being forcefully pressed onto the surface of helmet 1700. The pressing force may be provided by clipping elements 1704*a* and 1704*b*, which may pull mounting unit 1701 onto helmet 1700, thus pulling also mounting unit 1702 connected to mounting unit 1701, and squeezing pads 1705 between mounting unit 1702 and helmet 1700.

Therefore, by attaching elastic friction pads 1705 to the bottom side 1708 of side-to-side mounting unit 1702, more friction is created between mounting assembly 1750 and the top surface of helmet 1700. In some embodiments, when assembling front-to-back mounting unit 1701 on helmet 1700, elastic pads 1705 are pressed onto the surface of helmet 1700 to make a firm and/or full contact with the helmet surface as shown in FIG. 17G, thus providing further resistance to external shear forces if applied on front-to-back mounting unit 1701 and side-to-side mounting unit 1702.

In various embodiments of the present invention, elastic friction pads 1705 may have various lengths and shapes. The height of pad 1705 may be between about 0.01 and 100 millimeter. In some embodiments, a pad 1705 may have a varying height along its length and/or width. For example, since side-to-side mounting unit 1702 is pulled towards helmet 1700 from surface 1721 in its middle, pads 1705 may be thicker towards the edges of mounting unit 1702 to compensate for possible rising of the edges of mounting unit 1702 above the surface of helmet 1700 and/or keep firm and continuous contact with the helmet surface. In addition to providing friction, elastic pads 1705 of different shapes, heights and/or lengths may provide adaptation of mounting unit 1702 to different shapes and sizes of helmet 1700. Additionally, pads 1705 of different shapes may fit different mounting units 1702.

Reference in now made to FIG. 17H, which schematically illustrates half-full length elastic friction pads 1705*a* attached to a full side-to-side mounting unit 1702*b*, in accordance with some embodiments of the present invention. Full side-to-side mounting unit 1702*b* may be similar to partial side-to-side mounting unit 1702, however full side-to-side mounting unit 1702*b* may reach the side edges of helmet 1700 and may be secured to the side edges by a clip element 1704*c* on each side. Half-full length elastic friction pads 1705*a* are an exemplary embodiment of friction pads 1705 described herein. In some embodiments, side-to-side mounting unit 1702*b* may include half-full length friction pads 1705*a*, each having a length of almost half the length of a bottom side 1708*a* of side-to-side mounting unit 1702*b*. For example, when attached to bottom side 1708*a*, pads 1705*a* leave uncovered about 0.5-10 centimeters in the middle and/or edges of bottom side 1708*a*. For example, when attached to bottom side 1708*a*, pads 1705*a* leave uncovered the bottom of connection surface 1721, and/or about 1-5 centimeters in the edges of bottom side 1708*a*.

In some embodiments, elastic pads 1705*a* may include protrusions which may be designed in size and shape to fit snuggly between and/or in ribs and/or pits on bottom side 1708*a* of mounting unit 1702*b*, keeping the pads in their location firmly attached to mounting unit 1702*b*.

For example, when assembling side-to-side mounting unit 1702*b* on front-to-back mounting unit 1701 and on helmet 1700, elastic pads 1705*a* are pressed onto the surface of helmet 1700 to make a firm and/or full contact with the helmet surface as shown in FIG. 17H. Additionally, for example, by using half-full length friction pads 1705*a*, mounting unit 1702*b* may be adapted to a helmet 1700 of a smaller size. For example, pads 1705*a* of a certain height may be selected according to the size of a certain helmet 1700, on which mounting unit 1702*b* is intended to be attached. Therefore, by attaching elastic friction pads 1705*a* to the bottom side 1708 of side-to-side mounting unit 1702*b*, more friction is created between the mounting unit and the helmet surface, and also mounting unit 1702*b* may be adapted to a certain size and/or shape of helmet 1700, For example, a mounting unit 1702*b* designed for a large size helmets can be adapted to fit a medium size helmet by using elastic adjustment pads 1705*a*.

Side-to-side mounting unit 1702*b* may include on bottom side 1708*a* a plurality of ribs 1715 and/or pits 1717, by which pads 1705*a* may be connected to mounting unit 1702*b*. In some embodiments, elastic friction pads 1705*a* may include various round, longitudinal and/or transverse protrusions and/or any other suitable protrusions, designed in size and shape to fit snuggly between ribs 1715 and into pits 1717. Thus, ribs 1715 and pits 1717 may keep pads 1705*a* firmly attached to mounting unit 1702*b*.

In some embodiments pads 1705*a* may not include protrusions and in some embodiments the pads may be attached to mounting unit 1702*b* by adhesive or glue material, as described in detail herein below.

It should be appreciated that-side to side mounting unit 1702*b* may include along its length several different elastic friction pads 1705, possibly with different sizes, heights and/or shapes, to accommodate to the specific mounting unit 1702*b* and to a specific helmet 1700, to which the mounting unit is intended to be attached.

Reference is now made to FIG. 17I, which is a schematic illustration of adhesive elastic pads 1703*c* and of a mounting unit 1701 with attached adhesive pads, according to some embodiments of the present invention. In some embodiments of the present invention, pads 1703, 1703*a*, 1703*b*, 1705 and 1705*a* described herein may be replaced with adhesive elastic pads 1703*c*. Adhesive pads 1703*c* may include an adhesive layer 1732 and friction layer 1734. Adhesive layer 1732 may include adhesive or glue material to attach pad 1703*c* to mounting unit 1701 or 1702 by the adhesive or glue material. For example, adhesive layer 1732 may replace the protrusions, pits and grooves described herein above in attaching the pad to the mounting unit.

Similarly to pads 1703, 1703*a*, 1703*b*, 1705 and 1705*a*, a length A and or a width B of adhesive pad 1703*c*, and/or the shape of pad 1703*c*, may vary according to the specific needs or requirements, as described with more detail with reference to pads 1703, 1703*a*, 1703*b*, 1705 and 1705*a*.

Reference is now made to FIG. 18A, which schematically illustrates a side view of a front-to-back mounting unit including a connecting section, in accordance with an embodiment of the invention. In some embodiments, mounting unit 1801 may comprise at least one rail, grip or connector configured for connecting at least one helmet accessory to the front-to-back mounting unit 1801. Mounting unit 1801 may be a front-to-back mounting unit, i.e., located on top of a helmet between the helmet's front end and the helmet's back end. In some embodiments, end 1803 of mounting unit 1801, which may be located at the back end of the helmet, may comprise an indent 1805 which may be used to connect mounting unit 1801 to a helmet, via seeming elements, e.g., screws 1814 (e.g., FIG. 18B), as will be explained herein below. In some embodiments, each of the typically two screws 1814 may be screwed through a corresponding nut 1813. According to some embodiments, each of the typically two nuts 1813 is inserted into a designated indent 1807 prior to screws 1814 being screwed into nuts 1813 through indent 1805 in order to tighten mounting unit 1801 onto a helmet. The bottom view of the back end 1803 of mounting unit 1801 illustrates indent 1807 to which nuts 1813 are inserted. In other embodiments, nuts 1813 may be an integral pan of back end 1803, and would thus be pre-inserted into back end 1803 of mounting unit 1801 prior to assembly of mounting unit 1801 onto a helmet.

According to some embodiments, back end 1803 may have two configurations; a short configuration 1803A and a long configuration 1803B. The difference between these two configurations is the length of the back portion of back end 1803. According to some embodiments, back end 1803 comprises two sides; a back side 1809, which is the side of back end 1803 that rests of the helmet once mounting unit 1801 is placed onto a helmet, and front side 1811, which is the side of back end 1803 that has no contact with a helmet once mounting unit 1801 is placed onto the helmet. The long configuration 1803B of back end 1803 has a longer front side 1800 compared to the short configuration 1803A of back end 1803. This difference between long configuration 1803B and short configuration 1803A appears with respect to the lack of appearance of screws 1814 between the mounting unit 1801 and the clipping element 1804 in long configuration 1803B (e.g., FIG. 18G-H), or appearance of screws 1814 between the mounting unit 1801 and the clipping element 1804. In short configuration 1803A the screws 1814 may be visible to a user, in between mounting unit 1801 and clipping element 1804, whereas in long configuration 1803B, the screws may not be visible to a user but would instead be covered by the long front side 1811.

Reference is now made to FIG. 18B, which schematically illustrates a side view of a front-to-back mounting unit to be installed on top of a helmet, prior to full installation, in accordance with an embodiment of the present invention. According to some embodiments, mounting unit 1801 may be positioned on top of a helmet, e.g., helmet 1820, between the front edge of helmet 1820 and the back edge of helmet 1820. Prior to firmly installing mounting unit 1801 onto helmet 1820, clip or clipping element 1804 is not yet connected to back end 1803 of mounting unit 1801.

Reference is now made to FIG. 18C, which schematically illustrates a perspective back side view of a front-to-back mounting unit to be installed on top of a helmet, prior to full installation, in accordance with an embodiment of the present invention. The perspective view of mounting unit 1801 placed onto helmet 1820 further illustrates the location of mounting unit 1801 with respect to helmet 1820, and with respect to the other elements that are to be used in order to secure mounting unit 1801 to helmet 1820, e.g., clip 1804 and screws 1814. In some embodiments, clip 1804 may comprise a passage through which screw 1814 may pass. Typically, clip 1804 may comprise at least one passage. In some embodiments, when more than one passage is implemented as part of clip 1804, the passages may be located parallel to one another. In some embodiments, each of the at least one passages enables passage of one of screws 1814. That is, the number of screws 1814 that may be used to fasten mounting unit 1801 onto helmet 1820 is identical to the number of passages within clip 1804. For example, in case clip 1804 comprises two parallel passages 1804A and 1804B, screw 1814A may be intended to be screwed through passage 1804A, and screw 1814B may be intended to be screwed through passage 1804B. Other numbers of corresponding screws and passages may be implemented.

Reference is now made to FIGS. 18D-18F, which schematically illustrates a side view of a front-to-back mounting unit to be installed on top of a helmet, during a first, second and third stages of installation, respectively, in accordance with an embodiment of the present invention. According to some embodiments, FIG. 18D schematically illustrates the first stage of installation of mounting unit 1801 onto helmet 1820, which may comprise inserting each of screws 1814 through clip 1804. FIG. 18E schematically illustrates a side view of a front-to-back mounting unit to be installed on top of a helmet, during a second stage of installation, in accordance with an embodiment of the present invention. During the second stage of installation, screws 1814 may be screwed or threaded through the passages within clip 1804, e.g., passages 1804A and 1804B, and then through nuts 1813 that are pre-positioned along the sides of back end 1803 of mounting unit 1801. At the second stage of installation, the screws 1814 are threaded into clip 1804 and then into back end 1803, though not fully tightened. For example, during the second stage of installation, screws 1814 may be manually threaded through clip 1804 and through back end 1803. Screws 1814 are not fully tightened, such that distance D1 is present between clip 1804 and back end 1803.

FIG. 18F schematically illustrates a side view of a front-to-back mounting unit to be installed on top of a helmet, during a third stage of installation, in accordance with an embodiment of the present invention. During the third and final stage of installation of mounting unit 1801 onto helmet 1820, screws 1814 may be fully screwed and threaded through clip 1804 and into back end 1803 such that the distance between clip 1804 and back end 1803 of mounting unit 1801 is now D2, whereas D2 is smaller than D1. This indicates that clip 1804 is brought to an ideal proximity to back end 1803 and thus mounting unit 1801 is brought to an ideal position along the surface of helmet 1820 such that the distance between mounting unit 1801 and the surface of helmet 1820, specifically along the crown section of helmet 1820 or along other possible surface gaps, is small, which is equivalent to a tight fit of mounting unit 1801 onto helmet 1820. In some embodiments, the difference between distances D1 and D2 depends on the difference between the shape curves of helmet 1802 and the shape curves of mounting unit 1801. If the shape of helmet 1820 is similar to the shape of mounting unit 1801, there would be an initial better fit between helmet 1820 and mounting unit 1801, such that less force should be applied in order to forcefully attach mounting unit 1801 onto helmet 1820. However, since helmets have great variance in sizes and shapes, the fit between mounting unit 1801 and the helmet it is to be placed onto, may not be so accurate, which is when greater forces may be applied onto mounting unit 1801 such to squeeze it onto a helmet, e.g., helmet 1820, and then distance D2 is substantially smaller compared to D1.

In some embodiments, mounting unit 1801 may be manufactured from a rigid-flexible material. For example, mounting unit 1801 may be made of POM (Polyoxymethylene). In other embodiments, other materials may be used. Mounting unit 1801 may be flexible when bending forces are applied onto it while being rigid when tension forces are applied onto it. This enables the use of substantially one type of mounting unit 1801 per any helmet of any size and shape. Mounting unit 1801 may be configured to be assembled onto substantially any helmet of any size and shape. Once mounting unit 1801 is able to be stretched along the helmet, it is almost irrelevant what size or shape the helmet is, since the mounting unit 1801 adjusts its shape and is forcefully pulled along the surface of any helmet.

In addition, some helmets may be manufactured with a coating, e.g., color coating of various types of material, or with covers, e.g., rubber type cover. Such additional layers (coatings or covers) that are present on the helmet may provide high physical friction between the helmet and mounting unit 1801. In such case, the Torque force that is to be applied in order to squeeze mounting unit 1801 onto helmet 1820 would be smaller than the force required when no such cover or coating are present on helmet 1820. This final installation step may be manually performed by a user, e.g., via a manual screwdriver. However, in order to reach better results of a fully secured mounting unit 1801 onto helmet 1820, it is recommended for a user to use an electric screwdriver that may apply greater forces onto screws 1814 and thus apply great forces onto mounting unit 1801 and squeeze it onto helmet 1820. In some embodiments, mounting unit 1801 is configured to withstand Torque forces between 0.1 Nm and up to 200 Nm, e.g., 30-40 Nm, and thus to be tightly secured and squeezed onto helmet 1820.

As illustrated in FIGS. 18E-F, once clip 1804 is attached to the back edge of helmet 1820, the position of clip 1804 is constant and may not change due to the presence of the back edge of helmet 1820 (i.e., clip 1804 cannot move past the back edge of helmet 1820), and once the screws 1814 are screwed through the passages of clip 1804, it is the mounting unit 1801 that is puled towards clip 1804 and is thus forcefully squeezed onto the helmet, e.g., helmet 1820. For example, distance D1 between clip 1804 and back end 1803 of mounting unit 1801 illustrated in FIG. 18E becomes smaller and is designated by distance D2 illustrated in FIG. 18F, following the pulling and squeezing of mounting unit 1801 towards clip 1804.

Reference is now made to FIG. 18G, which schematically illustrates a back view of a front-to-back mounting unit installed on top of a helmet, in accordance with an embodiment of the present invention. FIG. 18G illustrates a back-view of mounting unit 1801 after it is squeezed and fully secured onto helmet 1820. In this embodiment, mounting unit 1801 comprises of the long configuration of back end 1803, such that the screws 1814 are not visible to a user of helmet 1820. Following ideal squeeze of screws 1814 into clip 1804 and through back end 1803, the mounting unit 1801 is tightly secured onto helmet 1820 in a manner that is impossible to release/move by pulling the mounting unit 1801 away from helmet 1820. That is, ideal squeeze force is applied between mounting unit 1801 and helmet 1820.

Reference is now made to FIG. 18H, which schematically illustrates a bottom-side view of a front-to-back mounting unit installed on top of a helmet, in accordance with an embodiment of the present invention. FIG. 18H illustrates how screws 1814 are fully screwed into clip 1804, and through back end 1803 such to tightly fasten mounting unit 1801 onto helmet 1820.

It will be appreciated that in some embodiments of the present invention, the configuration of front-to-back mounting unit 1801 and its tight attachment via squeeze onto a helmet, may be applied on a side-to-side type mounting unit as well. A side-to-side mounting unit may be attached onto a helmet through fastening or clipping means such as clip 1804 and via securing elements such as screws that are screwed into clip 1804 and through one or both ends of the side-to-side mounting unit.

A helmet may have attached thereon either a front-to-back mounting unit or a side-to-side mounting unit or both.

In some embodiments, the side-to-side mounting unit may comprise at least one rail, grip or connector configured for connecting at least one helmet accessory to the side-to-side mounting unit. In some embodiments, the front-to-back mounting unit is crossed by the side-to-side mounting unit in the middle of the front-to-back mounting unit.

It will be appreciated that in some embodiments of the present invention, the friction and/or adjustment pads are integral with the mounting unit, for example produced as one piece including a rigid portion to function as a mounting unit and an elastic portion to function as friction and/or adjustment pads.

Additionally, it will be appreciated by a person skilled in the art that the description provided herein of the front-to-back unit and its corresponding friction/adjustment pads may be applied with the required changes to the side-to-side unit and its corresponding friction/adjustment pads, and vice versa. For example, according to some embodiments of the present invention, there is provided a helmet mounting, assembly for attaching helmet accessories to a helmet, comprising: a side-to-side mounting unit comprising at least one rail, grip or connector configured for connecting at least one helmet accessory to the first mounting unit; at least one elastic friction pads attached to a bottom side of the front-to-back mounting unit; and at least one clipping elements for attaching side edges of the side-to-side mounting unit to side edges of the helmet, respectively, and pulling the side-to-side mounting unit forcefully onto the helmet to squeeze the pad between the mounting unit and the helmet. Optionally, the helmet mounting assembly of claim includes a front-to-back mounting unit configured to be placed and connected across side-to-side mounting unit.

The corresponding structures, materials, acts, and equivalents of all means or step plus function elements in the claims below are intended to include any structure, material, or act for performing the function in combination with other claimed elements as specifically claimed. As used herein, the singular forms "a", "an" and "the" are intended to include the plural forms as well, unless the context clearly indicates otherwise. It will be further understood that the terms "comprises" and/or "comprising" and/or "having" when used in this specification, specify the presence of stated features, integers, steps, operations, elements, and/or components, but do not preclude the presence or addition of one or more other features, integers, steps, operations, elements, components, and/or groups thereof.

The terminology used herein should not be understood as limiting, unless otherwise specified, and is for the purpose of describing particular embodiments only and is not intended to be limiting of the disclosed subject matter. While certain embodiments of the disclosed subject matter have been illustrated and described, it will be clear that the disclosure is not limited to the embodiments described herein. Numerous modifications, changes, variations, substitutions and equivalents are not precluded.

The invention claimed is:

1. A helmet mounting assembly for attaching a helmet mounting unit to a helmet, comprising:

a front-to-back mourning unit configured for connecting at least one helmet accessory to the front-to-back mounting unit, said front-to-back mounting unit comprising a front end and a back end;

at least one front clipping element connected to the front end of the front-to-back mounting unit and configured to attach to a front edge of the helmet; and at least one back clipping element configured to attach to the back end of the front-to-back mounting unit and to a back edge of the helmet, wherein said front-to-back mounting unit comprises at least one nut connected to an internal side of the front-to-back mounting unit, and said at least one back clipping element comprises at least one hole corresponding to the at least one nut, said at least one hole extending from a bottom end of the back clipping element to a top end of the back clipping element, wherein the back clipping element is attached to the front-to-back mounting unit via at least one screw screwed through said at least one hole into said at least one nut, such that said at least one screw does not penetrate into the helmet;

further wherein the more the at least one screw is screwed into the at least one nut, the more the at least one nut is pulled towards the back edge of the helmet to thereby pull the front-to-back mounting unit towards the back edge of the helmet with it, such to tighten and squeeze the front-to-back mounting unit onto a helmet surface and thereby to forcefully press the front-to-back mounting unit onto the helmet surface.

2. The helmet mounting assembly of claim 1, further comprising a second mounting unit configured to be placed and connected across the front-to-back mounting unit.

3. The helmet mounting assembly of claim 1, wherein said front-to-hack mounting unit is configured to be assembled onto various sized and shaped helmets.

4. The helmet mounting assembly of claim 1, wherein the at least one front clipping element is configured to attach to the front edge of the helmet without screws.

5. The helmet mounting assembly of claim 1, wherein the at least one screw is screwed from a bottom end of said at least one back clipping element.

* * * * *